US008351817B2

(12) United States Patent
Saitoh et al.

(10) Patent No.: US 8,351,817 B2
(45) Date of Patent: Jan. 8, 2013

(54) COOLING DEVICE AND IMAGE FORMING DEVICE

(75) Inventors: Masanori Saitoh, Tokyo (JP); Satoshi Okano, Kanagawa (JP); Tomoyasu Hirasawa, Kanagawa (JP); Shingo Suzuki, Kanagawa (JP); Kenichi Takehara, Kanagawa (JP); Yasuaki Iijima, Kanagawa (JP); Takayuki Nishimura, Tokyo (JP); Hiromitsu Fujiya, Kanagawa (JP); Keisuke Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 319 days.

(21) Appl. No.: 12/805,717

(22) Filed: Aug. 16, 2010

(65) Prior Publication Data

US 2011/0052247 A1 Mar. 3, 2011

(30) Foreign Application Priority Data

| | | |
|---|---|---|
| Aug. 26, 2009 | (JP) | 2009-196134 |
| Sep. 15, 2009 | (JP) | 2009-213499 |
| Sep. 15, 2009 | (JP) | 2009-213561 |
| May 14, 2010 | (JP) | 2010-111837 |
| May 14, 2010 | (JP) | 2010-111919 |
| May 14, 2010 | (JP) | 2010-111922 |

(51) Int. Cl.

| | |
|---|---|
| ***G03G 21/20*** | (2006.01) |
| ***G03G 15/00*** | (2006.01) |
| ***F28D 11/02*** | (2006.01) |

(52) U.S. Cl. ..... 399/94; 399/406; 399/407; 165/89

(58) Field of Classification Search ..... 399/94, 399/96, 406, 407; 165/89

See application file for complete search history.

(56) References Cited

U.S. PATENT DOCUMENTS

| | | | | |
|---|---|---|---|---|
| 7,280,795 | B2 * | 10/2007 | Kakishima et al. | 399/341 |
| 2007/0059023 | A1 | 3/2007 | Koshida | |
| 2007/0166071 | A1 * | 7/2007 | Shima | 399/94 |
| 2008/0014003 | A1 | 1/2008 | Smeyers et al. | |

(Continued)

FOREIGN PATENT DOCUMENTS

| | | | |
|---|---|---|---|
| JP | 08129310 | A | 5/1996 |

(Continued)

OTHER PUBLICATIONS

Abstract of JP-2006-003819 (which corresponds to JP-4445336-B2) published Jan. 5, 2006.

(Continued)

*Primary Examiner* — Joseph S Wong

(74) *Attorney, Agent, or Firm* — Harness, Dickey & Pierce, P.L.C.

(57) ABSTRACT

A cooling device includes a cooling roller having a dual tube structure including an inner tube disposed inside an outer tube, an outside flow passage and an inside flow passage in which a cooling medium flows, and an opening that allows the outside flow passage to communicate with the inside flow passage, a cooling medium transport unit, and a rotating tube joint unit mounted to one end side of the cooling roller. One end of the outer tube is coaxially rotatably fitted to a first fitting section of the rotating tube joint unit. One end of the inner tube is coaxially fitted into and rotatably or fixedly supported to a second fitting section of the rotating tube joint unit, and the other end is coaxially fitted into and rotatably or fixedly supported to a fitting section on the other end of the outer tube.

20 Claims, 53 Drawing Sheets

U.S. PATENT DOCUMENTS

| | | | | |
|---|---|---|---|---|
| 2009/0092427 | A1 | 4/2009 | Goretzky et al. | |
| 2009/0269099 | A1 * | 10/2009 | Takehara | 399/94 |
| 2010/0129107 | A1 | 5/2010 | Takehara et al. | |

FOREIGN PATENT DOCUMENTS

| | | | |
|---|---|---|---|
| JP | 3478676 | B2 | 2/1998 |
| JP | 10207155 | A | 8/1998 |
| JP | 11007218 | A | 1/1999 |
| JP | 2000075709 | A | 3/2000 |
| JP | 2002229366 | A | 8/2002 |
| JP | 3987399 | B2 | 3/2004 |
| JP | 2005234205 | A | 9/2005 |
| JP | 2005234206 | A | 9/2005 |
| JP | 2005292578 | A | 10/2005 |
| JP | 2005292594 | A | 10/2005 |
| JP | 4265996 | B2 | 12/2005 |
| JP | 4445336 | B2 | 1/2006 |
| JP | 2006058493 | A | 3/2006 |
| JP | 2006091095 | A | 4/2006 |
| JP | 2006225115 | A | 8/2006 |
| JP | 4380559 | B2 | 9/2006 |
| JP | 2006258953 | A | 9/2006 |
| JP | 2007078917 | A | 3/2007 |
| JP | 2007119109 | A | 5/2007 |

OTHER PUBLICATIONS

Abstract of JP-2005-349627 (which corresponds to JP-4265996-B2) published Dec. 22, 2005.
Abstract of JP-2004-085634 (which corresponds to JP-3987399-B2) published Mar. 18, 2004.
Abstract of JP-2006-232415 (which corresponds to JP-4380559-B2) published Sep. 7, 2006.
Abstract of JP-10-048868 (which corresponds to JP-3478676-B2) published Feb. 20, 1998.
European Search Report dated Feb. 25, 2011.

* cited by examiner

COOLING DEVICE AND IMAGE FORMING DEVICE

CROSS-REFERENCE TO RELATED APPLICATIONS

The present application claims priority to and incorporates by reference the entire contents of Japanese Patent Application No. 2009-196134 filed in Japan on Aug. 26, 2009, Japanese Patent Application No. 2009-213561 filed in Japan on Sep. 15, 2009, Japanese Patent Application No. 2009-213499 filed in Japan on Sep. 15, 2009, Japanese Patent Application No. 2010-111837 filed in Japan on May 14, 2010, Japanese Patent Application No. 2010-111919 filed in Japan on May 14, 2010 and Japanese Patent Application No. 2010-111922 filed in Japan on May 14, 2010.

BACKGROUND OF THE INVENTION

1. Field of the Invention

The present invention relates to a cooling device that cools down a sheet-like member used in an image forming device such as a printer, a facsimile, and a copy machine, and an image forming device.

2. Description of the Related Art

Image forming devices that form a toner image on a paper that is a sheet-like member using an electrophotography technique and gets the toner image through a heat fixing device to melt and fuse a toner have been known. Generally, the temperature of the heat fixing device depends on a type of a toner or a paper or a paper transport speed but is controlled to be set to a temperature of about 180° C. to 200° C. to quickly fuse the toner. A surface temperature of the paper after passing through the heat fixing device depends on a heat capacity (e.g., specific heat or density) of the paper but has a high temperature of, for example, about 100° C. to 130° C. Since a melting temperature of the toner is lower, at a point in time directly after passing through the heat fixing device, the toner is in a slightly softened state and is in an adhesive state for a while until the paper is cooled down. Thus, when an image output operation is continuously repeated and papers having passed through the heat fixing device are stacked on a discharge paper receiving unit, if the toner on the paper is not sufficiently hardened but in a soft state, the toner on the paper may be attached to another paper, so that a so-called blocking phenomenon may be caused, remarkably degrading the image quality.

In an image forming device disclosed in Japanese Patent Application Laid-Open (JP-A) No. 2006-003819, a cooling device with a cooling roller that is rotatably supported to a bracket through a bearing and comes in contact with a paper to cool down the paper while transporting the paper is disposed at a down stream side of a heat fixing device in a paper transport direction. The paper having passed through the heat fixing device is cooled down by the cooling roller of the cooling device, so that the toner on the paper is also cooled down and hardened, thereby preventing the occurrence of the blocking phenomenon. The cooling roller has a tubular structure. A cooling liquid flows inside the cooling roller from one end side to the other end side in a longitudinal direction of the cooling roller, and so the cooling roller raised in temperature by depriving heat from the paper is cooled down by the cooling liquid.

In a configuration in which the cooling liquid flows inside the cooling roller from one end side to the other end side in the longitudinal direction of the cooling roller, a rotary joint connecting a pump for feeding the cooling liquid with the cooling roller through a tube needs to be disposed at both ends of the cooling roller, which may lead to a large-sized image forming device. For this reason, as illustrated in FIG. 54, a cooling device in which a rotary joint 135 is disposed at one side of the cooling roller 122 is used. Therefore, compared to the case where the rotary joint 135 is disposed at both ends of the cooling roller 122, the size of the image forming device can be prevented from being increased.

The cooling roller has a dual tube structure in which an inner tube is disposed inside an outer tube, and an outside flow passage that allows the cooling liquid to flow through a space between the outer tube and the inner tube and an inside flow passage that allows the cooling liquids to flow inside the inner tube are formed. The cooling liquid flows in the outside flow passage and the inside flow passage from one end side to the other end side in the axial direction of the cooling roller and deprives the paper of heat, so that the cooling roller having a high temperature is cooled down by the cooling liquid. Since the cooling roller has the dual tube structure, the cooling liquid flowing through the outer flow passage can be cooled down as the cooling liquid flowing through the inner flow passage receives heat of the cooling liquid, heated by heat from the cooling roller, flowing through the outer flow passage, whereby the cooling performance of the cooling roller can be increased. In the configuration in which the cooling liquid flows through the outside flow passage and the inside flow passage inside the cooling roller from one end side to the other end side in the longitudinal direction of the cooling roller, a rotary joint connecting a pump for feeding the cooling liquid with the cooling roller through a tube is mounted to both ends of the cooling roller.

The cooling roller 122 illustrated in FIG. 54 has a dual tube structure in which an inner tube 122*b* is disposed inside an outer tube 122*a*, and an outside flow passage that allows the cooling liquid to flow through a space between the outer tube 122*a* and the inner tube 122*b* and an inside flow passage that allows the cooling liquid to flow inside the inner tube 122*b* are formed. The cooling roller 122 is rotatably supported to a bracket 134 of the cooling device through bearings 140 and 141. An opening 122*m* is formed in an end section of the inner tube 122*b* at the rotary joint 135 side, and an opening 122*k* allowing the outside flow passage to communicate with the inside flow passage is formed in an end section of the inner tube 122*b* at a side opposite to the rotary joint 135 side. The cooling liquid is fed to the inside of the rotary joint 135 through a feed port formed in the rotary joint 135, passes through the outside flow passage, and flows into the inside of the inner tube 122*b* through the opening 122*k*. The cooling liquid flowing into the inside of the inner tube 122*b* passes through the inner tube 122*b*, is drained to the outside of the inner tube 122*b* through the opening 122*m*, and is drained from a drain port formed in the rotary joint 135.

In the cooling roller 122 illustrated in FIG. 54, the inner tube 122*b* is supported to the rotary joint 135 in a cantilever state. For this reason, a free end of the inner tube 122*b* easily vibrates by the flow of the cooling liquid fed to the inside of the outer tube 122*a*. The vibration is transmitted from the inner tube 122*b* to the rotary joint 135, so that the rotary joint 135 vibrates. Further, since the outer tube 122*a* and the rotary joint 135 are screw-coupled by screws thereof and fixed, rattling is harsh, so that axis misalignment between the outer tube 122*a* and the rotary joint 135 is likely to occur. If axis misalignment between the outer tube 122*a* and the rotary joint 135 occurs, the rotary joint 135 vibrates due to eccentricity when the outer tube 122*a* rotates.

If the rotary joint 135 vibrates, a load is applied to a coupling section between the outer tube 122*a* and the rotary joint 135, and thus there occurs a problem in that durability is lowered, and the cooling liquid leaks from the coupling section. Further, the vibration of the rotary joint 135 is transmitted to the outer tube 122*a*, and rotation accuracy of the outer tube 122*a* is lowered. Therefore, there occurs a problem in that the sheet-like member is not properly transported.

The inventors of the present application conducted an experiment in a state in which the cooling device in which the rotary joint is mounted to both ends of the cooling roller is mounted in the image forming device that performs image forming at a high speed. At this time, a phenomenon that the rotary joint vibrates occurred. If the rotary joint vibrates, a load is applied to the coupling section between the outer tube and the rotary joint, and thus there occurs a problem in that durability is lowered, and the cooling liquid leaks from the coupling section. Further, the vibration of the rotary joint is transmitted to the outer tube, and the rotation accuracy of the outer tube is lowered. Therefore, there occurs a problem in that the sheet-like member is not properly transported.

As a result of repetitively doing research with all their heart, the inventors of the present application found out that the rotary joint vibrates due to the following reasons. If the outer tube and the rotary joint are screw-coupled by screws thereof and fixed, rattling is harsh, so that axis misalignment between the outer tube and the rotary joint is likely to occur. Further, if the inner tube and the rotary joint are screw-coupled by screws thereof and fixed, rattling is harsh, so that axis misalignment between the inner tube and the rotary joint is likely to occur. If axis misalignment occurs between the inner tube and the rotary joint, axis misalignment occurs between the rotary joint mounted to the one end side of the inner tube and the rotary joint mounted to the other end side. Then, axis misalignment also occurs between the outer tube and the rotary joints. Accordingly, it was found out that axis misalignment occurred between the outer tube and the rotary joints causes eccentricity when the outer tube rotates, vibrating the rotary joint.

Meantime, as an image forming process speed of the image forming device of the electrophotography type increases, the image forming device of the electrophotography type started to be used for the purpose of continuously performing an image forming process (a printing process) over a long time (for example, several days) by continuously passing a recoding medium such as a paper, as in a printing process. The image forming device of the electrophotography type can perform an image forming process of 100 to 120 pieces of A4-size papers per minute and thus is called as a high speed machine. If the cooling roller rotates to satisfy high speed printing of 100 to 120 pieces per minute, the above-described problem resulting from vibration of the rotary joint becomes remarkable. That is, as the cooling roller rotates at a high speed, a burden of the coupling section between the outer tube and the rotary joint increases, so that there is a possibility that the cooling liquid will leak or the vibration of the rotary joint will influence image forming.

SUMMARY OF THE INVENTION

It is an object of the present invention to at least partially solve the problems in the conventional technology.

According to one aspect of the present invention, a cooling device includes a cooling roller having a dual tube structure in which an inner tube is disposed inside an outer tube, and an outside flow passage in which a cooling medium flows between the outer tube and the inner tube and an inside flow passage in which a cooling medium flows inside the inner tube are formed, including an opening, formed in the inner tube, that allows the outside flow passage to communicate with the inside flow passage, and being rotatably supported to a housing of a device main body through bearings, a cooling medium transport unit that transports the cooling medium, and a rotating tube joint unit that is mounted to one end side of the cooling roller so that the cooling roller is rotatable and connects the cooling roller with the cooling medium transport unit through a pipe. The cooling roller contacts a sheet-like member to cool down the sheet-like member, one end side of the outer tube is coaxially rotatably fitted into and mounted to a first fitting section of the rotating tube joint unit, and one end side of the inner tube is coaxially fitted into and rotatably or fixedly supported to a second fitting section of the rotating tube joint unit, and the other end side is coaxially fitted into and rotatably or fixedly supported to a fitting section formed at the other end side of the outer tube.

According to another aspect of the present invention, an image forming device includes the cooling device according to the above-described aspect.

According to still another aspect of the present invention, a cooling device includes a cooling roller having a dual tube structure in which an inner tube is disposed inside an outer tube, and an outside flow passage in which a cooling medium flows between the outer tube and the inner tube and an inside flow passage in which a cooling medium flows inside the inner tube are formed and being rotatably supported to a housing of a device main body through a bearings, a cooling medium transport unit that transports the cooling medium; and a rotating tube joint unit that is mounted to both ends of the cooling roller so that the cooling roller is rotatable and connects the cooling roller with the cooling medium transport unit. The cooling roller contacts a sheet-like member to cool down the sheet-like member, fitting sections formed at both ends of the outer tube are coaxially rotatably fitted into first fitting sections of the rotating tube joint unit, respectively, and fitting sections formed at both ends of the inner tube are coaxially fitted into second fitting sections of the rotating tube joint unit, respectively, in a rotatable or fixed state.

According to still another aspect of the present invention, an image forming device includes the cooling device according to the above-described aspect.

According to still another aspect of the present invention, a cooling device includes a cooling roller having a dual tube structure in which an inner tube is disposed inside an outer tube, and an outside flow passage in which a cooling medium flows between the outer tube and the inner tube and an inside flow passage in which a cooling medium flows inside the inner tube are formed and being rotatably supported to a housing of a device main body through bearings, a cooling medium transport unit that transports the cooling medium, and a rotating tube joint unit that is mounted to both ends of the cooling roller so that the cooling roller is rotatable and connects the cooling roller with the cooling medium transport unit. The cooling roller contacts a sheet-like member to cool down the sheet-like member, and a flow direction of a cooling medium, in the outside flow passage, transported to the outside flow passage by the cooling medium transport unit is reverse to a flow direction of a cooling medium, in the inside flow passage, transported to the inside flow passage by the cooling medium transport unit in an axial direction of the cooling roller.

According to still another aspect of the present invention, an image forming device includes the cooling device according to the above-described aspect.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of the present invention will be described.

Embodiment 1

Embodiment 1-1

A cooling roller and a cooling device according to embodiment 1 of the present invention will be described in connection with an image forming device that fixes a toner on a recording paper by a heat fixing unit. However, the cooling roller and the cooling device of the present invention are not limited thereto but can be applied to any device requiring cooling of a sheet medium.

The cooling roller as a cooling unit has a tubular structure and enables the cooling liquid to flow and be circulated thereinside to cool down a surface of the cooling roller. The cooling device having the cooling roller is disposed in a paper transport path directly next to a heat fixing unit, and the cooling roller comes in contact with the paper while transporting the paper, thereby removing heat from the paper and cooling down the paper.

Figure 2:
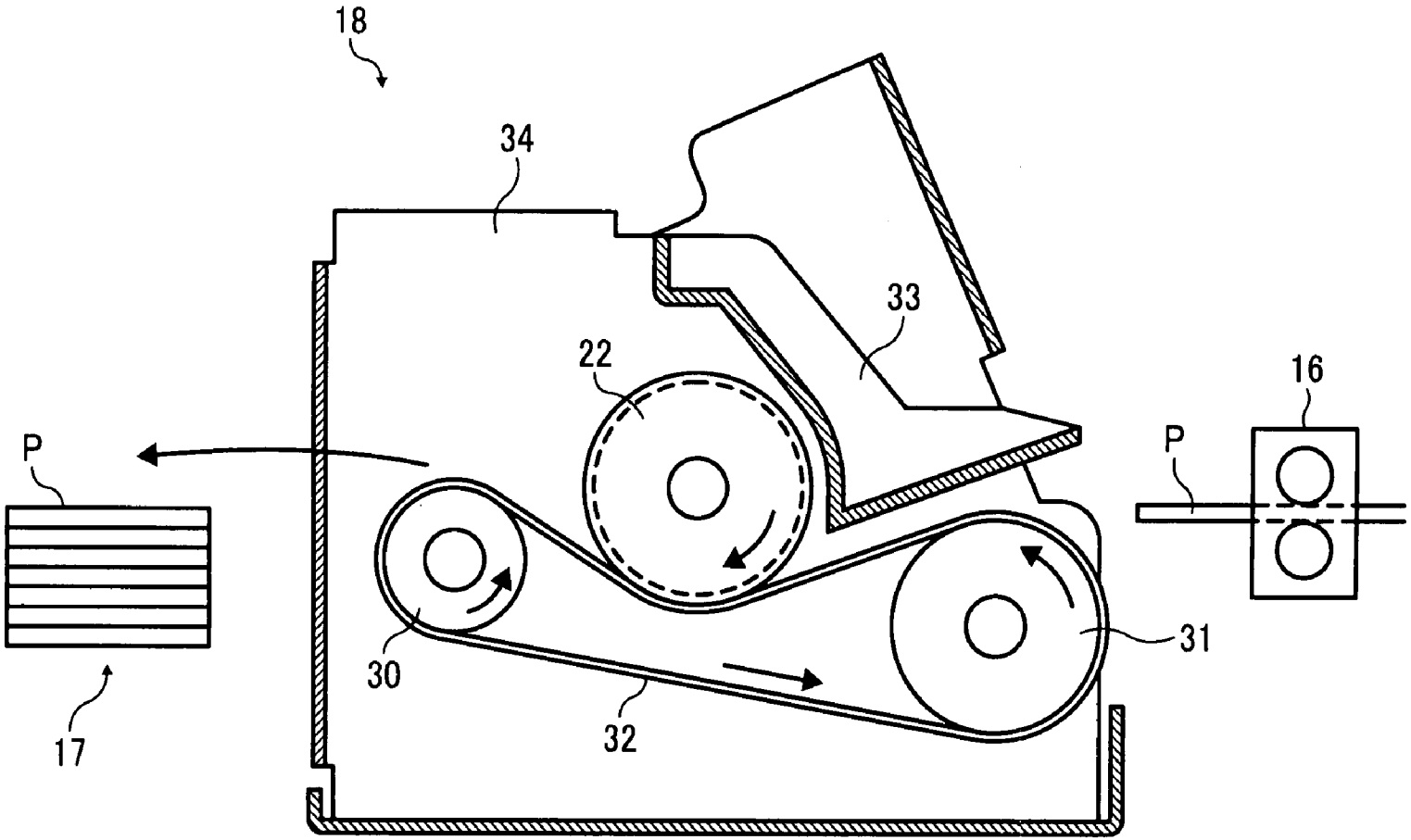
FIG. 2 is an explanation view illustrating a schematic configuration example (1) of the cooling device of the embodiment 1-1.

FIG. 2 is a schematic view of an example (1) of a cooling device 18 having a cooling roller 22 of the present invention which also functions to transport the paper. In the cooling device 18, a roller 30 and a roller 31 which are disposed apart from each other in a transport direction of a paper P as a sheet-like member (a left-right direction) are disposed, and a transport belt 32 for transporting the paper is extended. The roller 30 at a downstream side in the paper transport direction is used as a driving roller (connected with a driving source (not shown)), and the transport belt 32 rotates counterclockwise to transport the paper from a right side to the left side in FIG. 2.

A heat fixing unit 16 is disposed at an upstream side of the cooling device 18 in the paper transport direction, and a discharge paper receiving unit 17 is disposed at a downstream side of the cooling device 18 in the paper transport direction. An upper guide 33 that guides the paper P transported from the heat fixing unit 16 is disposed above the roller 31. A cooling roller 22 downwardly press-contacts and digs into the transport belt 32 at an intermediate position between the roller 30 and the roller 31. The cooling roller 22 rotates together with the transport belt 32 by transport force of the transport belt 32. In FIG. 2, a reference numeral 34 represents a bracket that constitutes a main body of the cooling device 18 and a member that fixedly or rotatably supports components such as the roller 30, the roller 31, the cooling roller 22, and the upper guide 33. The cooling device 18 is constituted as one unit by the bracket 34 and mounted to a main body of an image forming device.

The paper P which was heated by the heat fixing unit 16 to become a high temperature passes through the cooling device 18 before being discharged to the discharge paper receiving unit 17. In detail, the paper P which becomes a high temperature through the heat fixing unit 16 enters between the upper guide 33 and the roller 31 of the cooling device 18, then passes through a nip area formed by the cooling roller 22 and the transport belt 32, and is discharged to the discharge paper receiving unit 17. The inside of the cooling roller 22 has a tubular structure. Since the inside of the cooling roller 22 has a tubular structure, the cooling liquid sufficiently cooled down in the outside is fed to the inside of the cooling roller 22, circulated inside the cooling roller 22, and then drained from the inside of the cooling roller 22. Since the paper P is passed through while closely contacting the cooling roller 22 in the nip area formed when the cooling roller 22 contacts the transport belt 32, the heat of the paper P is absorbed into the cooling roller 22, so that the paper P is sufficiently cooled down. For example, when the surface temperature of the paper P directly after passing through the heat fixing unit 16 is about 100° C., the paper P can be cooled down to about 50° C. to 60° C. by passing through the cooling device 18.

As will be explained later, the cooling roller 22 is communicated/connected with a cooling liquid circulation unit such as a tank 26, a pump 25, and a radiator 24 having a cooling fan 23 mounted therein through a rotating tube joint unit. The sealed cooling liquid is circulated to thereby cool down the cooling roller 22.

Configuration Example 1

Figure 1:
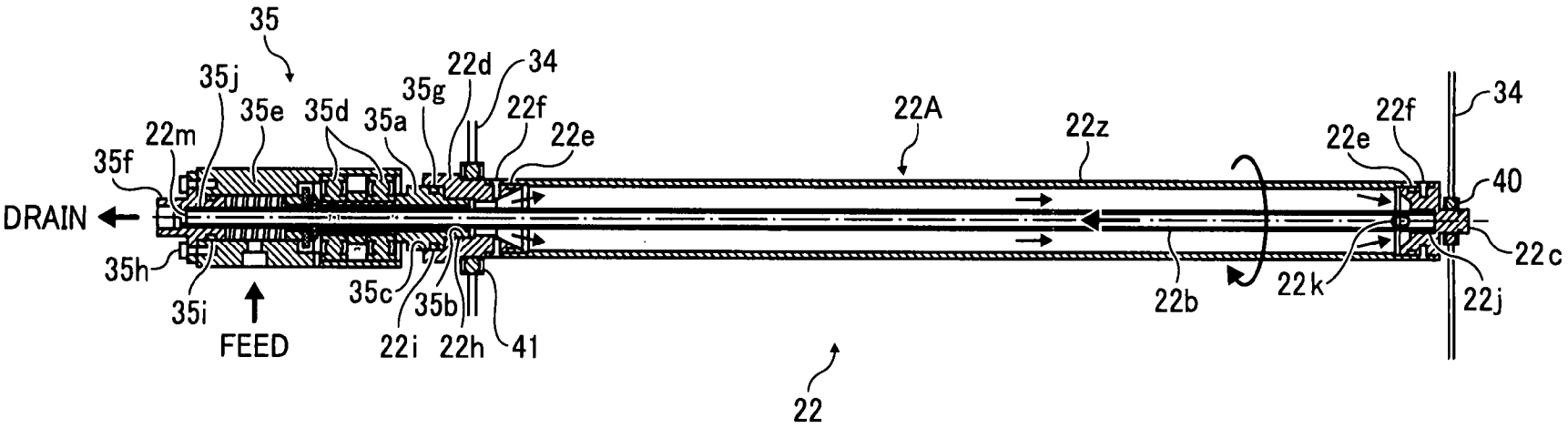
FIG. 1 is a cross-sectional view illustrating a schematic configuration of a cooling roller in which a rotary joint is mounted according to a configuration example 1 of an embodiment 1-1.
Figure 3:
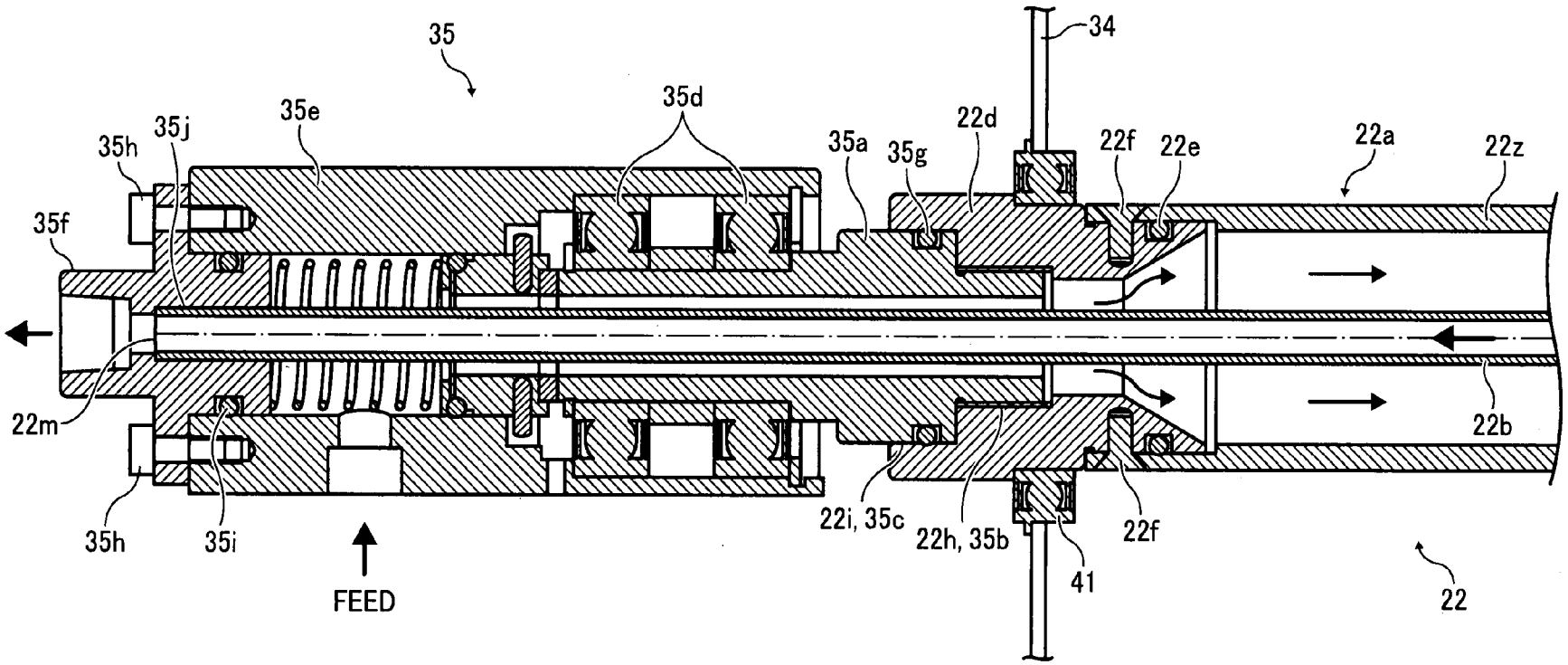
FIG. 3 is an enlarged view illustrating a longitudinal direction end of a cooling roller at a rotary joint side.
Figure 4:
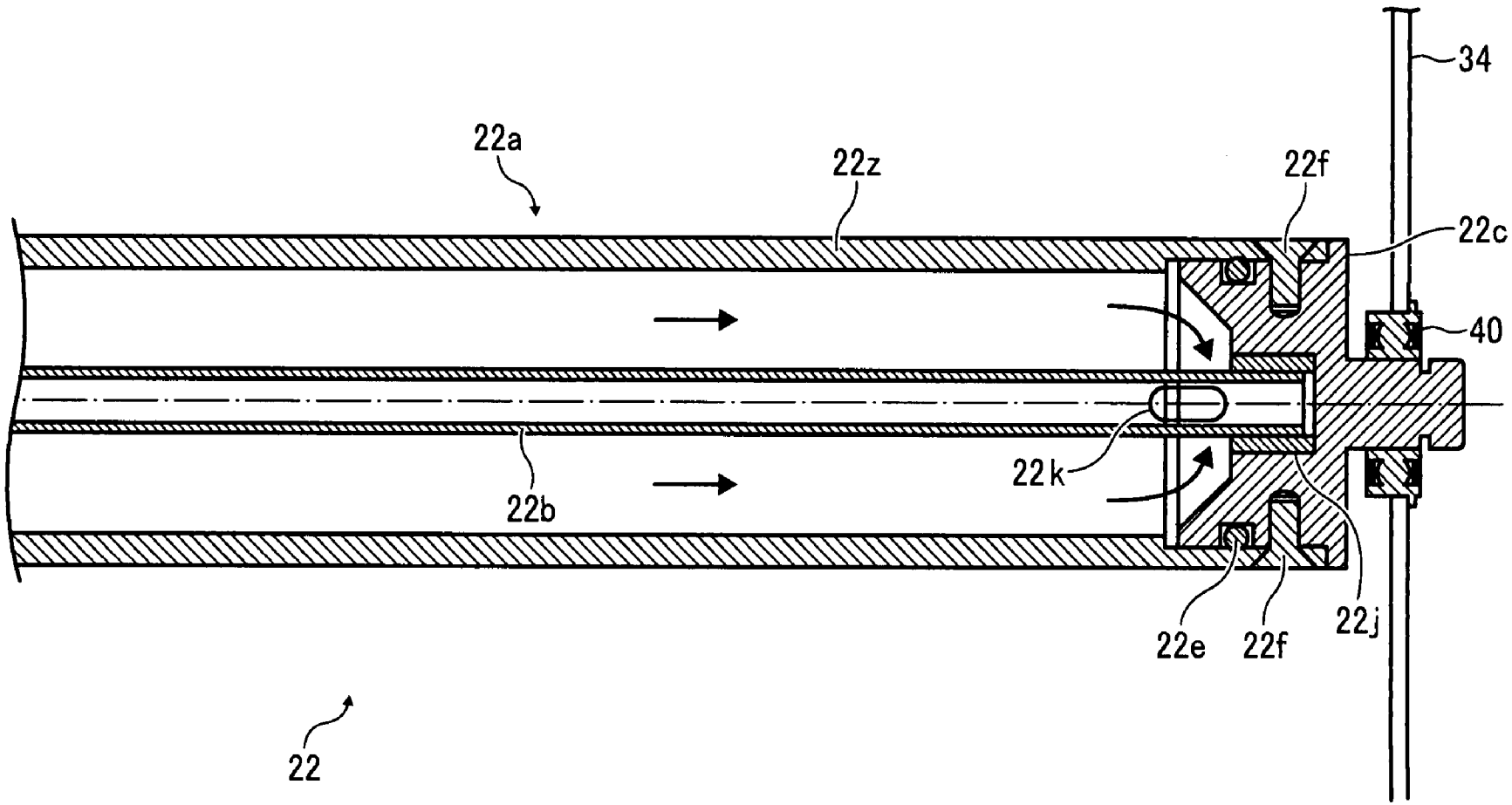
FIG. 4 is an enlarged view illustrating a longitudinal direction end of a cooling roller at a side opposite to a rotary joint.

FIG. 1 is a schematic cross-sectional view of a cooling roller 22 according to a configuration example 1. FIG. 3 is an enlarged view illustrating a longitudinal direction end of the cooling roller 22 at a rotary joint 35 side. FIG. 4 is an enlarged view illustrating a longitudinal direction end of the cooling roller 22 at a side opposite to the rotary joint 35. The cooling roller 22 has a dual tube structure in which an inner tube **22*b* is disposed inside an outer tube 22*a*, and an outside flow passage that allows the cooling liquid to flow through a space between the outer tube 22*a* and the inner tube 22*b* and an inside flow passage that allows the cooling liquids to flow inside the inner tube 22*b* are formed. An opening that allows the outside flow passage to communicate with the inside flow passage is formed near the longitudinal direction end of the inner tube 22*b* at the side opposite to the rotary joint 35**.

Longitudinal direction ends of the outer tube **22*a* are configured with a flange 22*c* having a shaft fitted into a bearing 40 and a flange 22*d* press-fitted into a bearing 41, respectively. O-rings 22*e* for leakage prevention are inserted into both the flange 22*c* and the flange 22*d*, and the flange 22*c* and the flange 22*d* are mounted to an outer tube barrel section 22*z* through screws 22*f*. That is, the outer tube 22*a* is configured with the outer tube barrel section 22*z*, the flange 22*c*, and the flange 22*d*. At this time, both of the flange 22*c* and the flange 22*d* are inserted into and mounted to the outer tube barrel section 22*z* in a fitting relationship. Thus, rattling between the flange 22***c* and the outer tube barrel section 22*z* and rattling between the flange 22*d* and the outer tube barrel section 22*z* are prevented, and the flange 22*c* and the flange 22*d* have the coaxiality with the outer tube barrel section 22*z*. Both ends of the cooling roller 22 are rotatably supported with respect to the bracket 34 of the cooling device 18 through the shaft of the flange 22*c* and the bearing 41 of the flange 22*d*.

Further, a coupling section including a parallel screw section 22*h* and a fitting section 22*i* is formed in the flange 22*d*. A rotor 35*a*, which has a parallel screw section 35*b* and a fitting section 35*c*, formed to face the coupling section is mounted to the flange 22*d*. The parallel screw section 22*h* and the parallel screw section 35*b* are screw-processed in a direction that is tightened against the rotation direction of the outer tube 22*a* (the transport direction of the paper P). The rotor 35*a* is a component of the rotary joint 35 and is rotatable. Since the rotor 35*a* and the flange 22*d* are inserted and mounted in the fitting relationship as described above, rattling between the rotor 35*a* and the flange 22*d* is prevented, and the rotor 35*a* and the flange 22*d* have the coaxiality with each other. The rotor 35*a* is rotatably supported to a casing 35*e* of the rotary joint 35 through a fitting relationship with two bearings 35*d* disposed with an interval therebetween. Therefore, the outer tube 22*a* is in a state which is coaxial to the casing 35*e* through the rotor 35*a* and the flange 22*d* mounted in the fitting relationship and thus can perform rotation with the high degree of accuracy. Further, an O-ring 35*g* is inserted into the rotor 35*a* to prevent the cooling liquid from leaking from the flange 22*d*.

In the cooling roller 22 of the present configuration, the outer tube 22*a* rotates, but the inner tube 22*b* is fixed (does not, rotates). The cooling roller 22 is appropriate to the case of actively generating turbulence against the flow (the flow in the axial direction and the rotation direction) of the cooling liquid in the outer tube 22*a*, particularly, is effective when employed in the case where the supply flow quantity of the cooling liquid is small or the flow velocity in a narrow space is slow.

As illustrated in FIG. 1, one end of the inner tube 22*b* is press-fitted into a fitting section 35*j* of the rotary joint 35 and fixedly supported not to rotate with respect to the rotary joint 35, and the other end of the inner tube 22*b* is supported to a bearing 22*j* disposed in the flange 22*c* of the outer tube 22*a* so that the flange 22*c* is rotatable with respect to the inner tube 22*b*.

The inner tube 22*b* is mounted to the rotary joint 35 such that the inner tube 22*b* is press-fitted into a fitting hole of a flange 35*f* mounted to the casing 35*e* so that the inner tube 22*b* is fixedly supported to the flange 35*f*, particularly, the rotary joint 35. An O-ring 35*i* for leakage prevention is inserted into the flange 35*f*, and the flange 35*f* is mounted to the casing 35*e* by a screw 35*h*.

Since the casing 35*e*, the flange 35*f*, and the inner tube 22*b* are inserted and mounted in the fitting relationship, rattling between the members is prevented, and the inner tube 22*b* has coaxiality with respect to the casing 35*e*. Further, since the flange 22*c*, the bearing 22*j*, and the inner tube 22*b* are inserted and mounted in the fitting relationship, rattling between the members is prevented, and the inner tube 22*b* has also coaxiality with respect to the flange 22*c*.

By the above-described configuration, in the cooling roller 22, at one end side of the cooling roller 22, the outer tube 22*a* and the inner tube 22*b* have coaxiality with reference to the rotary joint 35 (the casing 35*e*). The outer tube 22*a* is supported rotatably with respect to the rotary joint 35 (the casing 35*e*), and the inner tube 22*b* is fixedly supported not to rotate with respect to the rotary joint 35 (the casing 35*e*). At the other end side of the cooling roller 22, the outer tube 22*a* and the inner tube 22*b* have coaxiality through the flange 22*c*, and the inner tube 22*b* is supported to the flange 22*c* through the bearing 22*j* so that the outer tube 22*a* is rotatable with respect to the inner tube 22*b*.

An opening hole 22*k* is formed in an outer circumferential wall of the inner tube 22*b* at the flange 22*c* side, and a cross-sectional hole 22*m* is formed in an end section of the inner tube 22*b* at the rotary joint 35 side. The cooling liquid that is present in the outside flow passage formed in the space between the outer tube 22*a* and the inner tube 22*b* flows into the inside of the inner tube 22*b* through the opening hole 22*k* and is drain to the outside through the cross-section hole 22*m*.

The flow passage of the cooling liquid is indicated by an arrow. The cooling liquid fed to the inside of the rotary joint 35 through the feed port formed in the rotary joint 35 first passes through the narrow space between the inner tube 22*b* and the rotor 35*a* and then flows through the outside flow passage having the wide space formed between the outer tube 22*a* and the inner tube 22*b* toward the flange 22*c* side in the longitudinal direction of the cooling roller. At this time, the outer tube 22*a* is cooled down by the cooling liquid. In FIG. 1, the flow passage of the cooling liquid from the feed port of the rotary joint 35 to an end section of the outside flow passage at the flange 22*c* side in the longitudinal direction of the cooling roller is referred to as a forward flow passage. The cooling liquid fed up to the end section of the outside flow passage at the flange 22*c* side in the longitudinal direction of the cooling roller is U-turned through the opening hole 22*k* formed in the inner tube 22*b* to flow from the outside flow passage to the inside of the inner tube 22*b*. The cooling liquid flows inside the inner tube 22*b* in the longitudinal direction of the cooling roller reverse to the forward flow passage. The cooling liquid is drained to the outside of the inner tube 22*b* through the cross-section hole 22*m* and then drained to the outside of the rotary joint 35 through the drain port formed in the flange 35*f* of the rotary joint 35. Further, in FIG. 1, the flow passage of the cooling liquid from the opening hole 22*k* to the water drain port of the rotary joint 35 via the inside of the inner tube 22*b* is referred to a return flow passage.

As described above, the cooling roller 22 has the flow passage in which the cooling liquid flows back and forth and forms a closed-loop flow passage together with a cooling liquid circulating unit, which will be described later, through the rotary joint 35 to circulate the cooling liquid.

Further, the cooling roller 22 allows its components to be attached to or detached from for the purpose of reuse, recycling, or component replacement when a failure occurs.

Figure 5:
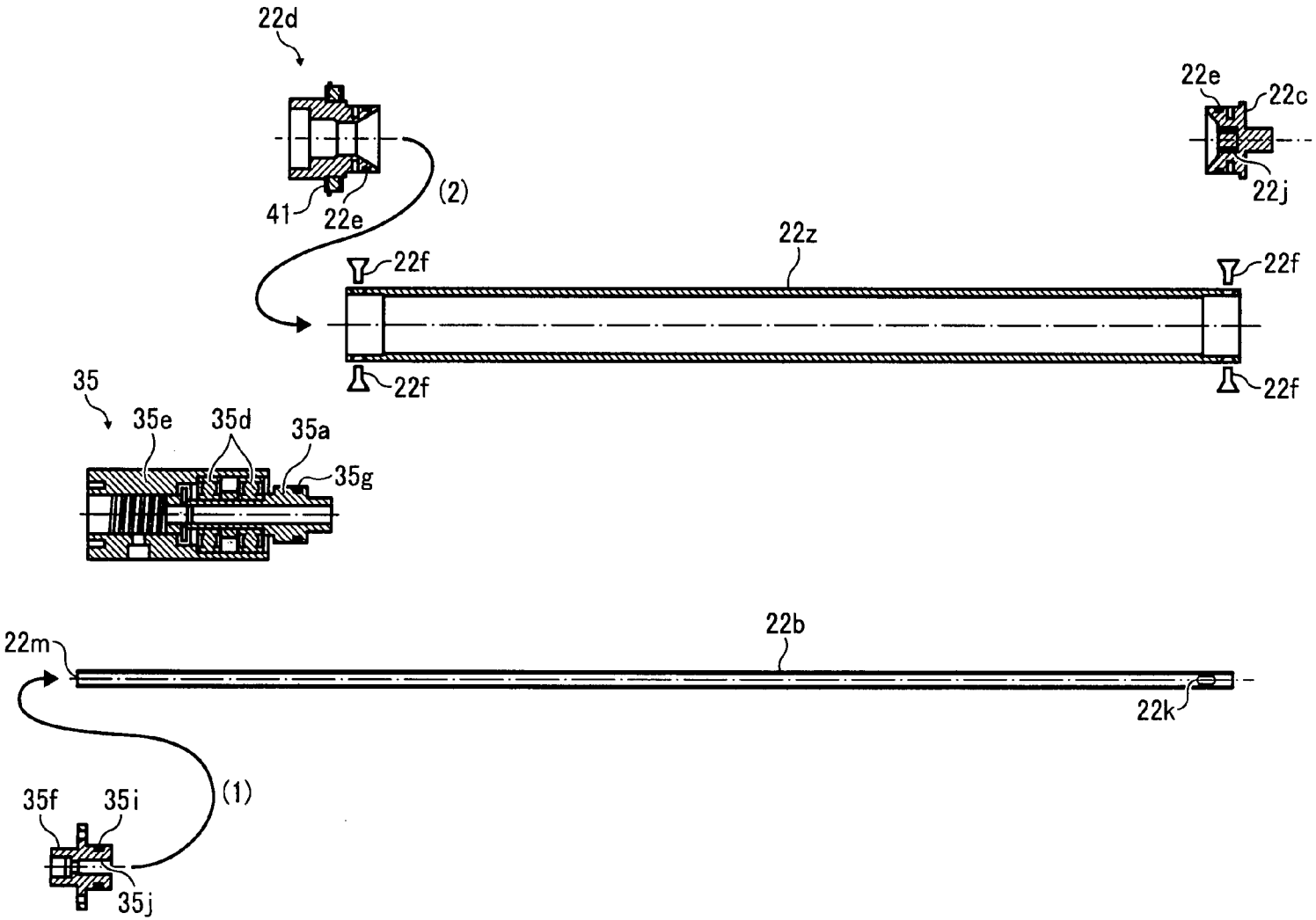
FIG. 5 is an explanation view illustrating a state before a cooling roller is assembled and a rotary joint is mounted.

FIG. 5 illustrates the components of the cooling roller 22, that is, the outer tube 22*a*, the inner tube 22*b*, the flange 22*c*, the flange 22*d*, and the rotary joint 35, which are arranged in line. Particularly, FIG. 5 illustrates a state before the cooling roller 22 is assembled and the rotary joint 35 is mounted. In FIG. 5, the bearing 22*j* and the O-ring 22*e* are in a state combined with the flange 22*c*, and the bearing 41 and the O-ring 22*e* are in a state combined with the flange 22*d*. Of course, the components can be attached to or detached from the flanges, respectively. The rotary joint 35 can be also attached to or detached from the cooling roller 22, so that the rotary joint 35 can be replaced.

The cooling roller 22 of the configuration example 1 is configured so that assembly or disassembly (attachment or detachment of a component) can be simply performed. An assembly procedure will be described.

Figure 6:
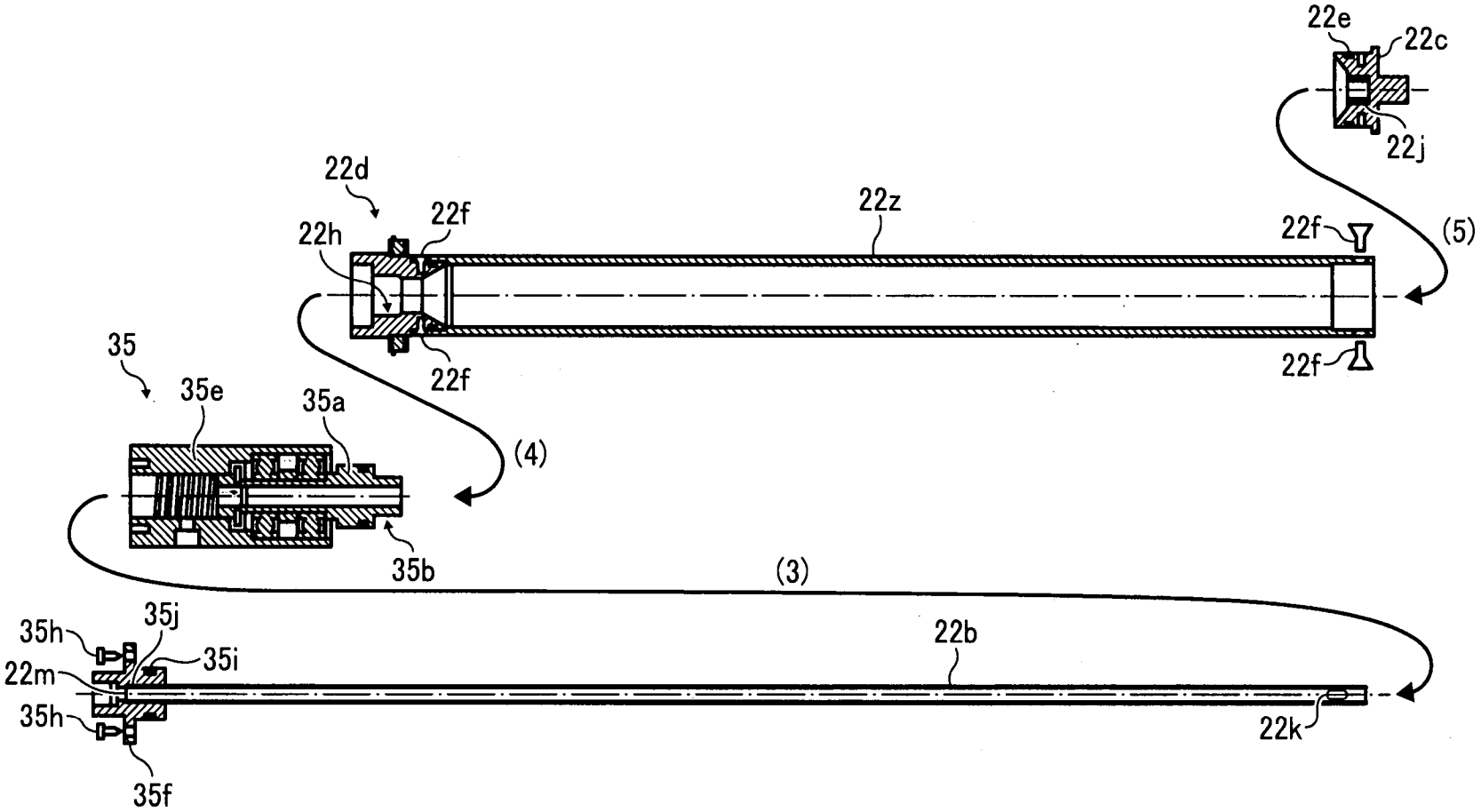
FIG. 6 is an explanation view used for explaining the assembly of a cooling roller.

First, one end side of the inner tube 22*b* is press-fitted into the fitting hole of the flange 35*f*, and so one end side of the inner tube 22*b* is fixedly supported to the flange 35*f* (procedure arrow (1) in FIG. 5 and work procedure 1). Next, the flange 22*d* is fitted and inserted into one end side of the outer tube barrel section 22*z*, and the flange 22*d* is fixed to the outer tube barrel section 22*z* by the screw 22*f* (procedure arrow (2) in FIG. 5 and work procedure 2). FIG. 6 illustrates a state after the works of the procedures 1 and 2 are performed.

After the work procedure 2, the inner tube 22*b* to which the flange 35*f* is mounted is inserted into a rear end section of the casing 35*e*, starting from the opening hole 22*k* side, to penetrate the inside of the rotor 35*a*. The inner tube 22*b* is inserted until the flange 35*f* contacts an end section of the rear end section of the casing 35*e*, and then the flange 35*f* is fitted into and fixed by the screw 35*h* (procedure arrow (3) in FIG. 5 and work procedure 3). Next, the flange 22*d* to which the outer tube barrel section 22*z* is mounted is fitted and inserted into the rotor 35*a* of the rotary joint 35 to which the inner tube 22*b* is mounted through the flange 35*f*, and the flange 22*d* and the rotor 35*a* are fixed by the parallel screw section 22*h* and the parallel screw section 35*b* (procedure arrow (4) in FIG. 5 and work procedure 4). Finally, the flange 22*c* is fitted and inserted into end sections of both of the outer tube barrel section 22*z* and the inner tube 22*b* mounted through the rotary joint 35 and fixed by the screw 22*f* (procedure arrow (5) in FIG. 5 and work procedure 5). As a result, the assembly of the cooling roller 22 is completed as illustrated in FIG. 1. The disassembly of the cooling roller 22 is performed by performing the above-described works, reversely to the above-described work procedure, and thus the components of the cooling roller 22 can be easily mounted or detached. Further, the rotary joint 35 can be also mounted or detached in units of components.

Configuration Example 2

Figure 7:
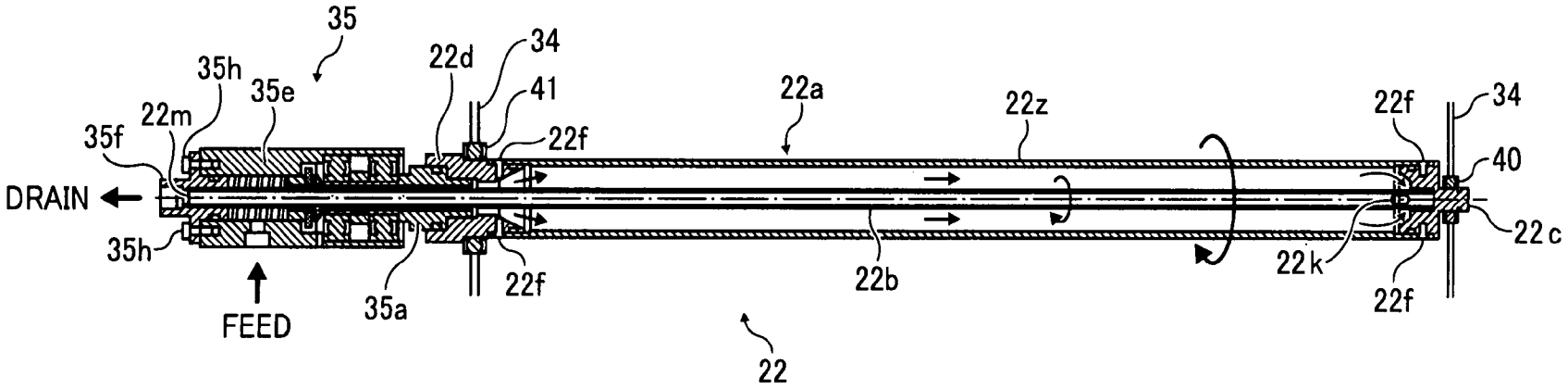
FIG. 7 is a cross-sectional view illustrating a schematic configuration of a cooling roller according to a configuration example 2 of the embodiment 1-1.

FIG. 7 is a schematic cross sectional view illustrating a cooling roller according to configuration example 2. In the cooling roller 22 of the configuration example 2, the outer tube 22*a* rotates, and the inner tubes 22*b* rotates together with the outer tube 22*a*. The cooling roller 22 is appropriate to the case of desiring to make smooth the flow (the flow in the axial direction and the rotation direction) of the cooling liquid in the outer tube 22*a*, and particularly, is effective in the case where the supply flow quantity of the cooling liquid is abundant or the flow velocity in the narrow space is fast.

The configuration of the cooling roller 22 of the configuration example 2 is different from the configuration of the cooling roller 22 of the configuration example 1 illustrated in FIG. 1 in that one end side of the inner tube 22*b* is press-fitted into and fixedly supported to the flange 22*c* that is coaxial with the outer tube barrel section 22*z*, and the other end of the inner tube 22*b* is mounted to the flange 35*f* through a bearing 35*k* so that the inner tube 22*b* is rotatable with respect to the rotary joint 35. That is, in the cooling roller 22 of the configuration example 2, the inner tube 22*b* as well as the outer tube 22*a* is supported rotatably with respect to the rotary joint 35 (the casing 35*e*), and at the other end side, the inner tube 22*b* is supported rotatably with respect to the outer tube 22*a*. The flow passages through which the cooling liquid of the cooling roller 22 flows back and forth are the same as illustrated in FIG. 1.

Further, the component of the cooling roller 22 of the configuration example 2 can be mounted or detached, and the rotary joint 35 can be mounted or detached.

An assembly procedure of the cooling roller 22 of the configuration example 2 will be described. First, one end side of the inner tube 22*b* is press-fitted into the fitting hole of the flange 22*c*, and one end side of the inner tube 22*b* is fixedly supported to the flange 22*c* (work procedure 1). Next, the flange 22*d* is fitted and inserted into one end side of the outer tube barrel section 22*z*, and the flange 22*d* is fixed to the outer tube barrel section 22*z* by the screw 22*f* (work procedure 2).

Figure 8:
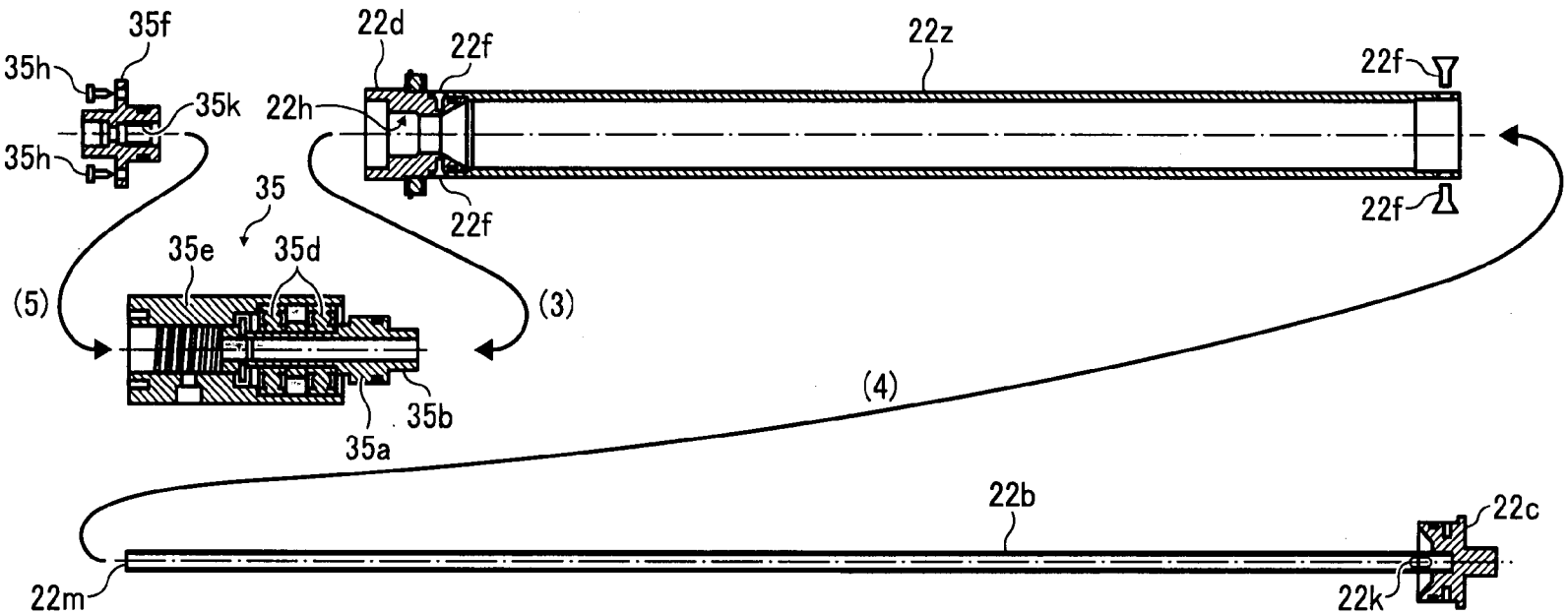
FIG. 8 is an explanation view used for explaining the assembly of a cooling roller.

Then, as illustrated in FIG. 8, the flange 22*d* to which the outer tube barrel section 22*z* is mounted is fitted and inserted into the rotor 35*a* of the rotary joint 35, and the flange 22*d* and the rotor 35*a* are fixed by the parallel screw section 22*h* and the parallel screw section 35*b* (work procedure 3). Thereafter, the inner tube 22*b* to which the flange 22*c* is mounted is inserted into the inside of the outer tube barrel section 22*z*, from a side opposite to a side at which the rotary joint 35 is mounted, in the longitudinal direction of the outer tube barrel section 22*z*, starting from the cross-sectional hole 22*m* side. The inner tube 22*b* is inserted until the flange 22*c* contacts the end section of the outer tube barrel section 22*z*, and the flange 22*c* is fitted into and fixed to the outer tube barrel section 22*z* by the screw 22*f* (work procedure 4). Finally, the flange 35*f* is fitted and inserted into the rear end section of the casing 35*e* of the rotary joint 35 while inserting one end side of the inner tube 22*b* into the bearing 35*k* and then fixed by the screw 35*h* (work procedure 5).

As a result, the assembly of the cooling roller 22 is completed as illustrated in FIG. 7. The disassembly of the cooling roller 22 is performed by performing the above-described works reversely to the above-described work procedure, and thus the components of the cooling roller 22 can be simply mounted or detached. Further, similarly to the configuration example 1, the O-ring of the flange 22*c* or the bearing and the O-ring of the flange 22*d* can be mounted or detached in units of components. Further, similarly to the configuration example 1, the rotary joint 35 can be also detached in units of components.

Here, in the cooling rollers 22 of the configuration example 1 and the configuration example 2, as illustrated in FIGS. 1 and 7, the inner tube 22*b* has a diameter much smaller than the outer tube 22*a*, and in the tubular structure, the space formed between the outer tube 22*a* and the inner tube 22*b*, that is, a hollow section, is very large. The above-described configuration allows the cooling liquid to enter the space formed between the outer tube 22*a* and the inner tube 22*b* as much as possible, whereby it is possible to easily prevent the surface temperature of the cooling roller 22 from being raised, in other words, to easily cool down the surface of the cooling roller 22.

In a condition in which the cooling liquid flows in the circulation path of the present configuration example and the outer tube 22*a* rotates, a heat fluid simulation (a simulation of a flow velocity and a temperature) inside the cooling roller 22 when giving heat to the surface of the outer tube 22*a* was conducted.

As a result of analyzing the simulation, when the flow velocity of the cooling liquid inside the cooling roller 22 is observed in a radius direction, the flow velocity is fast near the center of the cooling roller 22, that is, around the outer circumference of the inner tube 22*b*, and as it is closer to the inner wall of the outer tube 22*a*, the flow velocity gradually decreases, and the flow velocity is very slow near the inner wall of the outer tube 22*a*.

Regarding the temperature, the temperature distribution follows the way in which the cooling liquid flows. Near the outer circumference of the inner tube 22*b*, since the flow velocity is fast and so the cooled cooling liquid continuously flows in, the temperature is kept low. However, as it is closer to the inner wall of the outer tube 22*a*, since the flow velocity decreases and so the cooled cooling liquid hardly flows in, the temperature gradually increases. Near the inner wall of the outer tube 22*a*, since the cooling liquid does not flow and so the cooled cooling liquid does not flow in, the temperature becomes high.

That is, since the flow velocity was very slow near the inner wall of the outer tube 22*a*, the heat of the surface of the outer tube 22*a* was not efficiently transmitted to the cooling liquid.

A material having high thermal conductivity such as aluminum or stainless steel is used as a material of the outer tube 22*a*. Thus, it can be said that the reason why heat of the surface of the outer tube 22*a* is not successfully transmitted to the cooling liquid is because that heat exchange between the inner wall of the outer tube 22*a* and the cooling liquid is not successfully performed, that is, the heat resistance between the inner wall of the outer tube 22*a* and the cooling liquid is large, and thus the heat transfer rate is low. It results from the very slow flow velocity, and the slow flow velocity is due to the very wide space structure formed between the outer tube 22*a* and the inner tube 22*b*.

For this reason, the applicant of the present application has reached a thought that the heat exchange can be successfully performed by a device that increases the flow velocity near the inner wall of the outer tube 22*a* or greatly agitates a flow field, thereby increasing the cooling efficiency of the outer tube 22*a*, and thus modified the internal structure of the cooling roller 22. However, since it has no meaning if the rotation accuracy and durability of the cooling roller 22 are lowered and a leak occurs, the internal structure was modified based on the configuration/structure (both end support and axis alignment) of the cooling roller 22 described with reference to FIGS. 1 and 7.

Configuration Example 3

Figure 9:
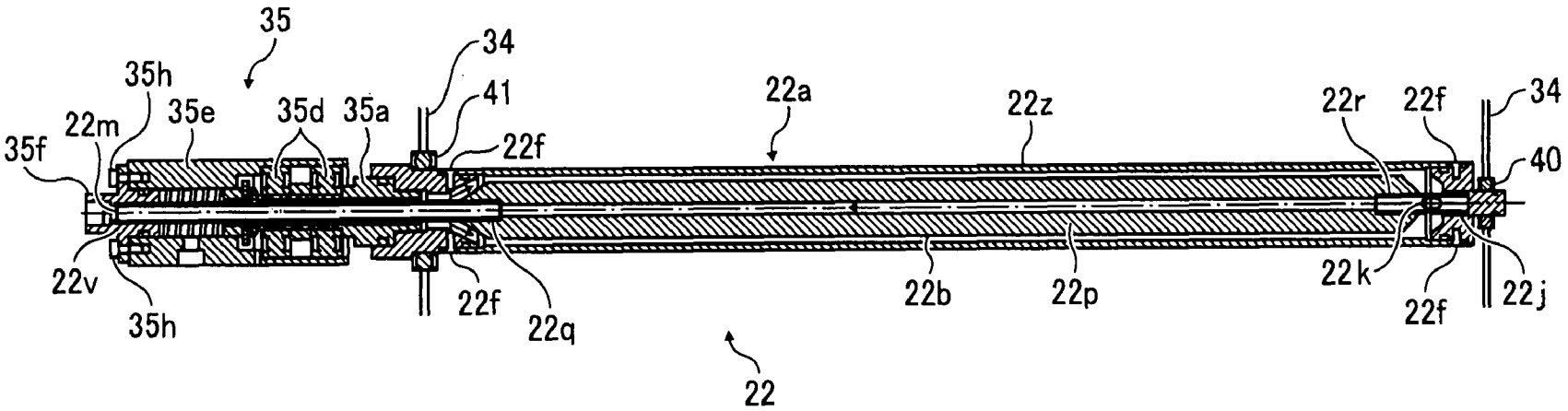
FIG. 9 is a cross-sectional view illustrating a schematic configuration of a cooling roller according to a configuration example 3 of the embodiment 1-1.
Figure 10:
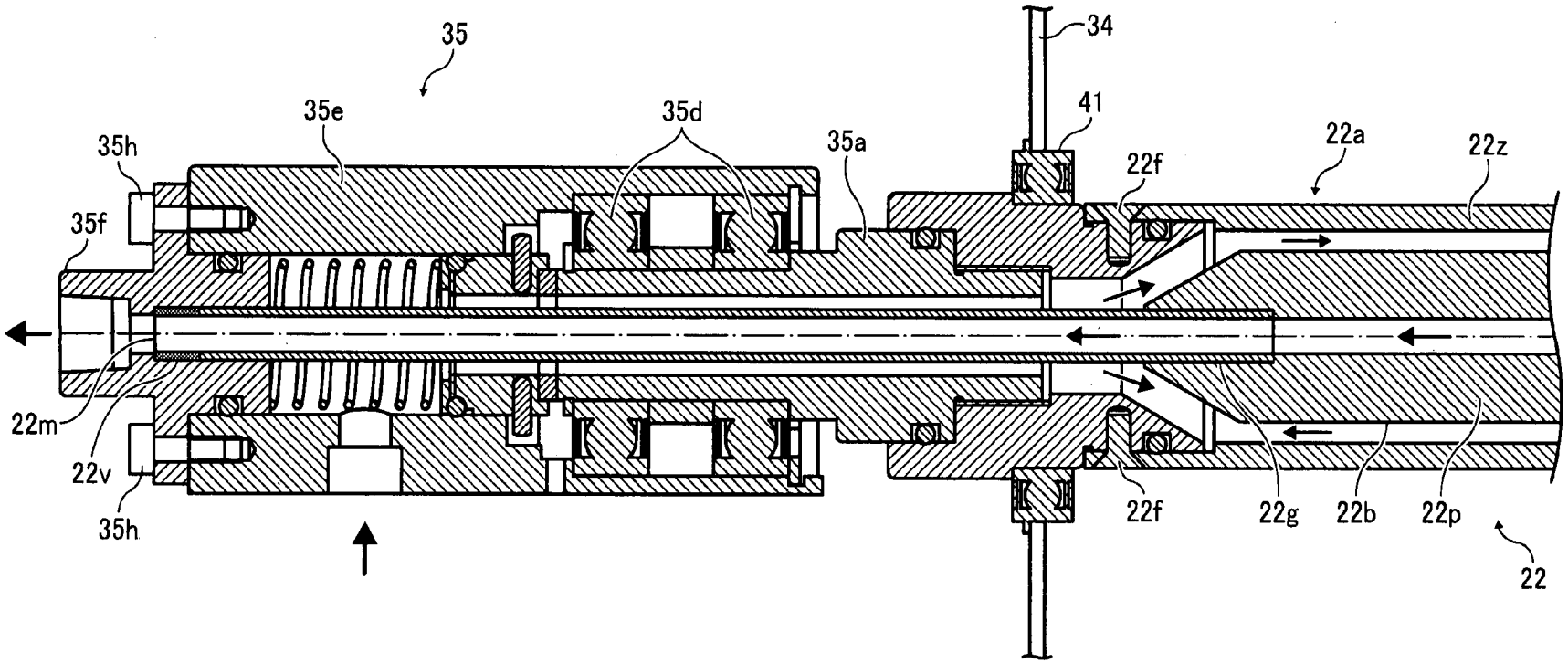
FIG. 10 is an enlarged view illustrating a longitudinal direction end of a cooling roller at a rotary joint side.
Figure 11:
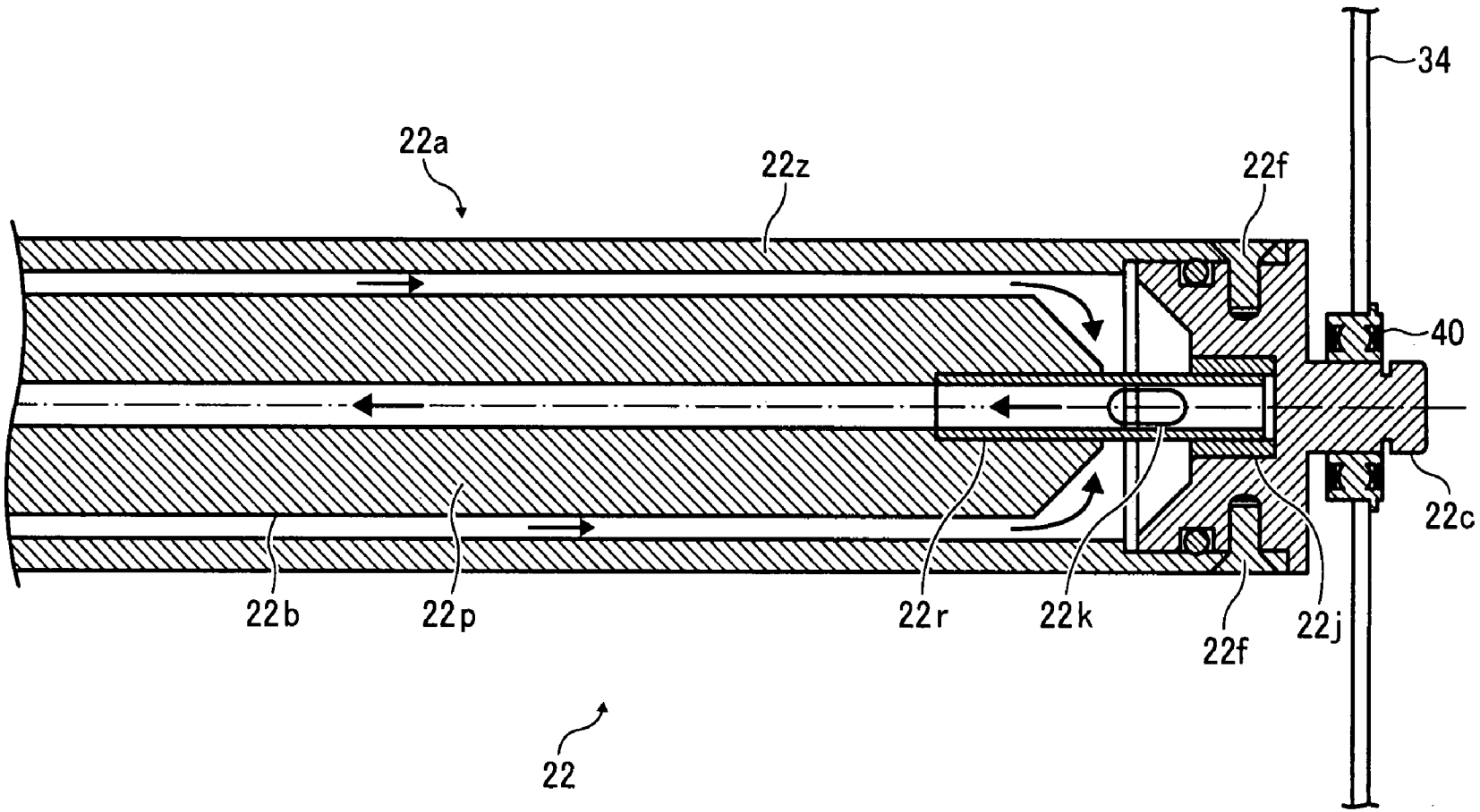
FIG. 11 is an enlarged view illustrating a longitudinal direction end of a cooling roller at a side opposite to a rotary joint.

FIG. 9 is a schematic cross-sectional view illustrating a cooling roller 22 of configuration example 3. FIG. 10 is an enlarged view illustrating a longitudinal direction end of the cooling roller 22 at the rotary joint 35 side. FIG. 11 is an enlarged view illustrating a longitudinal direction end of the cooling roller 22 at a side opposite to the rotary joint 35. Similarly to the configuration example illustrated in FIG. 1, in the cooling roller 22 of FIG. 9, the outer tube 22*a* rotates, and the inner tube 22*b* is fixed (does not rotates). However, unlike FIG. 1, in the configuration example 3, the inner tube 22*b* is composed of components such as a cylindrical pipe 22*p* as a large diameter section and pipes 22*q* and 22*r* as small diameter sections.

The inner tube 22*b* is formed by fixedly press-fitting the pipe 22*q* and the pipe 22*r* into both ends of the cylindrical pipe 22*p* in a fitting relationship while performing axis alignment. Since the flow velocity near the inner wall of the outer tube 22*a* is very slow and thus deteriorates the cooling performance as described above, in the configuration example 3, the external diameter of the cylindrical pipe 22*p* is slightly smaller than the internal diameter of the outer tube 22*a*, so that the space (for example, the hollow section) formed between the outer tube 22*a* and the inner tube 22*b* becomes a very narrow gap. Therefore, the cooling liquid flows through the narrow gap as the flow passage, and thus as well-known in fluid dynamics, the flow velocity increases, and the heat transfer rate is improved, thereby improving the cooling performance of the outer tube 22*a*.

A thermofluid simulation of the cooling roller 22 having the narrow gap configuration was performed, and the simulation showed that it is possible to increase the heat transfer rate of the inner wall surface of the outer tube 22*a*, and fluid resistance does not increase even though the space is narrowed. Further, it was found that it is possible to expect the same cooling performance as when the flow quantity flowing through the flow passage in the wide gap configuration illustrated in FIG. 1 is increased several times.

Since the inner tube 22*b* in which the cylindrical pipe 22*p* is integrated with the pipes 22*q* and 22*r* does not rotate, similarly to the cooling roller 22 of the configuration example 1, the pipe 22*r* at one end side is supported rotatably with respect to the outer tube 22*a* via the bearing 22*j*, and the pipe 22*q* at the other end side is fixedly supported to the rotary joint 35 through the flange 35*f*. Here, if the pipe 22*q* is press-fitted into and fixed to the flange 35*f*, the inner tube 22*b* can not be assembled to the rotary joint 35. Therefore, the inner tube is configured so that the pipe 22*q* and the flange 35*f* can be detachably attached. In a state in which the flange 35*f* is detached, the inner tube 22*b* is inserted into the casing 35*e* starting from the pipe 22*q*, and the flange 35*f* is mounted to the pipe 22*q*. In the configuration example 3, both ends of the pipe 22*q* and the flange 35*f* are screw-processed to have screw sections 22*v* and thus can be attached or detached. The components of the cooling roller 22 and the rotary joint 35 of the configuration example 3 can be mounted or detached, similarly to the cooling roller 22 and the rotary joint 35 of the configuration example 1.

Further, if the pipe 22*q* and the pipe 22*r* which are press-fitted into and fixed to the cylindrical pipe 22*p* can be mounted or detached to disassemble the components of the inner tube 22*b*, it is more beneficial (reuse, recycling, or component replacement when a failure occurs). For example, a portion where the cylindrical pipe 22*p* and the pipe 22*q* are press-fitted into each other and a portion where the cylindrical pipe 22*p* and the pipe 22*r* are press-fitted into each other are preferably screw-processed. However, if a screw coupling method is used to attach or detach the components to or from each other, for example, if only the screw coupling section is used to attach or detach the pipes 22*q* and 22*r* to or from the cylindrical pipe 22*p* or the pipe 22*q* to or from the flange 35*f*, axial misalignment may be caused. Thus, a fitting section for axis alignment should be provided together.

Figure 12:
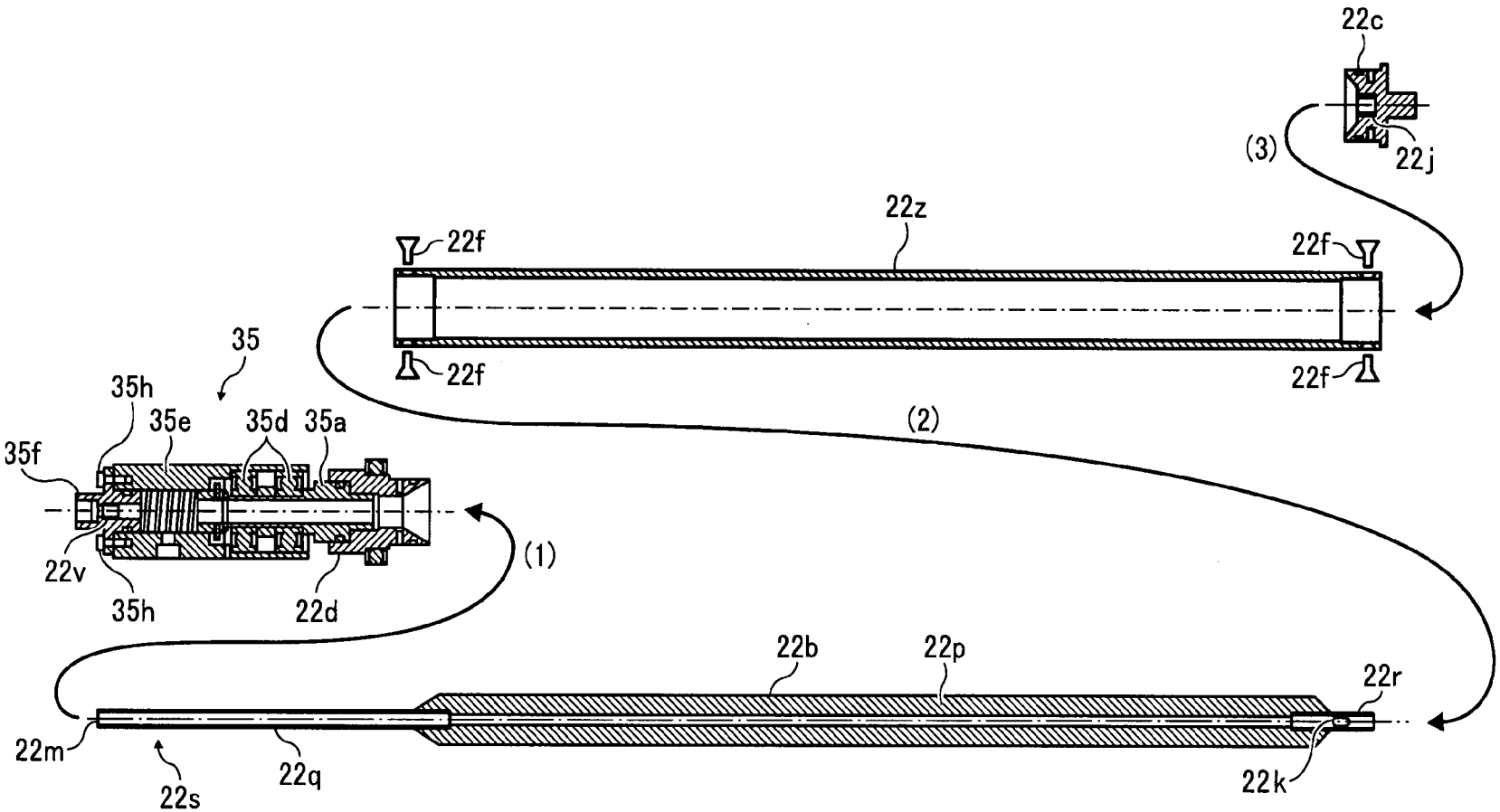
FIG. 12 is an explanation view used for explaining the assembly of a cooling roller.

An assembling procedure of the cooling roller 22 of the present configuration example will be described with reference to FIG. 12. First, the flange 22*d* and the flange 35*f* are fitted and inserted into and fixed to the rotor 35*a* and the casing 35*e* of the rotary joint 35, respectively. Thereafter, the inner tube 22*b* is inserted into the rotary joint 35, and the pipe 22*q* is fitted into, fixed to, and supported to the flange 35*f* using the screw section 22*v* (work procedure 1). Next, one end of the outer tube 22*a* is fitted and inserted into and fixed to the flange 22*d* to cover the inner tube 22*b* (work procedure 2). Finally, the flange 22*c* is fitted and inserted into and fixed to the other end of the outer tube 22*a* while inserting the pipe 22*r* of the inner tube 22*b* into the bearing 22*j* (work procedure 3).

Accordingly, the assembly of the cooling roller 22 is completed as illustrated in FIG. 9. The disassembly of the cooling roller 22 is performed by performing the above-described works reversely to the above-described work procedure, and thus the components of the cooling roller 22 can be easily mounted or detached. Further, similarly to the configuration example 1, the O-ring of the flange 22*c* or the bearing and the O-ring of the flange 22*d* can be mounted or detached in units of components. Further, similarly to the configuration example 1, the rotary joint 35 can be also mounted or detached in units of components.

The configuration example 3 has been described in connection with the cooling roller 22 of the type in which the inner tube 22*b* is fixed (does not rotate), but similarly to the cooling roller 22 of the configuration example 2 illustrated in FIG. 7, it can be applied to the type in which the outer tube 22*a* and the inner tube 22*b* rotate.

Configuration Example 4

Figure 13:
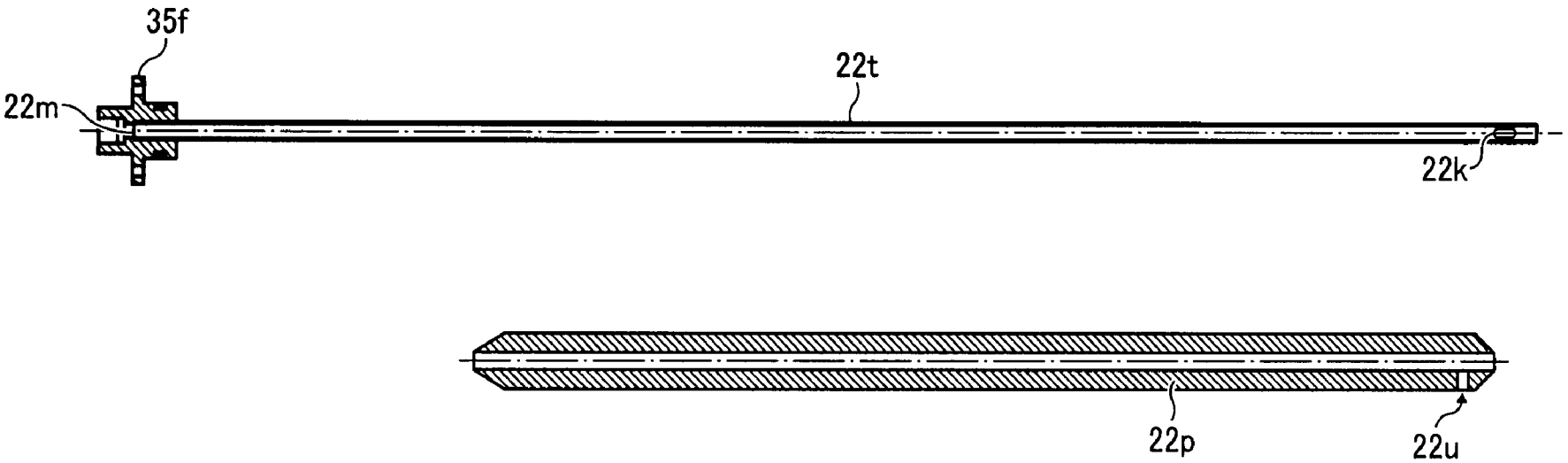
FIG. 13 is an explanation view illustrating an inner tube, a cylinder pipe, and a pipe according to a configuration example 4 of the embodiment 1-1.

In the configuration example 3, the inner tube 22*b* is configured with the three components: the cylindrical pipe 22*p* as a large diameter section; and the pipes 22*q* and 22*r* as small diameter sections. However, in configuration example 4, as illustrated in FIG. 13, the inner tube 22*b* is configured with two components: a pipe 22*t* as a small diameter section having a long length; and the cylindrical pipe 22*p*. This improves workability of the assembly or the disassembly and makes component management easy. Since the pipe 22*t* having the long length is used as a pipe used as the small diameter section, it is easy to obtain coaxiality between the cylindrical pipe 22*p* and the pipe 22*t*. When the inner tube 22*b* is configured by assembling the cylindrical pipe 22*p* and the pipe 22*t*, the high axis alignment accuracy with the outer tube 22*a* or the rotary joint 35 is obtained.

An assembly procedure of the cooling roller 22 of the configuration example 4 will be described. The pipe 22*t* fixed to the flange 35*f* in a press-fitting manner is attached to the rotary joint 35. Thereafter, the pipe 22*t* is inserted into the cylindrical pipe 22*p* in a fitting relationship while performing axis alignment, and the cylindrical pipe 22*p* is fixed to the pipe 22*t* using a fixing screw section 22*u*. The outer tube barrel section 22*z* and the flange 22*c* are mounted and fixed in a fitting relationship.

Embodiment 1-2

Next, an embodiment 1-2 of the present invention will be described.

A cooling roller and a cooling device of the present invention will be described in connection with an image forming device that fixes a toner on a recording paper by a heat fixing unit. However, the cooling roller and the cooling device of the present invention are not limited thereto but can be applied to any device requiring cooling of a sheet medium. In an embodiment, a liquid is used as a cooling liquid, but a gaseous body may be used if it is a fluid medium.

The cooling roller as the cooling unit of the present embodiment has a tubular structure and allows the cooling liquid to flow back and forth to be circulated thereinside to thereby cool down the surface of the cooling roller. A heat fixing unit is disposed at an upstream side of the cooling device having the cooling roller in the paper transport direction. A discharge paper receiving section is disposed at a downstream side of the cooling device in the paper transport direction. The cooling device is disposed directly next to the heat fixing unit in the paper transport path between the heat fixing unit and the discharge paper receiving unit. Since the cooling roller needs to directly contact the paper when removing heat from the paper, the cooling roller has a function as a transport roller for transporting the paper with the high degree of accuracy as well as a function of removing heat of the paper.

In the present embodiment, the cooling roller 22 of a high cooling performance is provided by mounting a cylinder 22*s* having a large diameter to the inner tube 22*b* to narrow a flow passage of the cooling liquid flowing near the inner wall of the outer tube 22*a* and combining a rotation or non-rotation operation of the cylinder 22*s* (including the inner tube 22*b*) and the flow velocity of the cooling liquid flowing through the narrow space. Further, an agitating member that agitates the flow of the cooling liquid inside the narrow space and gives change to the flow is disposed, thereby further improving the cooling performance of the cooling roller 22.

Figure 15:
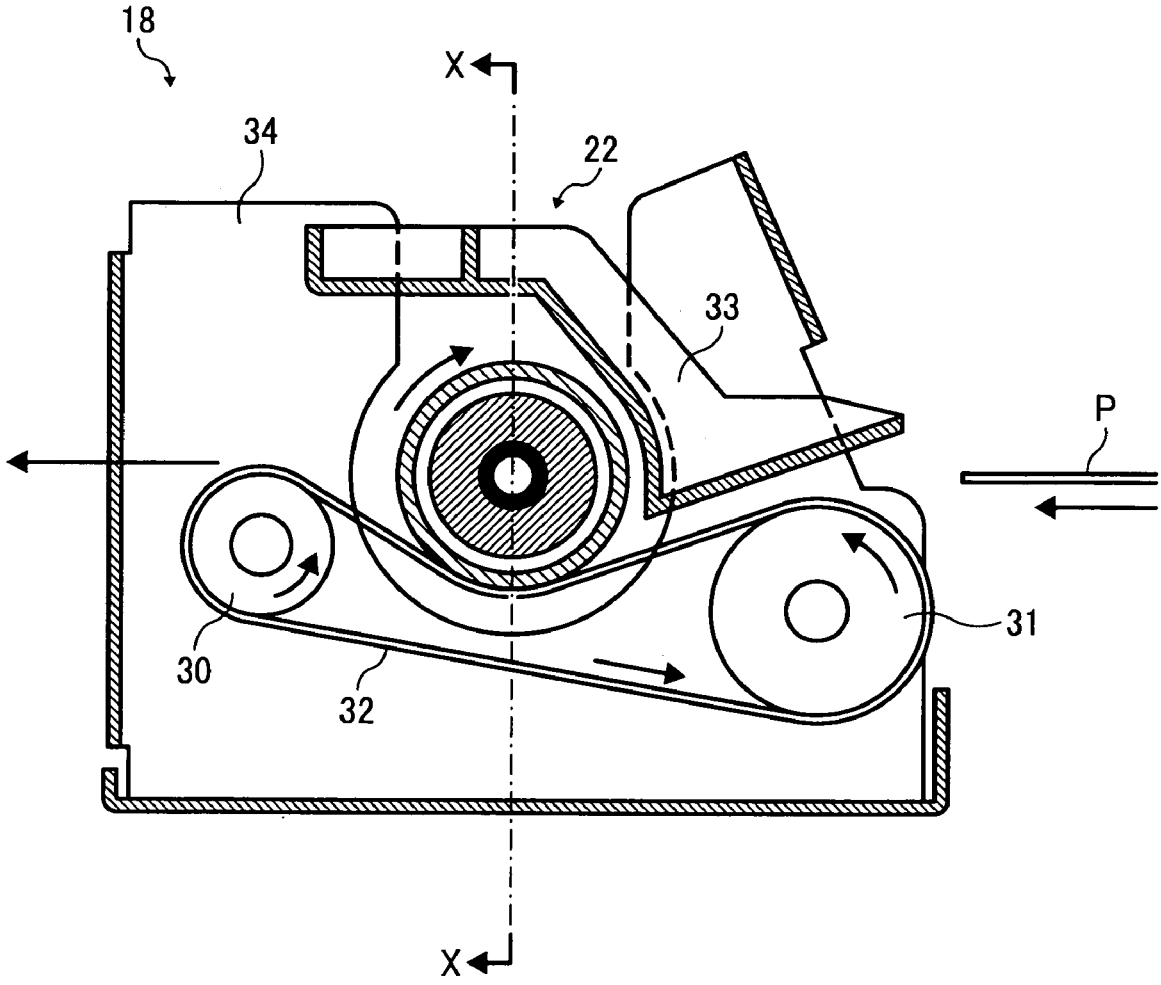
FIG. 15 is a cross-sectional view illustrating a schematic configuration example (2) of a cooling device according to an embodiment 1-2.

FIG. 15 is a schematic view of an example (2) of the cooling device 18 having the cooling roller 22 of the present invention which also functions to transport the paper. In the cooling device 18, a roller 30 and a roller 31 which are disposed apart from each other in a transport direction of a paper P (a left-right direction) are disposed, and a transport belt 32 for transporting the paper is extended. The roller 30 at a downstream side in the paper transport direction is used as a driving roller (connected with a driving source (not shown)), and the transport belt 32 rotates counterclockwise to the paper from a right side to the left side in FIG. 15.

A heat fixing unit 16 is disposed at an upstream side of the cooling device 18 in the paper transport direction, and a discharge paper receiving unit 17 is disposed at a downstream side of the cooling device 18 in the paper transport direction. An upper guide 33 that guides the paper P transported from the heat fixing unit 16 is disposed above the roller 31. A cooling roller 22 having a dual tube structure downwardly press-contacts and digs into the transport belt 32 at an intermediate position between the roller 30 and the roller 31. The cooling roller 22 rotates together with the transport belt 32 by transport force of the transport belt 32. In FIG. 15, a reference numeral 34 represents a bracket that constitutes a main body of the cooling device 18 and a member that fixedly or rotatably supports components such as the roller 30, the roller 31, the cooling roller 22, and the upper guide 33. The cooling device 18 is constituted as one unit by the bracket 34 and mounted to a main body of an image forming device.

The paper P which was heated by the heat fixing unit 16 to become a high temperature passes through the cooling device 18 before being discharged to the discharge paper receiving unit 17. In detail, the paper P which becomes a high temperature through the heat fixing unit 16 enters between the upper guide 33 and the roller 31 of the cooling device 18, then passes through a nip area formed by the cooling roller 22 and the transport belt 32, and is discharged to the discharge paper receiving unit 17. The inside of the cooling roller 22 has a tubular structure. Since the inside of the cooling roller 22 has a tubular structure, the cooling liquid sufficiently cooled down in the outside is fed to the inside of the cooling roller 22, circulated inside the cooling roller 22, and then drained from the inside of the cooling roller 22. Since the paper P is passed through while closely contacting the cooling roller 22 in the nip area formed when the cooling roller 22 contacts the transport belt 32, the heat of the paper P is absorbed into the cooling roller 22, so that the paper P is sufficiently cooled down.

The applicant of the present application actually experimentally made a cooling roller having a single tube structure and a cooling roller having a dual tube structure and performed a cooling effect evaluation experiment to compare both cooling rollers. When the surface temperature of the paper P directly after passing through the heat fixing unit 16 was 100° C., the surface temperature of the paper P as an actual measured value after passing through the cooling device 18 was 60° C. in the case of using the cooling roller having the single tube structure, but it fell to about 54° C. to 55° C. in the case of using the cooling roller having the dual tube structure. Therefore, it was confirmed that the cooling performance can be further improved by using the cooling roller of the dual tube structure instead of the single tube structure.

As will be described later, the cooling roller 22 is communicated/connected with a cooling liquid circulation unit such as a tank 26, a pump 25, and a radiator 24 having a cooling fan 23 mounted therein through a rotating tube joint unit. The sealed cooling liquid is circulated to thereby cool down the cooling roller 22.

Configuration Example 5

Figure 16:
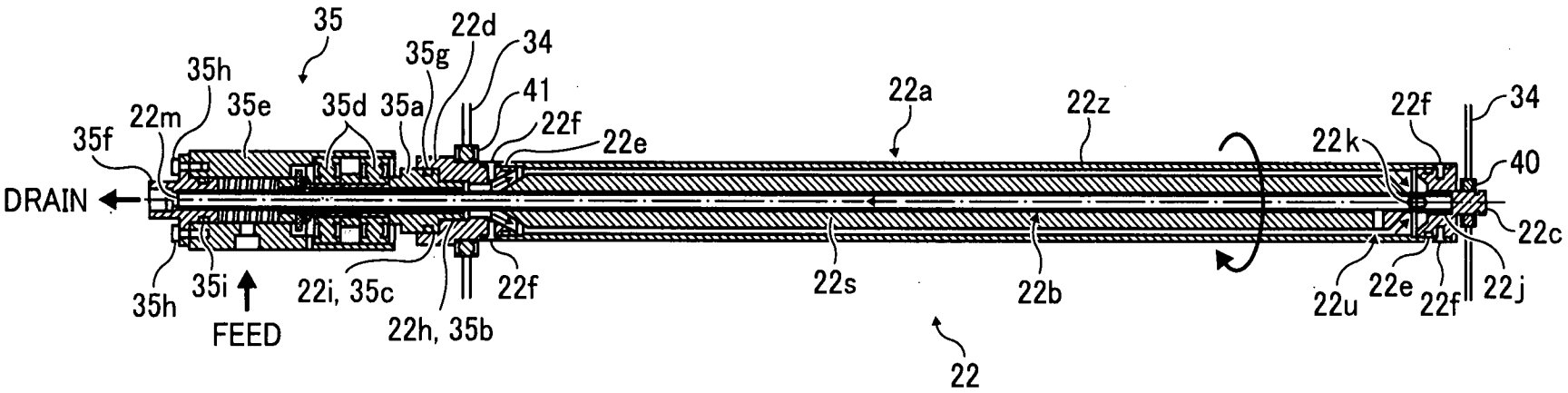
FIG. 16 is a schematic cross-sectional view illustrating a cooling roller in which a rotary joint is mounted at one end side in FIG. 15.
Figure 17:
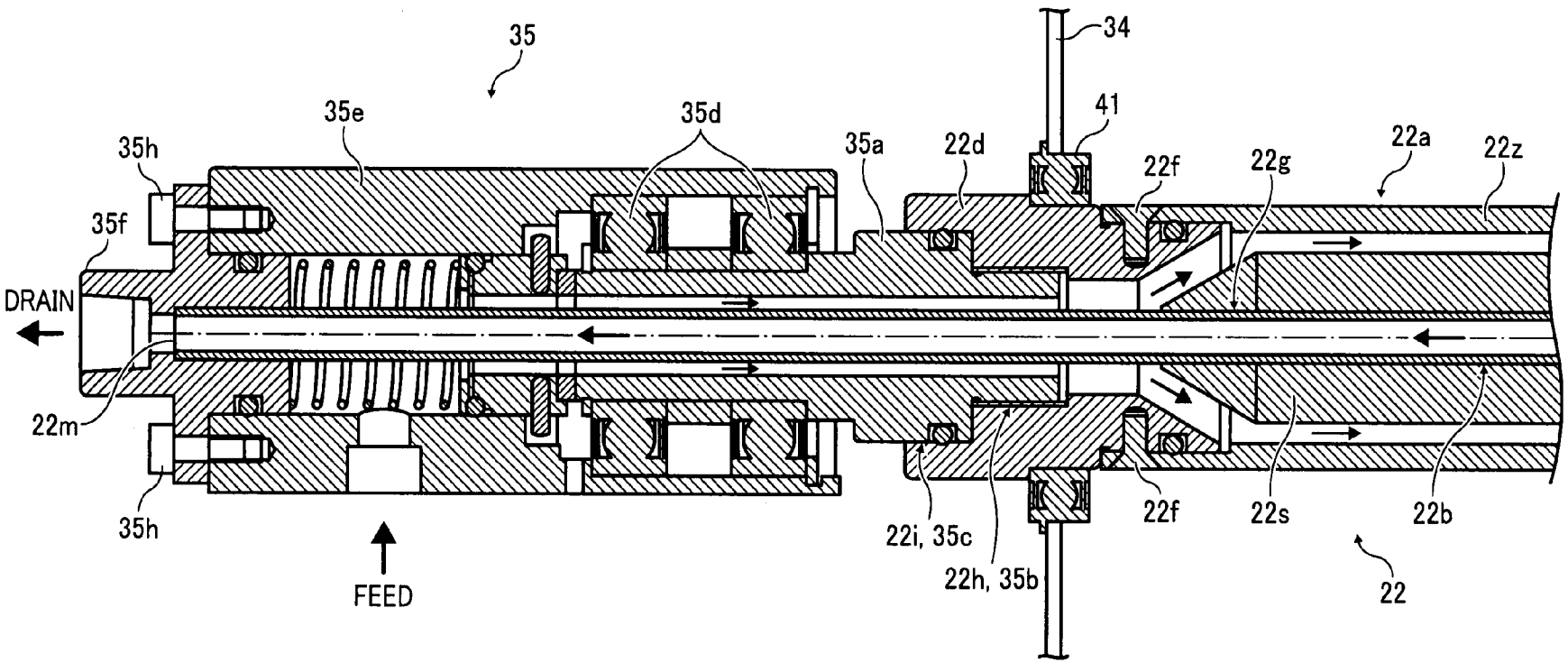
FIG. 17 is an enlarged view illustrating a longitudinal direction end of a cooling roller at a rotary joint side.
Figure 18:
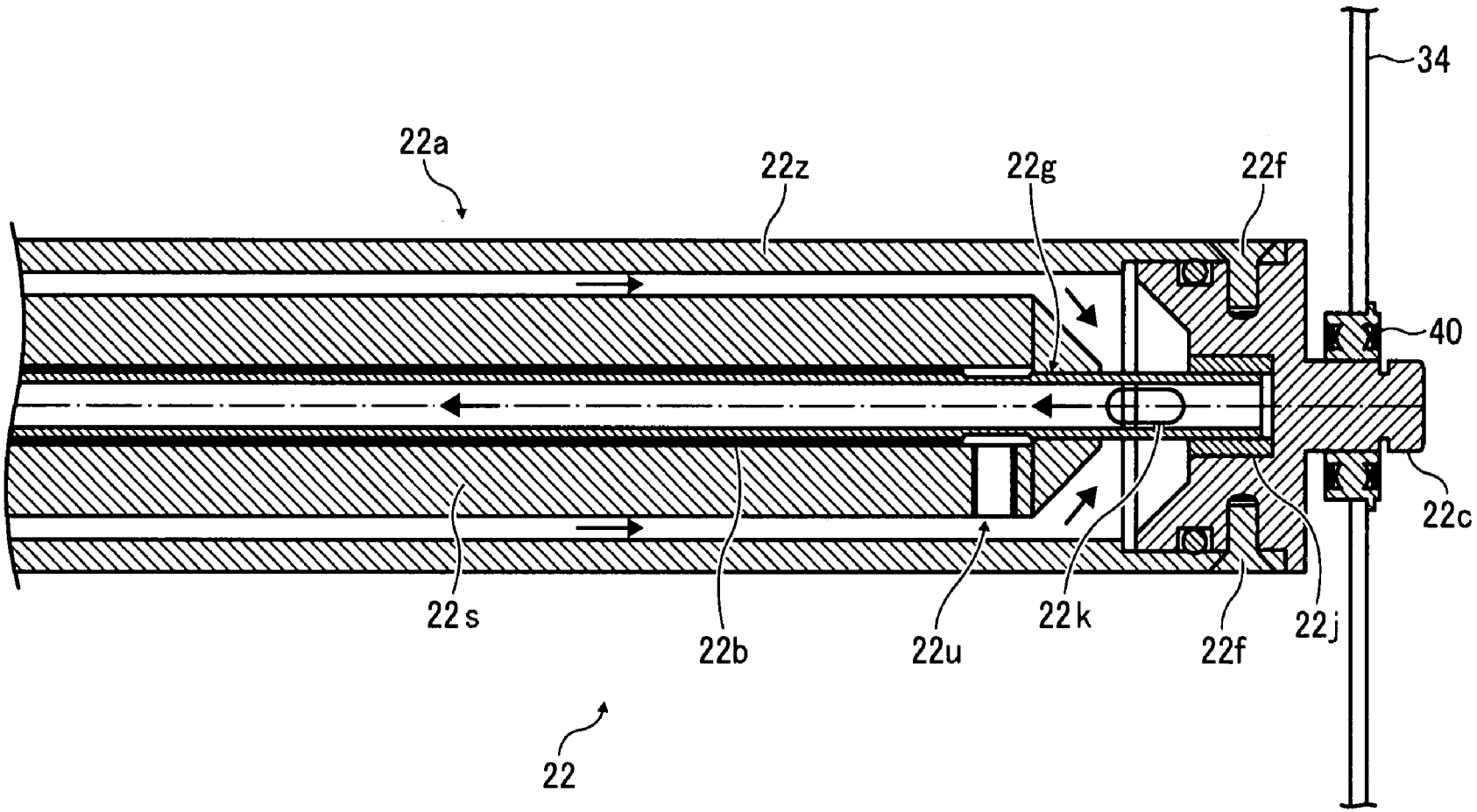
FIG. 18 is an enlarged view illustrating a longitudinal direction end of a cooling roller at a side opposite to a rotary joint.

FIG. 16 is a schematic configuration diagram of a cooling roller 22 according to configuration example 5. FIG. 17 is an enlarged view illustrating a longitudinal direction end of the cooling roller 22 at a rotary joint 35 side. FIG. 18 is an enlarged view illustrating a longitudinal direction end of the cooling roller 22 at a side opposite to the rotary joint 35.

The cooling roller 22 has a dual tube structure in which an inner tube 22*b* is disposed inside an outer tube 22*a*, and an outside flow passage that allows the cooling liquid to flow through a space between the outer tube 22*a* and the inner tube 22*b* and an inside flow passage that allows the cooling liquids to flow inside the inner tube 22*b* are formed. An opening that allows the outside flow passage to communicate with the inside flow passage is formed near the longitudinal direction end of the inner tube 22*b* at a side opposite to a rotary joint 35.

The cooling roller 22 has a hollow tube structure that is mainly composed of the outer tube 22*a*, the inner tube 22*b*, and a cylinder 22*s*. In the present embodiment, the cylinder 22*s* is mounted to and supported to the inner tube 22*b*. The cylinder 22*s* has a large diameter, so that a flow passage having a narrow space is formed between the outer tube 22*a* and the cylinder 22*s*. Thus, the cooling liquid flowing through the flow passage of the narrow space has a fast flow velocity.

Longitudinal direction ends of the outer tube 22*a* are configured with a flange 22*c* having a shaft and a flange 22*d* into which a bearing 41 is press-fitted. O-rings 22*e* for leakage prevention are inserted into both of the flange 22*c* and the flange 22*d*, and the flange 22*c* and the flange 22*d* are mounted to an outer tube barrel section 22*z* through screws 22*f*. At this time, both the flange 22*c* and the flange 22*d* are inserted into and mounted to the outer tube barrel section 22*z* in a fitting relationship, thereby preventing rattling between the flange 22*c* and the outer tube barrel section 22*z* and rattling between the flange 22*d* and the outer tube barrel section 22*z*. The flange 22*c* and the flange 22*d* have coaxiality with the outer tube barrel section 22*z*. Both ends of the cooling roller 22 are rotatably supported with respect to the bracket 34 of the cooling device 18 through the shaft of the flange 22*c* and the bearing 41 of the flange 22*d*.

Further, a coupling section including a parallel screw section 22*h* and a fitting section 22*i* is formed on the inside of the flange 22*d*. A rotor 35*a*, which has a parallel screw section 35*b* and a fitting section 35*c*, formed to face the coupling section is mounted to the flange 22*d*. The parallel screw section 22*h* and the parallel screw section 35*b* are screw-processed in a direction that is tightened against the rotation direction of the outer tube 22*a* (the transport direction of the paper P). The rotor 35*a* is a component of the rotary joint 35 and is rotatable. Since the rotor 35*a* and the flange 22*d* are inserted and mounted in the fitting relationship as described above, rattling between the rotor 35*a* and the flange 22*d* is prevented, and the rotor 35*a* and the flange 22*d* have the coaxiality. The rotor 35*a* is rotatably supported to a casing 35*e* of the rotary joint 35 through a fitting relationship with two bearings 35*d* disposed with an interval therebetween. Therefore, the outer tube 22*a* becomes a state which is coaxial to the casing 135*e* through the rotor 35*a* and the flange 22*d* mounted in the fitting relationship and thus can perform rotation with the high degree of accuracy. Further, an O-ring 35*g* is inserted into the rotor 35*a* to prevent the cooling liquid from leaking from the flange 22*d*.

Next, configurations of the inner tube 22*b* and the cylinder 22*s* will be described. The inner tube 22*b* having a long length is inserted into the cylinder 22*s* through fitting sections 22*g* (see FIGS. 17 and 18) formed at both ends of the cylinder 22*s* while performing axis alignment, and the cylinder 22*s* is fixed at a fixing screw section 22*u* by a screw (not shown) to be supported to the inner tube 22*b*.

As the inner tube 22*b*, instead of the long tube, short tubes may be disposed at both ends as illustrated in the embodiment 1. However, when the single tube having a long length is used as the inner tube 22*b*, straightness and cylindricality of the inner tube 22*b* are high or axis alignment between the inner tube 22*b* and the cylinder 22*s* can be performed with the degree of accuracy. Thus, when the cylinder 22*s* is mounted to and integrated with the inner tube 22*b*, the degree of accuracy of axis alignment with the outer tube 22*a* or the rotary joint 35 can be improved.

Further, in the configuration example 5, the external diameter of the cylinder 22*s* is slightly smaller than the internal diameter of the outer tube 22*a*, so that the space, that is, the hollow section, formed between the outer tube 22*a* and the cylinder 22*s* becomes a very narrow gap. Therefore, the cooling liquid flows through the narrow gap as the flow passage, and thus as well-known in fluid dynamics, the flow velocity increases, and the heat transfer rate is improved, thereby improving the cooling performance of the outer tube 22*a*.

For confirmation, a thermofluid simulation on the configuration of the cooling roller 22 illustrated in FIG. 16 was conducted. As a result, it was found that it is possible to increase the heat transfer rate of the inner wall surface of the outer tube 22*a*. At first, it was feared that the cooling performance would increase but the fluid resistance would also increase since the space is narrow. However, the fluid resistance hardly changed. That is, it was confirmed that it is unnecessary to increase the flow quantity of the cooling liquid even though the flow passage is narrow.

Further, it was found out that it is possible to expect the same cooling performance as when the quantity of the flow flowing in the cooling roller 22 having the wide gap without the cylinder 22*s* illustrated in the embodiment 1-1 is increased several times. That is, the configuration of the cooling roller 22 of the present embodiment can increase the cooling efficiency with the small supply flow quantity, that is, the small energy, thereby achieving the high cooling performance.

A numerical value of the narrow space greatly depends on the configuration condition or the flow quantity of the cooling roller 22 and can not be categorically specified. However, for example, based on a simulation or an experimental production evaluation result conducted by the applicant of the present application, in the case of the cooling roller 22 having a size that is mounted in a typical image forming device (for example, the external diameter of the outer tube 22*a* is equal to or less than about $\phi$100 mm, and the flow quantity is equal to or less than one (1) liter/minute), the space of equal to or less than 3 mm was recommendable, and the space having the highest cooling performance was around 1 mm. When the space was narrower than the above-described value (for example, 0.5 mm), the effect did not increase.

Subsequently, as a method of further increasing the cooling efficiency, a configuration of giving change to the way that the cooling liquid flows in the narrow space will be described. In order to give change to the way that the cooling liquid flows, in the present application, the inner tube 22*b* and the cylinder 22*s* rotate or do not rotate depending on whether the flow velocity of the cooling liquid is fast or slow. The configuration of the cooling roller 22 is the same, but in order to enable the inner tube 22*b* and the cylinder 22*s* to rotate or not to rotate, the cooling roller should have different types in supporting the inner tube 22*b* and the cylinder 22*s*. As the types, the following four kinds are described below.

Configuration Example 6

In the cooling roller 22 of configuration example 6, the outer tube 22*a* rotates, but the inner tube 22*b* and the cylinder 22*s* are fixed (do not rotates). The cooling roller 22 is appropriate to the case of actively generating the turbulence against the flow (the flow in the axial direction and the rotation direction) of the cooling liquid flowing in the narrow space flow passage formed between the outer tube 22*a* and the cylinder 22*s*, particularly, is effective when employed in the case where the supply flow quantity of the cooling liquid is small or the flow velocity in the narrow space is slow.

When the outer tube 22*a* rotates while the cylinder 22*s* do not rotate, the flow changes, starting from around the outer circumference of the cylinder 22*s*, and so the smooth flow in the narrow space is agitated. This enables the cooling liquid to flow, showing various movements, and thus it is possible to prevent the cooling efficiency from being lowered due to the slow flow velocity. Therefore, even though the flow velocity of the cooling liquid is slow, the cooling roller 22 of the configuration example 6 can successfully perform heat exchange between the cooling liquid and the outer tube 22*a*, thereby increasing the cooling efficiency. Because of this point, it can be said that the configuration of the cooling roller 22 is effective in the case of desiring to reduce the flow velocity of the cooling liquid or in the case of desiring to reduce the supply flow quantity.

A simulation of enabling the outer tube 22*a* and the cylinder 22*s* to rotate together or not to rotate together under the condition of the same narrow space and the same flow quantity (the same flow velocity) was actually conducted. As a result of comparison, as expected, the cooling effect is better when the cylinder 22*s* does not rotate. However, since the effect is different depending on the flow quantity (the flow velocity), the smaller the flow quantity is (the slower the flow velocity is), the greater the difference is, whereas the greater the flow quantity is (the faster the flow velocity is), the smaller the difference is. When the cylinder 22*s* rotates together with the outer tube 22*a*, the turbulence is not generated, and the cooling performance is determined only by the flow velocity. Therefore, when the flow velocity is fast, the cooling performance is high, whereas when the flow velocity is slow, the cooling performance is naturally low. When the cylinder 22*s* does not rotate, the turbulence is generated near the outer circumference of the cylinder 22*s*. Thus, when the flow velocity is slow, the cooling performance increases as described above. However, when the flow velocity is fast, since the cooling effect by the high flow velocity is greater than influence of the turbulence (the cooling effect by the turbulence), the same cooling performance as when the cylinder 22*s* rotates is obtained. That is, there is no difference in the cooling effect between when the cylinder 22*s* rotates and when the cylinder 22*s* does not rotate.

Further, when the outer tube 22*a* rotates and the cylinder 22*s* does not rotate, whether the inner tube 22*b* rotates or does not rotate does not influence the flow of the cooling liquid inside the narrow space flow passage and thus has nothing to do with the cooling performance. However, since the cylinder 22*s* is mounted such that both ends thereof are supported to the inner tube 22*b*, axis alignment with the rotary joint 35 or the outer tube 22*a* is performed with the high degree of accuracy, preventing vibration. Therefore, when the cylinder 22*s* is fixed to and integrated with the inner tube 22*b* (of course, when the cylinder 22*s* does not rotate, the inner tube 22*b* does not rotate), the rotation accuracy of the cooling roller 22 can be improved, and vibration of the cylinder 22*s* caused by the high space accuracy of the narrow space flow passage or the turbulence can be prevented.

In the configuration example 6, as illustrated in FIGS. 16, 17, and 18, in order to enable the inner tube 22*b* and the cylinder 22*s* not to rotate, one end side of the inner tube 22*b* to which the cylinder 22*s* is mounted is fixedly supported to the rotary joint 35 not to rotate, the other end side is fixed to the flange 22*c* of the outer tube 22*a*, and the outer tube 22*a* is rotatably supported through the flange 22*c*.

The cylinder 22*s* is mounted to the inner tube 22*b* such that the fitting sections 22*g* formed at both ends of the cylinder 22*s* are inserted into the inner tube 22*b* while performing axis alignment and fixedly supported to the inner tube 22*b* at the fixing screw section 22*u* by the screw (not shown) as described above. The inner tube 22*b* is mounted to the rotary joint 35 such that the inner tube 22*b* is press-fitted into and fixedly supported to the flange 35*f* mounted to the casing 35*e*.

Since the casing 35*e*, the flange 35*f*, and the inner tube 22*b* are inserted into and mounted to each other in a fitting relationship, the inner tube 22*b* and the cylinder 22*s* have coaxiality with the casing 35*e*. The O-ring 35*i* for leakage prevention is inserted into the flange 35*f*, and the flange 35*f* is mounted to the casing 35*e* by the screw 35*h*. The inner tube 22*b* is mounted to and rotatably supported to the flange 22*c* through the bearing 22*j*. Since the flange 22*c*, the bearing 22*j*, and the inner tube 22*b* are inserted into and mounted to each other in a fitting relationship, the inner tube 22*b* and the cylinder 22*s* have coaxiality with the flange 22*c*.

However, in the case of the cooling roller 22 of the configuration example 6, after the cylinder 22*s* is mounted to the inner tube 22*b* that is press-fitted into and fixed to the flange 35*f*, it is impossible to assemble with the rotary joint 35 or mount the outer tube barrel section 22*z*. In this case, it can be resolved by devising the assembly procedure or the assembly method. For example, the cylinder 22*s* may be mounted to the inner tube 22*b* after assembling the inner tube 22*b* to the rotary joint 35. One of the reasons why the cylinder 22*s* and the inner tube 22*b* are initially not integrated (for example, integrally molded or fixed by an adhesive) but are separately configured is because it is easy to assemble, and it is possible to flexibly respond to the assembly procedure.

Through the above-described configuration, at one end side of the cooling roller 22, the inner tube 22*b* and the cylinder 22*s* have coaxiality with the outer tube 22*a* with reference to the rotary joint 35 (the casing 35*e*), the outer tube 22*a* is supported rotatably with respect to the rotary joint 35, and the inner tube 22*b* to which the cylinder 22*s* is mounted is fixedly supported not to rotate. At the other end side of the cooling roller 22, the inner tube 22*b* and the cylinder 22*s* have coaxiality with the outer tube 22*a* through the flange 22*c*, and the inner tube 22*b* to which the cylinder 22*s* is mounted is supported rotatably with respect to the outer tube 22*a*.

An opening hole 22*k* as an inlet/outlet hole and a cross-sectional hole 22*m* are formed at respective ends of the inner tube 22*b*. The cooling liquid in the narrow space flows into the inside of the inner tube 22*b* through the opening hole 22*k* and is drained to the outside through the cross-sectional hole 22*m*.

The flow passage of the cooling liquid is indicated by an arrow. The cooling liquid fed to the inside of the rotary joint 35 through the feed port formed in the rotary joint 35 first passes through the narrow space between the inner tube 22*b* and the rotor 35*a* and then flows through the outside flow passage including the narrow space formed between the outer tube 22*a* and the cylinder 22*s* toward the flange 22*c* side in the longitudinal direction of the cooling roller. At this time, the outer tube 22*a* is cooled down by the cooling liquid, and the temperature of the heat exchanged cooling liquid increases. In FIG. 16, the flow passage of the cooling liquid from the feed port of the rotary joint 35 to the end of the outside flow passage at the flange 22*c* side in the longitudinal direction of the cooling roller is referred to as a forward flow passage. The cooling liquid fed up to the end of the outside flow passage at the flange 22*c* side in the longitudinal direction of the cooling roller is U-turned through the opening hole 22*k* formed in the inner tube 22*b* to flow from the outside flow passage to the inside of the inner tube 22*b*. The cooling liquid flows inside the inner tube 22*b* in the longitudinal direction of the cooling roller reverse to the forward flow passage. The cooling liquid is drained to the outside of the inner tube 22*b* through the cross-section hole 22*m* and then drained to the outside of the rotary joint 35 through the drain port formed in the flange 35*f* of the rotary joint 35. Further, in FIG. 16, the flow passage of the cooling liquid from the opening hole 22*k* to the water drain port of the rotary joint 35 via the inside of the inner tube 22*b* is referred to a return flow passage.

As described above, the cooling roller 22 has the flow passage in which the cooling liquid flows back and forth and forms a closed-loop flow passage together with a cooling liquid circulating unit, which will be described later, through the rotary joint 35 to circulate the cooling liquid.

Further, the cooling roller 22 allows its components to be attached or detached for the purpose of reuse, recycling, or component replacement when a failure occurs.

Figure 19:
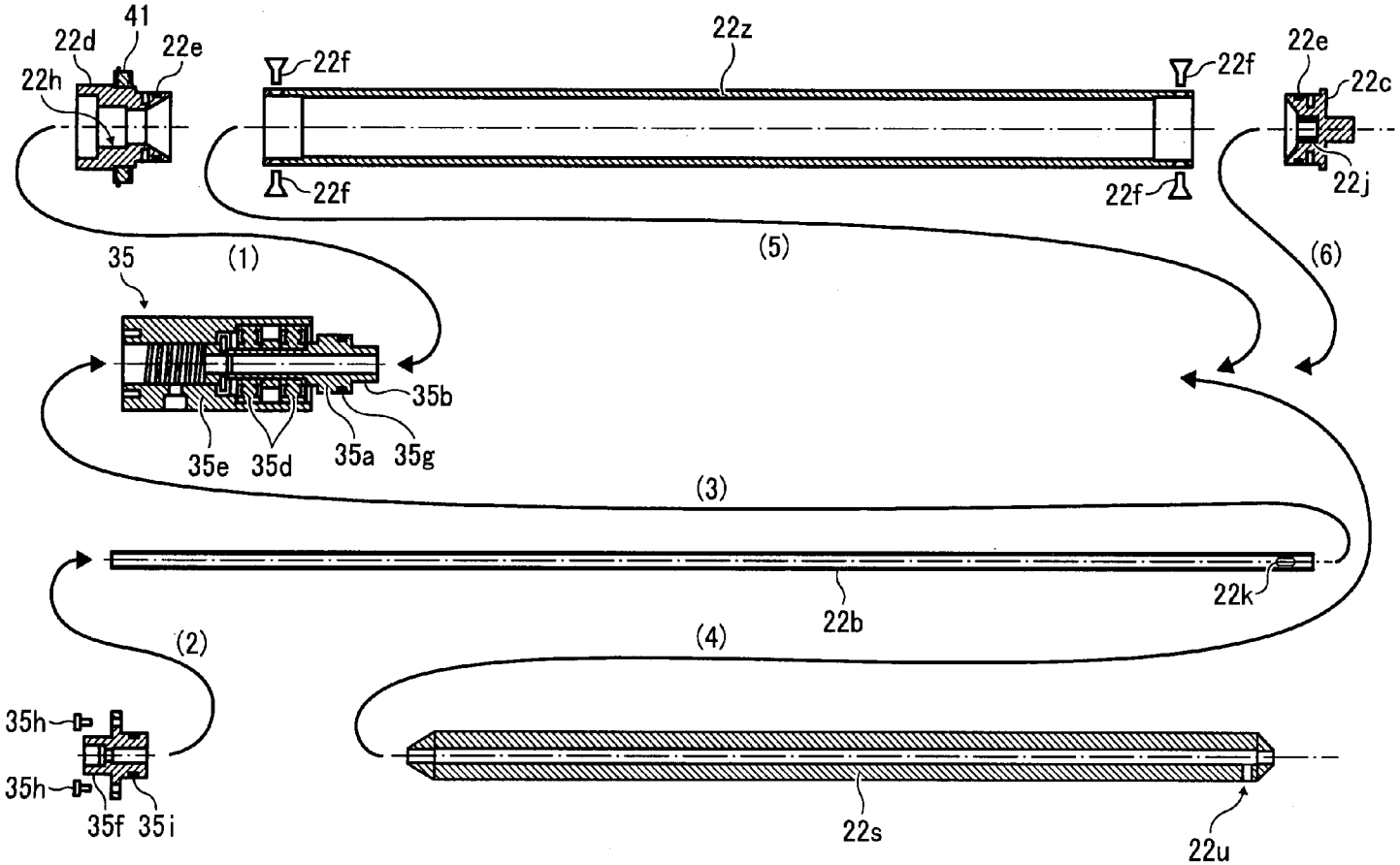
FIG. 19 is a schematic view illustrating a state before a cooling roller is assembled and a rotary joint is mounted.

FIG. 19 illustrates the components of the cooling roller 22, that is, the outer tube 22*a* (the outer tube barrel section 22*z*, the flange 22*c*, and the flange 22*d*), the inner tube 22*b*, the cylinder 22*s*, and the rotary joint 35, which are arranged in line. Particularly, FIG. 19 illustrates a state before the cooling roller 22 is assembled and the rotary joint 35 is mounted. In FIG. 19, the bearing 22*j* and the O-ring 22*e* are in a state combined with the flange 22*c*, and the bearing 41 and the O-ring 22*e* are in a state combined with the flange 22*d*. Of course, the components can be attached to or detached from the flanges, respectively. The rotary joint 35 can be also attached to or detached from the cooling roller 22, so that the rotary joint 35 can be replaced.

The cooling roller 22 of the configuration example 6 is configured so that assembly or disassembly (attachment or detachment of a component) can be simply performed. An assembly procedure will be described.

First, the flange 22*d* is fitted and inserted into the rotor 35*a* of the rotary joint 35 and fixed by the parallel screw sections 22*h* and 35*b* (work procedure 1). Next, one end side of the inner tube 22*b* is press-fitted into and fixedly supported to the flange 35*f* removed from the casing 35*e* of the rotary joint 35 (work procedure 2). The work procedure 1 and the work procedure 2 are in random order, and the work procedure 1 may be performed after the work procedure 2 is performed. The inner tube 22*b* to which the flange 35*f* is mounted is inserted into the rear end section of the casing 35*e*, starting from the opening hole 22*k* side, to penetrate the inside of the rotor 35*a*. The inner tube 22*b* is inserted until the flange 35*f* contacts the rear end section of the casing 35*e*, and then the flange 35*f* is fitted into and fixed to the casing 35*e* by the screw 35*h* (work procedure 3). Therefore, the inner tube 22*b* is fixedly supported to the casing 35*e* and becomes a non-rotation state. Thereafter, the inner tube 22*b* is inserted into the cylinder 22*s*, starting from the opening hole 22*k* side, in a fitting relationship while performing axis alignment, and the cylinder 22*s* is fixed to the inner tube 22*b* by the screw (not shown) through the fixing screw section 22*u* in a state in which both ends are supported (work procedure 4). The outer tube barrel section 22*z* is inserted from one end side to cover the inner tube 22*b* and the cylinder 22*s*, and the flange 22*d* is fitted and inserted into one end of the outer tube barrel section 22*z* and fixed by the screw 22*f* (work procedure 5). Finally, the flange 22*c* is fitted and inserted into opposite side free ends of the inner tube 22*b* whose one end side is mounted to the rotary joint 35 and the outer tube barrel section 22*z*, and fixed by the screw 22*f* (work procedure 6). Therefore, the outer tube 22*a* is rotatable with respect to the inner tube 22*b* through the flange 22*c*.

Accordingly, the assembly of the cooling roller 22 and mounting of the rotary joint 35 are completed as illustrated in FIG. 16. The disassembly of the cooling roller 22 is performed by performing the above-described works reversely to the above-described work procedure, and thus the components of the cooling roller 22 or the rotary joint 35 can be simply mounted or detached.

Configuration Example 7

Figure 20:
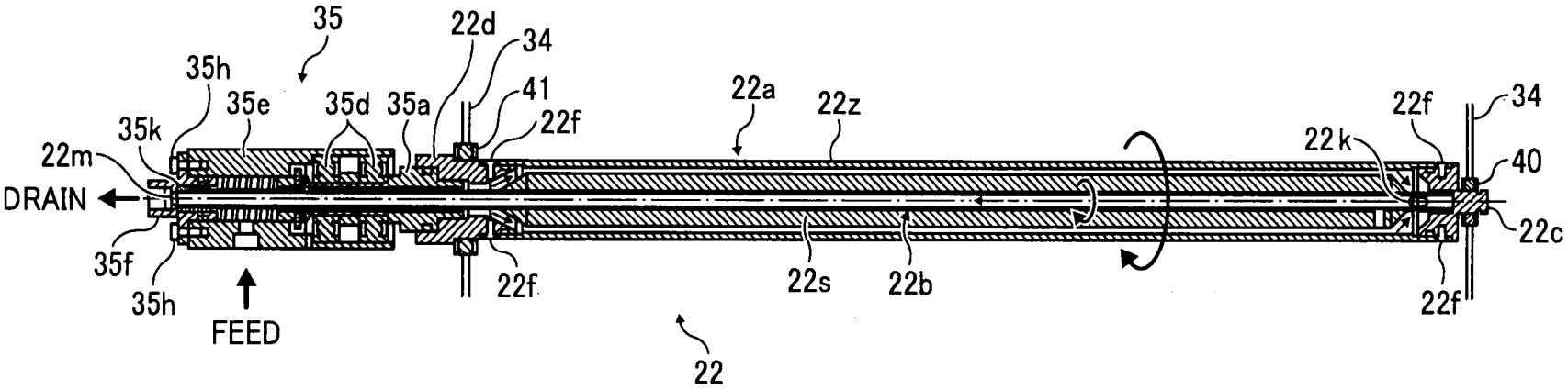
FIG. 20 is an enlarged view illustrating a cooling roller according to a configuration example 7 according to the embodiment 1-2.
Figure 21:
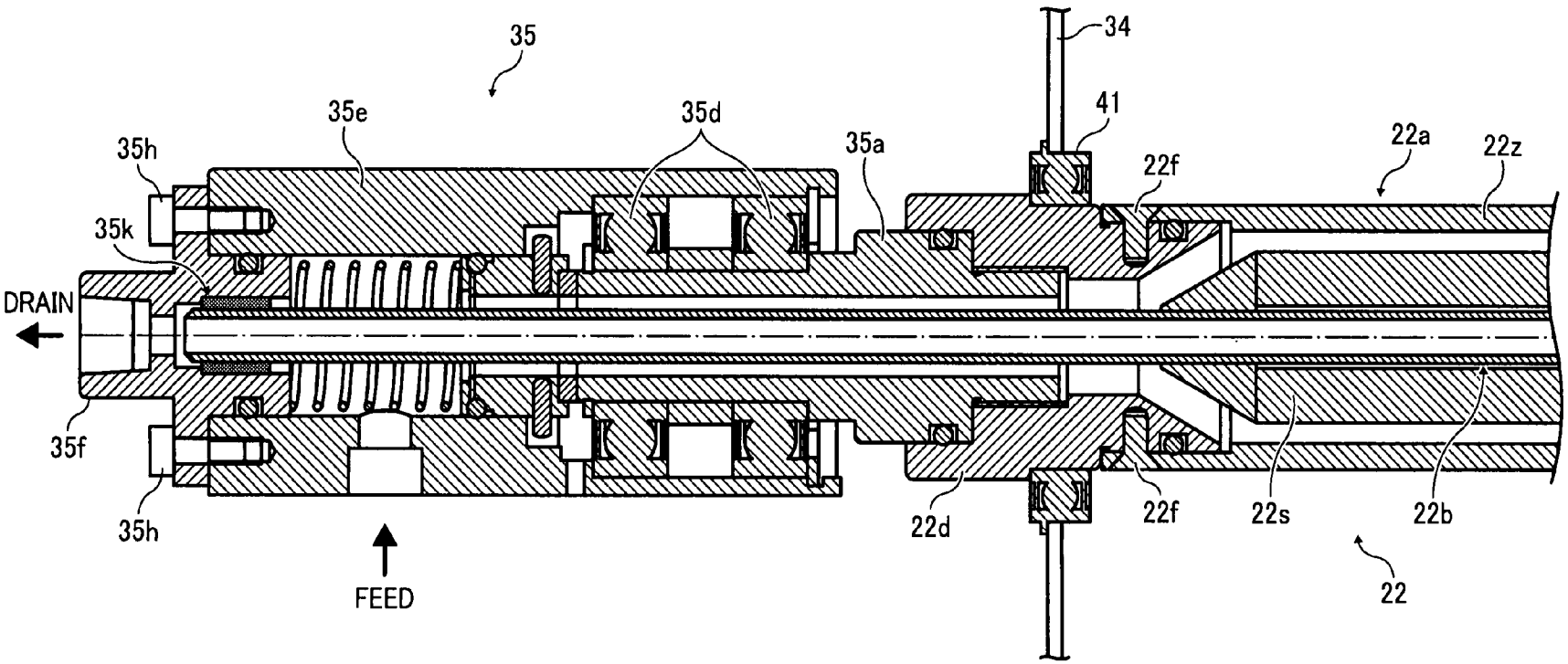
FIG. 21 is an enlarged view illustrating a longitudinal direction end of a cooling roller of FIG. 20 at a rotary joint side.
Figure 22:
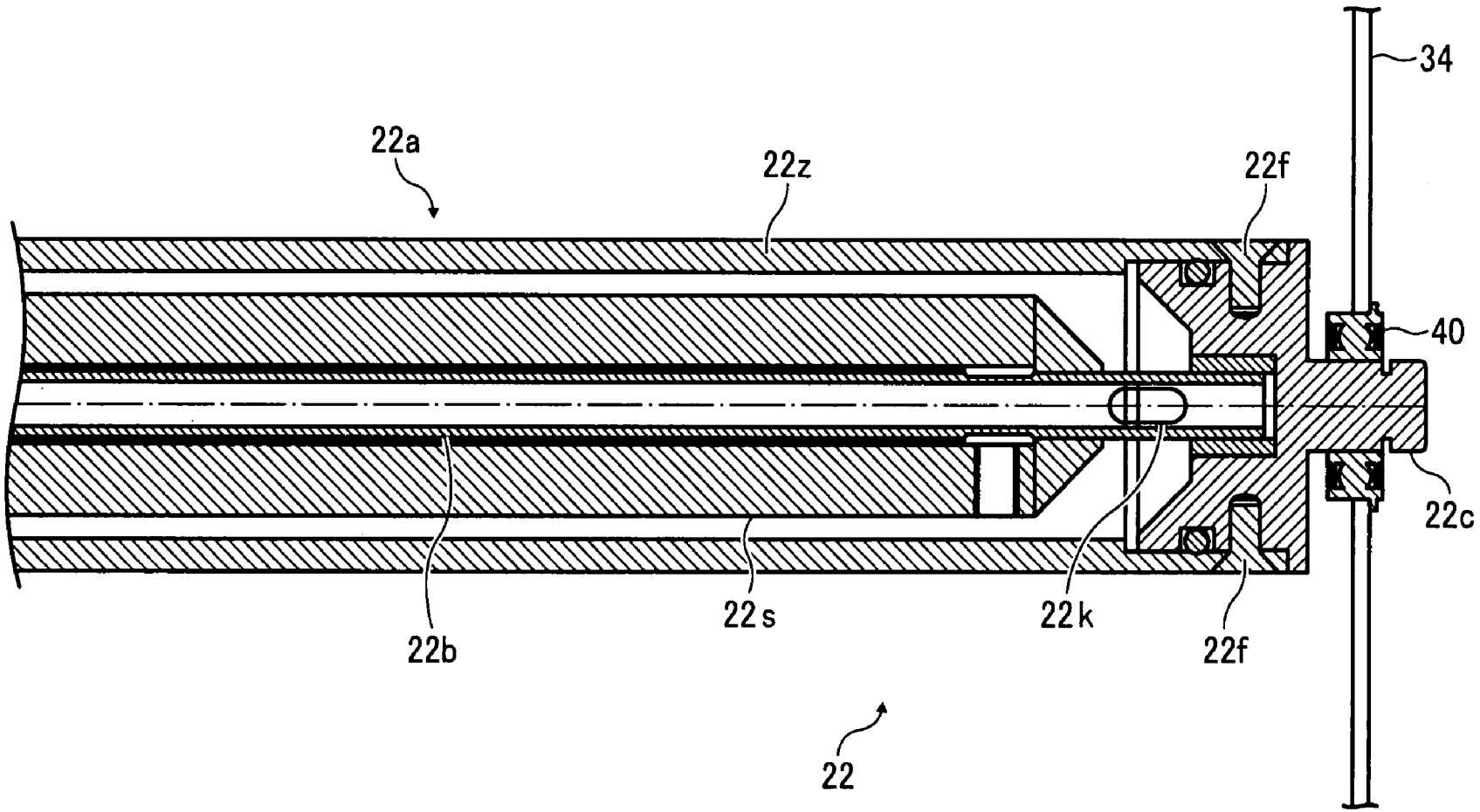
FIG. 22 is an enlarged view illustrating a longitudinal direction end of a cooling roller of FIG. 20 at a side opposite to a rotary joint.

FIG. 20 is a schematic cross-sectional view of the cooling roller 22 according to configuration example 7. FIG. 21 is an enlarged view illustrating a longitudinal direction end of the cooling roller 22 at a rotary joint 35 side. FIG. 22 is an enlarged view illustrating a longitudinal direction end of the cooling roller 22 at a side opposite to the rotary joint 35.

In the cooling roller 22 of the configuration example 7, the outer tube 22*a* rotates, and the inner tubes 22*b* and the cylinder 22*s* rotate together with the outer tube 22*a*. The cooling roller 22 is appropriate to the case of desiring to make smooth the flow (the flow in the axial direction and the rotation direction) of the cooling liquid in the outer tube 22*a*, and particularly, is effective in the case where the supply flow quantity of the cooling liquid is abundant or the flow velocity in the narrow space is fast.

When the cylinder 22*s* rotates in the same direction as the outer tube 22*a* in synchronization with the rotation of the outer tube 22*a*, the narrow space flow passage also rotate, and thus the cooling liquid in the narrow space flows very smoothly in the axial direction and in the rotation direction without any resistance. In addition, the cooling efficiency can be further improved by increasing the flow quantity (increasing the flow velocity). As described above, when the cylinder 22*s* rotates, the cooling efficiency increases in the case in which the flow quantity is abundant (the flow velocity is fast) more than in the case in which the flow quantity is small (the flow velocity is slow). Here, even though described in the configuration example 6, since as the flow velocity becomes faster, the effect by the high flow velocity is greater, the difference of the cooling effect between rotation and non-rotation of the cylinder 22*s* is reduced. However, since making the flow velocity sufficiently high to eliminate the difference requires large energy, it is actually not realistic. For this reason, if the cooling liquid flows at as fast flow velocity as possible (the flow velocity is determined by the space of the flow passage and the quantity of the flow flowing therein) while taking energy consumption into account, it is preferable to use the cooling roller 22 of the configuration example 7.

Further, when the cylinder 22*s* rotates together with the outer tube 22*a*, whether the inner tube 22*b* rotates or does not rotate does not influence the flow of the cooling liquid inside the narrow space flow passage and has nothing to do with the cooling performance. However, since the cylinder 22*s* is mounted such that both ends thereof are supported to the inner tube 22*b*, axis alignment with the rotary joint 35 or the outer tube 22*a* is performed with the high degree of accuracy, and vibration can be prevented. Therefore, when the cylinder 22*s* is fixed to and integrated with the inner tube 22*b* (of course, when the cylinder 22*s* rotates, the inner tube 22*b* rotates), the rotation accuracy of the cooling roller 22 can be improved, and vibration of the cylinder 22*s* caused by the high space accuracy of the narrow space flow passage or the flow of the cooling liquid can be prevented.

The configuration of the cooling roller 22 of the configuration example 7 is different from the configuration of the cooling roller 22 of the configuration example 6 illustrated in FIG. 16 in that one end side of the inner tube 22*b* is press-fitted into and fixedly supported to the flange 22*c* that is coaxial with the outer tube barrel section 22*z*, and the other end of the inner tube 22*b* is mounted to the flange 35*f* through the bearing 35*k* so that the inner tube 22*b* is rotatable with respect to the rotary joint 35. That is, in the cooling roller 22 of the configuration example 7, the inner tube 22*b* as well as the outer tube 22*a* is supported rotatably with respect to the rotary joint 35 (the casing 35*e*), and at the other end side, the inner tube 22*b* is fixedly supported to the outer tube 22*a* to rotate in synchronization with the outer tube 22*a*. The flow passages through which the cooling liquid of the cooling roller 22 flows back and forth are the same as illustrated in FIG. 16.

Further, the components of the cooling roller 22 of the configuration example 7 can be mounted or detached, and the rotary joint 35 can be mounted or detached.

Figure 23:
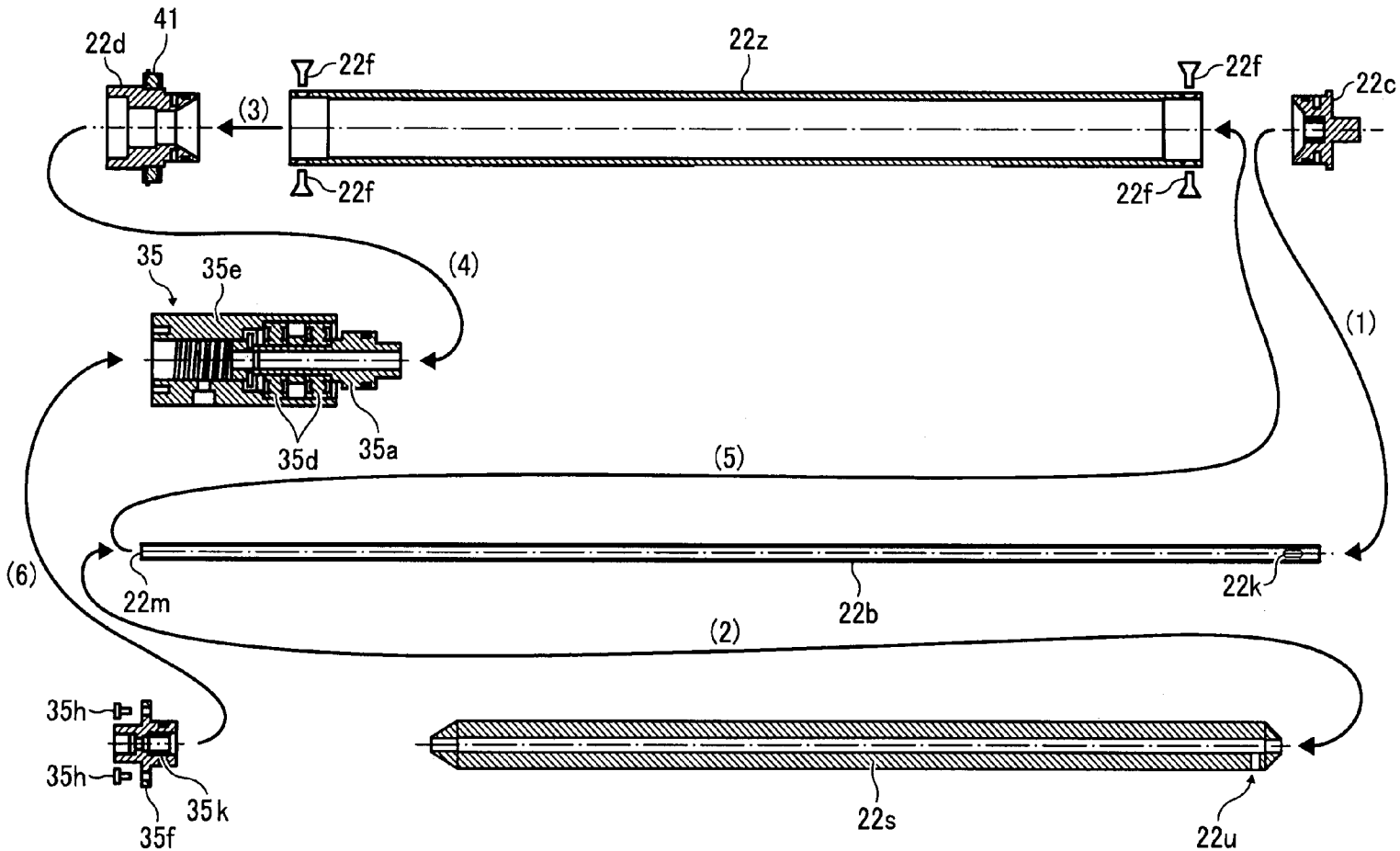
FIG. 23 is an explanation view used for explaining the assembly of the cooling roller of FIG. 20.

An assembly procedure of the cooling roller 22 of the configuration example 7 will be described with reference to FIG. 23. First, one end side (the opening hole 22*k* side) of the inner tube 22*b* is press-fitted into and fixedly supported to the flange 22*c* (work procedure 1). The inner tube 22*b* to which the flange 22*c* is mounted is inserted into the cylinder 22*s* through the fixing screw section 22*u* side in a fitting relationship while performing axis alignment, and the cylinder 22*s* is fixed to the inner tube 22*b* by the screw (not shown) at the fixing screw section 22*u* in a state in which both ends are supported (work procedure 2). Next, the flange 22*d* is fitted and inserted into and fixed to one end side of the outer tube barrel section 22*z* (work procedure 3). The flange 22*d* to which the outer tube barrel section 22*z* is mounted is fitted and inserted into and fixed to the rotor 35*a* of the rotary joint 35 (work procedure 4). The work procedure 1, the work procedure 2, the work procedure 3, and the work procedure 4 are in random order. Thereafter, the inner tube 22*b* to which the flange 22*c* and the cylinder 22*s* are mounted are inserted into the outer tube barrel section 22*z* to which the rotary joint 35 is mounted. At this time, attention is required so that the inner wall of the outer tube barrel section 22*z* and the outer wall of the cylinder 22*s* may not contact and get hurt. The inner tube 22*b* is inserted until the flange 22*c* contacts the end section of the outer tube barrel section 22*z*, and then the flange 22*c* is fitted into and fixed to the outer tube barrel section 22*z* (work procedure 5). Finally, the flange 35*f* is fitted and inserted into, while inserting one end side of the inner tube 22*b* into the bearing 35*k* of the flange 35*f*, and fixed to the rear end section of the casing 35*e* of the rotary joint 35 (work procedure 6). Therefore, the inner tube 22*b*, the cylinder 22*s*, and the outer tube 22*a* are rotatable with respect to the rotary joint 35.

Accordingly, the assembly of the cooling roller 22 is completed as illustrated in FIG. 20. The disassembly of the cooling roller 22 is performed by performing the above-described works reversely to the above-described work procedure, and thus the components of the cooling roller 22 can be simply mounted or detached. Further, similarly to the configuration example 6, the O-ring of the flange 22*c* or the bearing and the O-ring of the flange 22*d* can be mounted or detached in units of components. Further, similarly to the configuration example 6, the rotary joint 35 can be also detached in units of components.

Configuration Example 8

Figure 24:
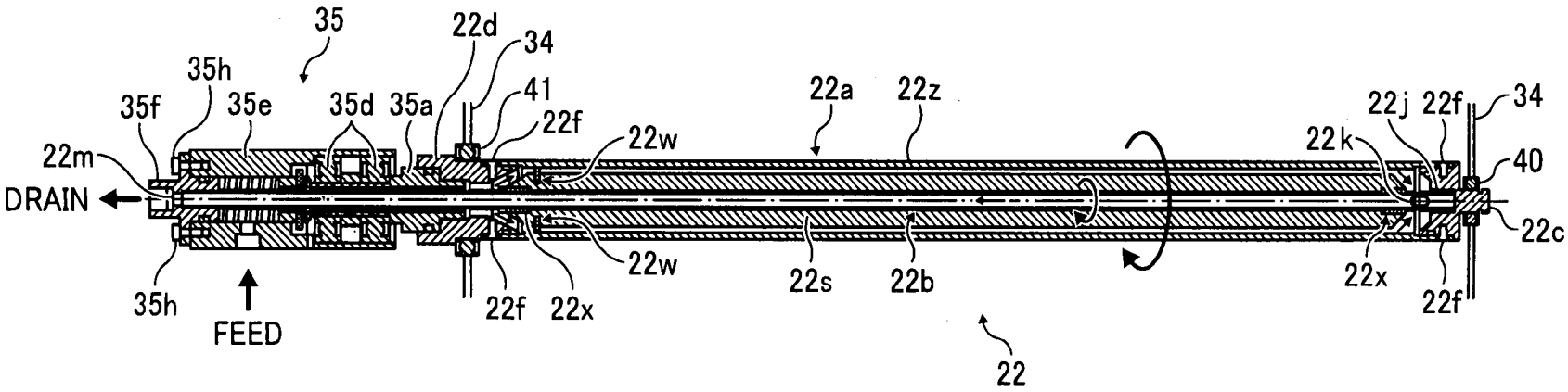
FIG. 24 is a schematic cross-sectional view illustrating a cooling roller according to a configuration example 8 according to the embodiment 1-2.
Figure 25:
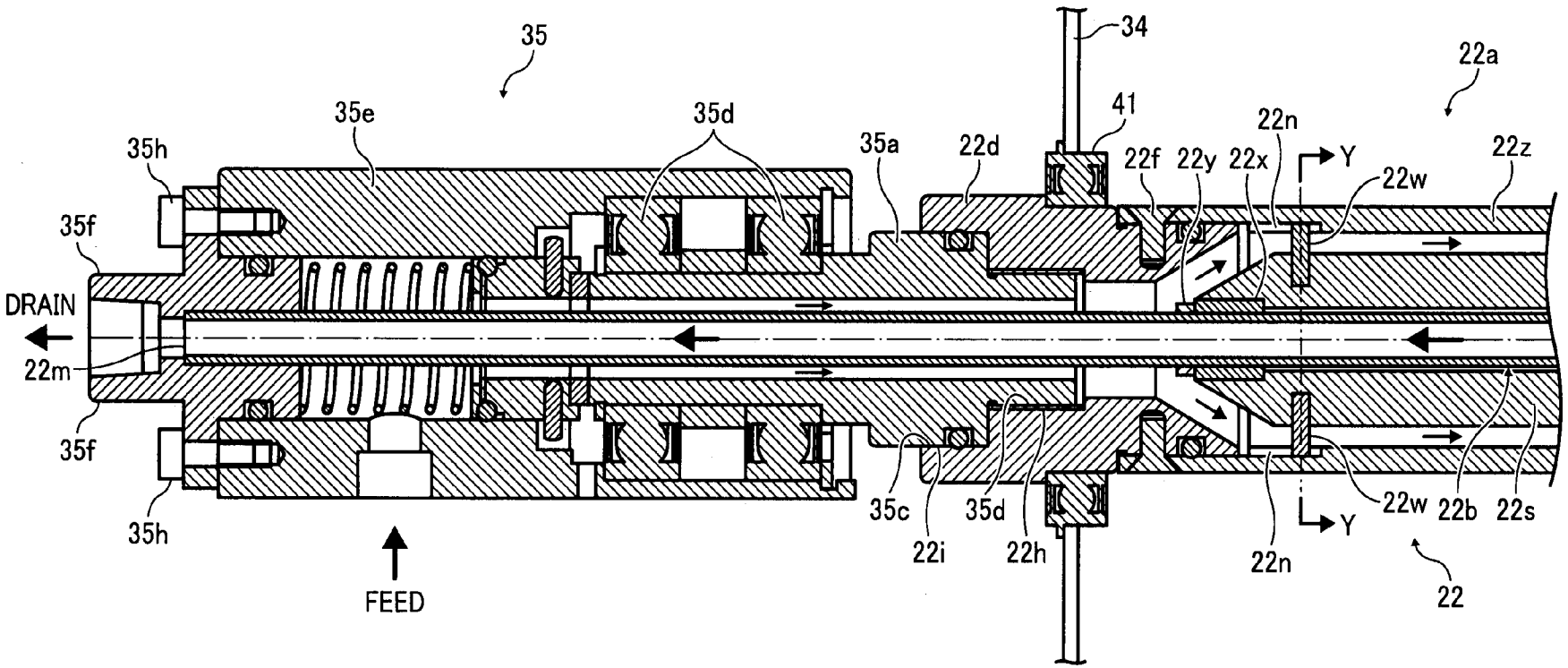
FIG. 25 is an enlarged view illustrating a longitudinal direction end of a cooling roller of FIG. 24 at a rotary joint side.
Figure 26:
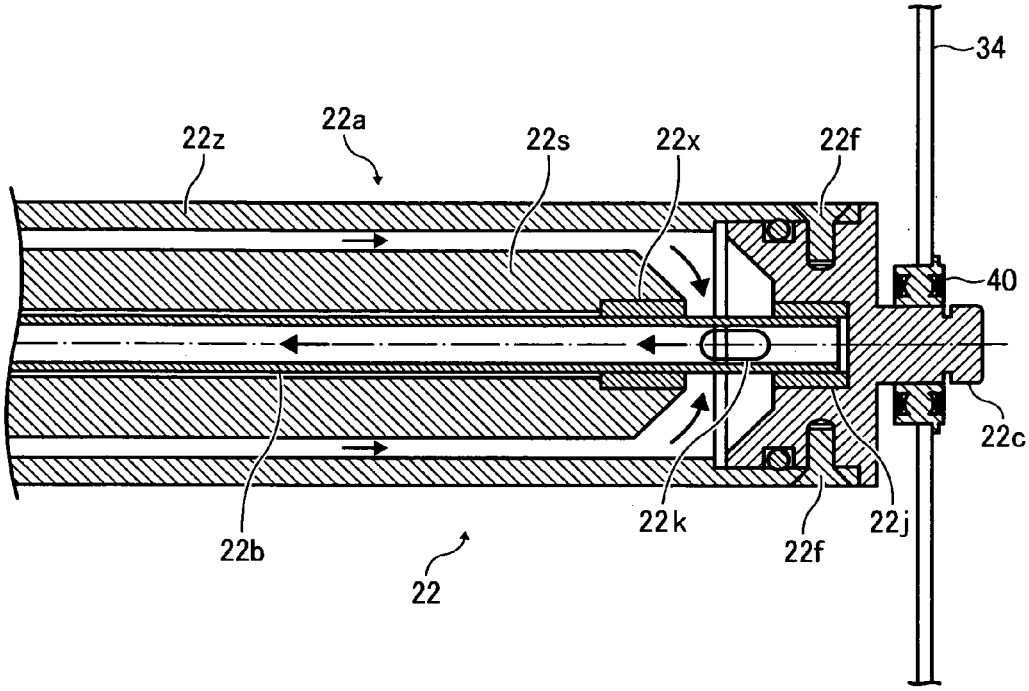
FIG. 26 is an enlarged view illustrating a longitudinal direction end of a cooling roller of FIG. 24 at a side opposite to a rotary joint.

FIG. 24 is a schematic cross-sectional view of the cooling roller 22 according to configuration example 8. FIG. 25 is an enlarged view illustrating a longitudinal direction end of the cooling roller 22 at a rotary joint 35 side. FIG. 26 is an enlarged view illustrating a longitudinal direction end of the cooling roller 22 at a side opposite to the rotary joint 35.

In the cooling roller 22 of the configuration example 8, the outer tube 22*a* rotates, the cylinder 22*s* rotates together with the outer tube 22*a*, and the inner tubes 22*b* does not rotate. Since the cylinder 22*s* rotates in synchronization with rotation of the outer tube 22*a*, similarly to the cooling roller 22 of the configuration example 7, the cooling roller 22 of the configuration example 8 is appropriate to the case of desiring to make smooth the flow (the flow in the axial direction and the rotation direction) of the cooling liquid flowing in the narrow space flow passage formed between the outer tube 22*a* and the cylinder 22*s*, and particularly, is effective in the case where the supply flow quantity of the cooling liquid is abundant or the flow velocity in the narrow space is fast.

Since the cylinder 22*s* rotates in synchronization with the rotation of the outer tube 22*a*, the cooling roller 22 of the configuration example 8 has the same cooling mechanism, feature, and performance as the cooling roller 22 of the configuration example 7 in which the cylinder 22*s* rotates in synchronization with the rotation of the outer tube 22*a* as in the cooling roller 22 of the configuration example 8, and description thereof is omitted. The cooling roller 22 of the configuration example 8 is different from the cooling roller 22 of the configuration example 7 in that in the cooling roller 22 of the configuration example 7, the inner tube 22*b* also rotates in synchronization with the rotation of the outer tube 22*a*, whereas in the cooling roller 22 of the configuration example 8, the inner tube 22*b* does not rotate.

Further, when the outer tube 22*a* and the cylinder 22*s* rotate, whether the inner tube 22*b* rotates or does not rotate does not influence the flow of the cooling liquid inside the narrow space flow passage and has nothing to do with the cooling performance. However, when the inner tube 22*b* rotates together with the outer tube 22*a* and the cylinder 22*s* as in the cooling roller 22 of the configuration example 7, since one end side of the inner tube 22*b* needs to be rotatably supported to the rotary joint 35 using the bearing 35*k*, in order to rotate without rattling, the bearing 35*k* and the inner tube 22*b* need to be fitted into each other with the high degree of accuracy.

In the cooling roller 22 of the configuration example 7, as illustrated in FIG. 20, a slide bearing is used as the bearing 35*k*, but under a condition of use in a liquid, a resin or ceramic bearing (a slide bearing or a rolling bearing) is widely used as the bearing 35*k*. However, since the bearings have some problems on dimensional accuracy or time degradation (abrasion), it is difficult to secure the high fitting accuracy with the inner tube 22*b*, and thus they become a cause of rotational vibration of the inner tube 22*b*. The rotational vibration of the inner tube 22*b* in the slide bearing section greatly influences the rotary joint 35 side, and so the whole rotary joint 35 vibrates, thereby causing breakage or leak.

In order to avoid the anxiety, in the cooling roller 22 of the configuration example 8, the inner tube 22*b* does not rotate so that rotation vibration of the inner tube 22*b* does not occur. The same cooling performance as the cooling roller 22 of the configuration example 7 is achieved, and vibration of the rotary joint 35 is prevented.

The configuration of the cooling roller 22 of the configuration example 8 is different from the configuration of the cooling roller 22 of the configuration example 7 illustrated in FIG. 20 in that regarding the inner tube 22*b*, one end side of the inner tube 22*b* is rotatably supported to the flange 22*c* that is coaxial with the outer tube barrel section 22*z* through the bearing 22*j*, and the other end of the inner tube 22*b* is press-fitted into and fixedly supported to the flange 35*f* of the rotary joint 35 so that the inner tube 22*b* does not rotate as illustrated in FIG. 24. Therefore, in the cooling roller 22 of the configuration example 8, the inner tube 22*b* does not rotate with respect to the rotary joint 35 (the casing 35*e*), and the outer tube 22*a* is rotatable with respect to the inner tube 22*b*.

The cylinder 22*s* rotates in synchronization with the outer tube 22*a* and is rotatable with respect to the inner tube 22*b*. For this reason, rotational force of the outer tube 22*a* is transmitted to the cylinder 22*s*, for example, by an engagement unit, so that the cylinder 22*s* rotates together with the outer tube 22*a*, and the cylinder 22*s* is rotatable with respect to the inner tube 22*b* through a bearing 22*x*.

Figure 27:
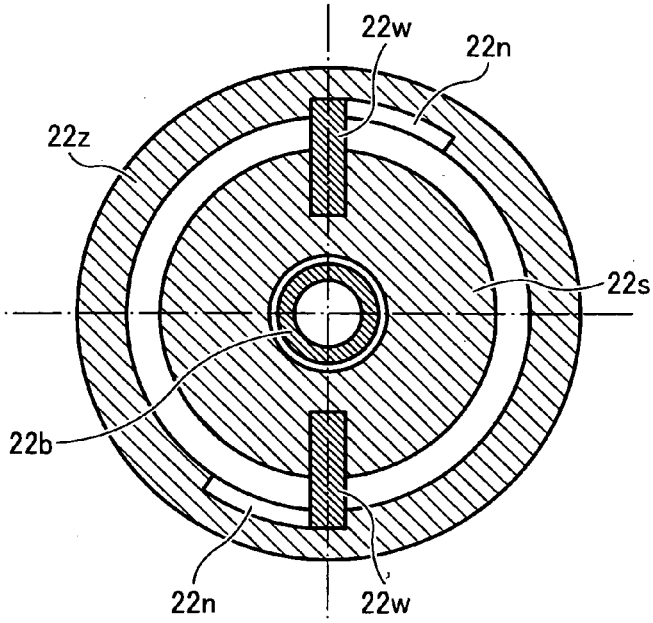
FIG. 27 is an explanation view illustrating a Y-Y cross section of FIG. 24.

For the sake of accompany rotation of the cylinder 22*s*, as illustrated in FIG. 25 that is a cross-sectional view taken along line Y-Y of FIG. 27, for example, an engagement unit including an engagement pin 22*w* formed in the cylinder 22*s* and an engagement groove 22*n* formed in the outer tube barrel section 22*z* is used. The engagement pin 22*w* is engaged with the engagement groove 22*n*, so that rotation of the outer tube 22*a* is transmitted to the cylinder 22*s*, and the cylinder 22*s* rotates together. The cylinder 22*s* is prevented from moving in the axial direction (the left-right direction in FIG. 27) by a stopper 22*y* formed in the inner tube 22*b* and the engagement pin 22*w*.

The flow passage in which the cooling liquid flows back and forth in the cooling roller 22 of the configuration example 8 is the same as in the cooling roller 22 of the configuration example 7 illustrated in FIG. 20. The components of the cooling roller 22 of the configuration example 8 can be also mounted or detached, and the rotary joint 35 can be also mounted or detached.

Figure 28:
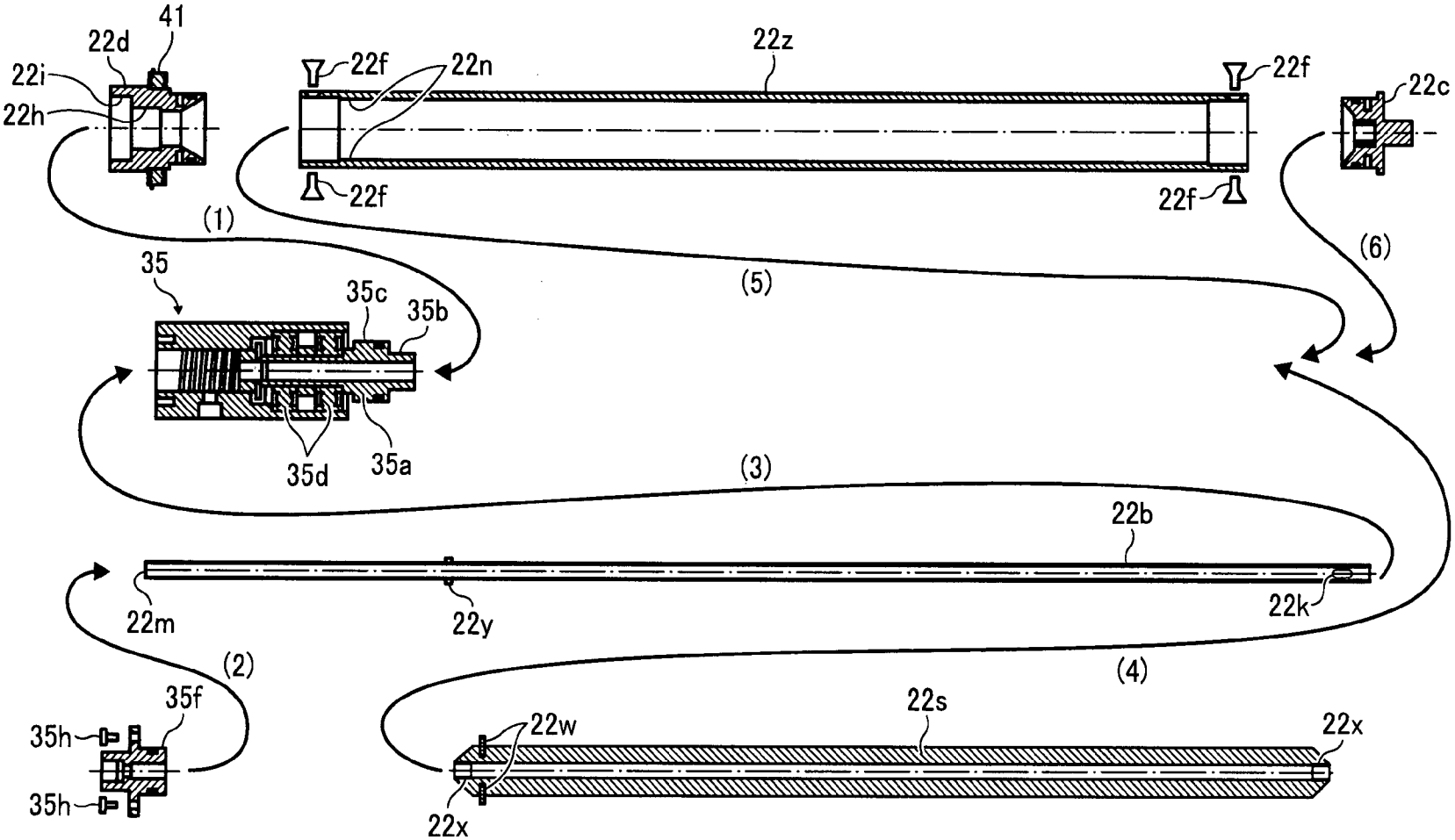
FIG. 28 is an explanation view used for explaining the assembly of the cooling roller of FIG. 20.

An assembly procedure of the cooling roller 22 of the configuration example 8 will be described with reference to FIG. 28. First, the flange 22*d* is fitted and inserted into and fixed to the rotor 35*a* of the rotary joint 35 (work procedure 1). Next, one end side of the inner tube 22*b* is press-fitted into and fixedly supported to the flange 35*f* of the rotary joint 35 (work procedure 2). The work procedure 1 and the work procedure 2 are in random order. The work procedure 1 may be performed after the work procedure 2 is performed. The inner tube 22*b* is passed through the rotary joint 35, and the flange 35*f* is fitted into and fixed to the casing 35*e* (work procedure 3). Therefore, the inner tube 22*b* is fixedly supported to the rotary joint 35 and becomes a non-rotation state. Bearings 22*x* are disposed on both ends of the cylinder 22*s*, and the engagement pin 22*w* is mounted to one end of the cylinder 22*s*. The inner tube 22*b* is inserted into the cylinder 22*s*, starting from the opening hole 22*k* side, in a fitting relationship in an axis alignment state until it contacts the stopper 22*y* (work procedure 4). Therefore, the cylinder 22*s* is rotatably supported to the inner tube 22*b*. The inner tube 22*b* and the cylinder 22*s* are inserted into the outer tube barrel section 22*z* starting from one ends thereof, and the flange 22*d* fixed to the rotor 35*a* is fitted and inserted into and fixed to one end of the outer tube barrel section 22*z*. Since the engagement pin 22*w* and the engagement groove 22*n* are disposed as the engagement unit for rotating the cylinder 22*s* together with the outer tube 22*a*, when the outer tube barrel section 22*z* is assembled to cover the cylinder 22*s*, the engagement pin 22*w* is fitted into the engagement groove 22*n* so that an accompanying rotation relationship can be made (work procedure 5). Finally, the flange 22*c* is fitted and inserted into and fixed to free ends of the inner tube 22*b* and the outer tube barrel section 22*z* so that the inner tube 22*b* can be rotatable.

Accordingly, the assembly of the cooling roller 22 and mounting of the rotary joint 35 are completed as illustrated in FIG. 24. The disassembly of the cooling roller 22 is performed by performing the above-described works reversely to the above-described work procedure, and thus the components of the cooling roller 22 or the rotary joint 35 can be simply mounted or detached:

Configuration Example 9

Figure 29:
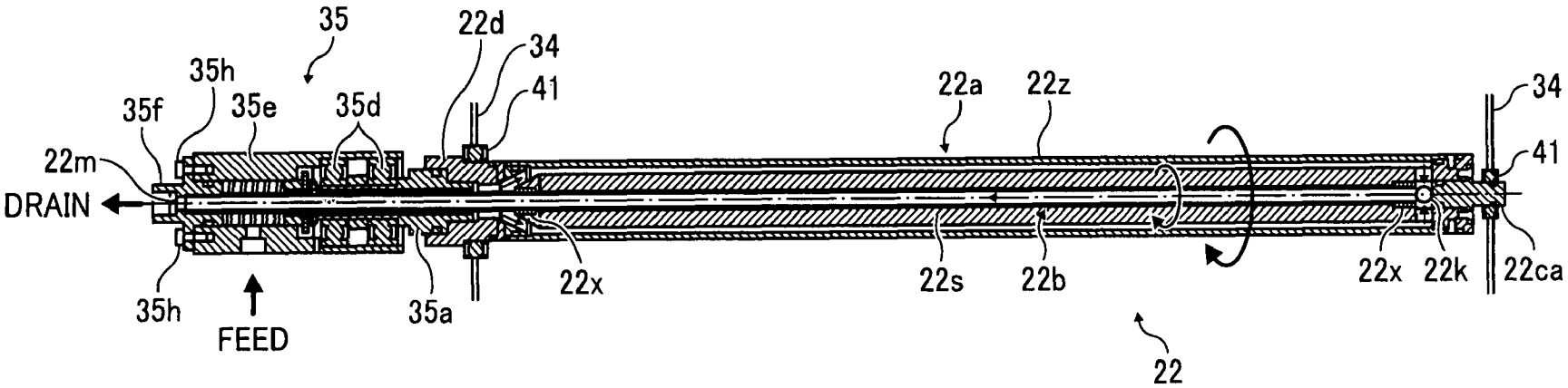
FIG. 29 is a schematic cross-sectional view illustrating a cooling roller according to a configuration example 9 according to the embodiment 1-2.

FIG. 29 is a schematic cross-sectional view of the cooling roller 22 according to the configuration example 9. In the configuration example 9, a configuration in which the cylinder 22*s* rotates together with rotation of the outer tube 22*a* using the engagement unit as illustrated in FIG. 24 is not provided. Instead, as illustrated in FIG. 29, through a configuration of increasing stiffness of a drive transmission system (without the engagement unit), rotational force of the outer tube 22*a* is transmitted directly to the cylinder 22*s*. That is, the outer tube 22*a* and the cylinder 22*s* are integrally formed. Through such a configuration, a problem in that the fluid resistance increases due to the engagement unit such as the engagement pin 22*w* is also solved.

Figure 30:
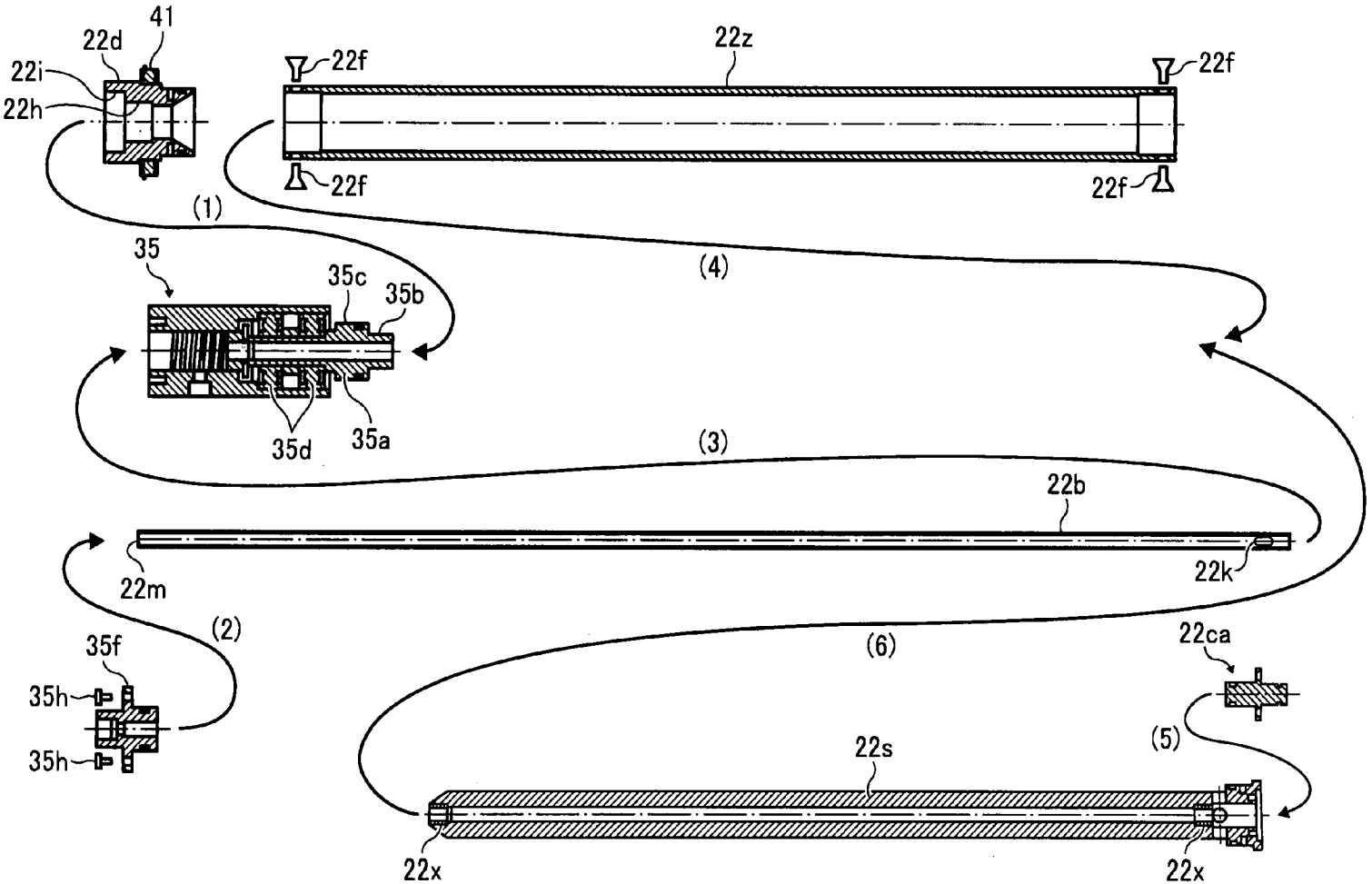
FIG. 30 is an explanation view used for explaining the assembly of the cooling roller of FIG. 29.

Specially, as illustrated in FIG. 30, the engagement pin 22*w* for engaging the cylinder 22*s* with the outer tube 22*a* is eliminated from the cooling roller 22 of the configuration example 8, and instead of the flange 22*c* that is fitted into and fixed to the outer tube barrel section 22*z* in the cooling roller 22 of the configuration example 8 as illustrated in FIG. 24, the cylinder 22*s* with the flange in which the flange 22*c* is formed integrally with the cylinder 22*s* as illustrated in FIG. 30 is disposed. The outer tube 22*a* and the cylinder 22*s* with the flange can be rotatable with respect to the inner tube 22*b* by fitting and fixing the cylinder 22*s* with the flange into the outer tube barrel section 22*z*.

Further, in the configuration example 9, a shaft 22*ca* is disposed as a component separated from the cylinder 22*s* with the flange. It is to easily process the cylinder 22*s*, and mountability of the bearing 22*x* was also considered.

Configuration Example 10

In the cooling roller 22 of configuration example 10, the outer tube 22*a* rotates, the inner tube 22*b* rotates together with the outer tube 22*a*, and the cylinder 22*s* does not rotate. Since the cylinder 22*s* does not rotate even though the outer tube 22*a* rotates, the cooling roller 22 of the configuration example 10 is appropriate to the case of desiring to actively generate the turbulence in the flow (the flow in the axial direction and the rotation direction) of the cooling liquid flowing in the narrow space flow passage formed between the outer tube 22*a* and the cylinder 22*s*, and particularly, is effective in the case where the supply flow quantity of the cooling liquid is small or the flow velocity in the narrow space is slow.

Since the cylinder 22*s* does not rotate even though the outer tube 22*a* rotates, the cooling roller 22 of the configuration example 10 has the same cooling mechanism, feature, and performance as the cooling roller 22 of the configuration example 6 in which the cylinder 22*s* does not rotate even though the outer tube 22*a* rotates as in the cooling roller 22 of the configuration example 10, and description thereof is omitted. The cooling roller 22 of the configuration example 10 is different from the cooling roller 22 of the configuration example 6 in that in the cooling roller 22 of the configuration example 6, the inner tube 22*b* does not rotate like the cylinder 22*s*, whereas in the cooling roller 22 of the configuration example 10, the inner tube 22*b* rotates in synchronization with the rotation of the outer tube 22*a*.

Whether the inner tube 22*b* rotates or does not rotate does not influence the flow of the cooling liquid in the narrow space flow passage and has nothing to do with the cooling performance. However, rotation of the inner tube 22*b* in synchronization with the outer tube 22*a* means that the inner tube 22*b* can be integrated with the outer tube 22*a*, and thus axis alignment between the inner tube 22*b* and the outer tube 22*a* can be performed with the high degree of accuracy. Therefore, when the inner tube 22*b* is integrated with the outer tube 22*a*, and the inner tube 22*b* and the cylinder 22*s* are in a rotatable relationship (the cylinder 22*s* is fixed to an immobile section), the rotation accuracy of the cooling roller 22 can be improved, and vibration of the cylinder 22*s* caused by the high space accuracy of the narrow space flow passage or the flow of the cooling liquid can be prevented.

Embodiment 1-3

Figure 14:
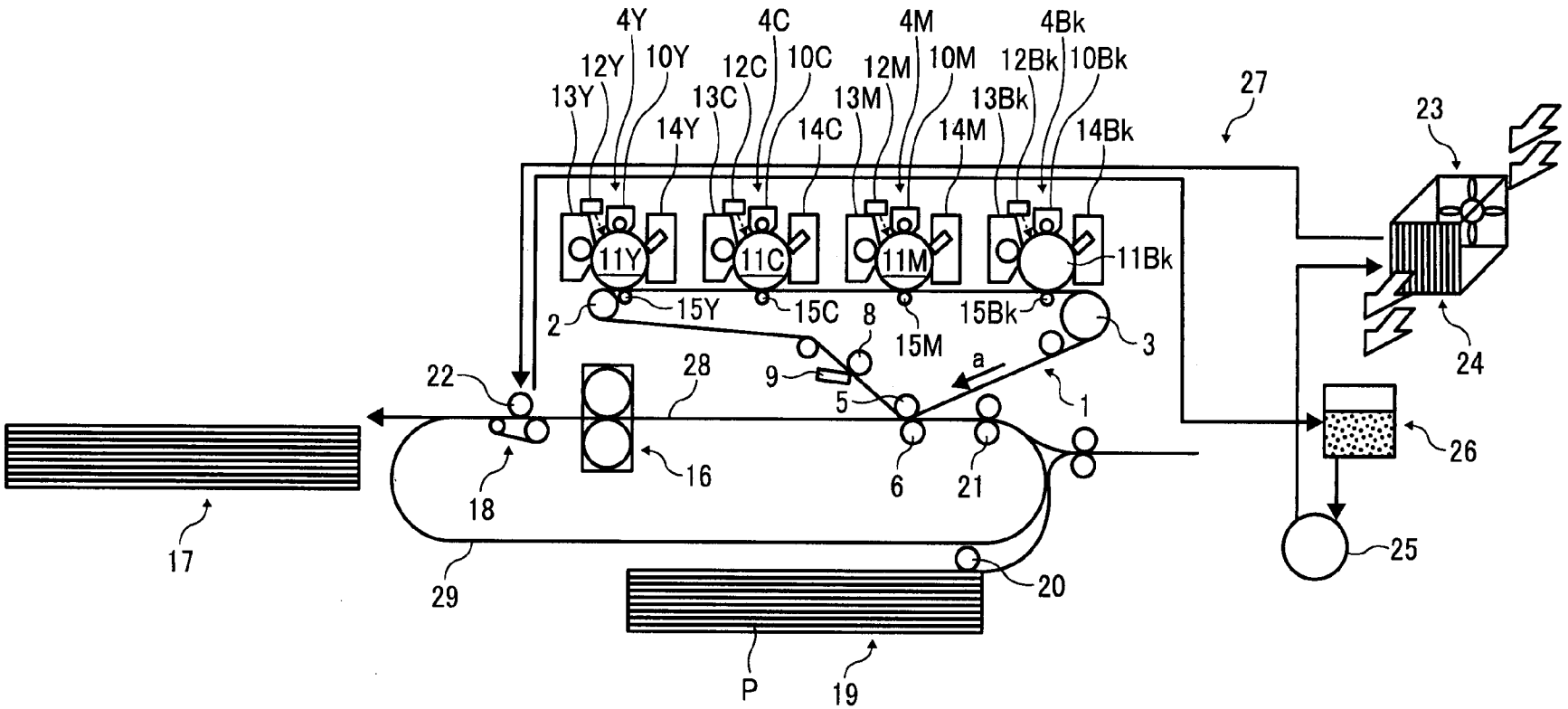
FIG. 14 is an explanation view illustrating a schematic configuration example (1) of an image forming device in which a cooling roller according to an embodiment 1 is installed.

FIG. 14 is a schematic configuration diagram illustrating a color image forming device of a tandem type intermediate transfer belt method in which the cooling device 18 having the cooling roller 22 of the present invention is installed. The color image forming device can perform image forming at a high speed, for example, perform image forming of 100 to 120 pieces of A4-size papers per minute, but the present invention can be similarly applied to any image forming device (an image forming device of an electrophotography method such as a copy machine or a printer typically used in offices) other than the high speed machine.

An intermediate transfer belt 1 as an intermediate transfer medium is stretch over a plurality of rollers. The intermediate transfer belt 1 is configured to rotate by the rollers, and a process unit for image formation is disposed around the intermediate transfer belt 1.

If a rotation direction of the intermediate transfer belt 1 is a direction indicated by an arrow "a" in the drawing, as process unit for image formation, a first image station 4Y, a second image station 4C, a third image station 4M, a fourth image station 4Bk are disposed between a roller 2 and a roller 3 above the intermediate transfer belt 1 in order from an upstream side of the intermediate transfer belt 1 in the rotation direction. For example, as the first image station 4Y, a charging unit 10Y, an optical writing unit 12Y, a developing device 13Y, and a cleaning unit 14Y are disposed around a drum-shaped photoreceptor 11Y. A primary transfer roller 15Y as a transfer unit for the intermediate transfer belt 1 is disposed at a position facing the photoreceptor 11 with the intermediate transfer belt 1 interposed therebetween. The other three image stations have the same configuration. The four image stations are disposed at a predetermined pitch interval in parallel in a left-right direction.

In the present embodiment, the optical writing unit 12 is used as an optical system having a light emitting diode (LED) as a light source but may be configured with a laser optical system having a laser as a light source. The optical writing unit 12 performs light exposure on the photoreceptor 11 based on image information.

Below the intermediate transfer belt 1, disposed are a paper receiving unit 19 of the paper P that is the sheet-like member, a paper feed roller 20, a pair of resist rollers 21, a secondary transfer roller 6 which serves as a transfer unit from the intermediate transfer belt 1 to the paper P and which is disposed to face via the intermediate transfer belt 1 a roller 5 stretching the intermediate transfer belt 1, a cleaning unit 9 that is disposed at a position facing a roller 8 contacting a back side of the intermediate transfer belt 1 to contact a front surface of the intermediate transfer belt 1, a heat fixing unit 16, the cooling device 18 having the cooling roller 22 for cooling the paper P, and a discharge paper receiving unit 17 that is a discharge section of the paper P on which the toner is fixed. A paper transport path 28 extends from the paper receiving unit 19 to the discharge paper receiving unit 17. At the time of two-sided image formation, in order to perform image formation on a back side, a paper transport path 29 for two-sided image formation in which the paper P passing through the cooling device 18 once is inverted and transported to a pair of resist rollers 21 again is also provided.

The cooling roller 22 of the cooling device 18 is a heat receiving unit that receives heat of the paper P. The cooling roller 22 is communicated or connected with a radiator 24 having a cooling fan 23, a pump 25, and a tank 26 through a liquid feed tube 27 and encloses the cooling liquid therein. The cooling liquid is circulated along a circulation passage configured such that the cooling liquid cooled down by the radiator 24 is fed to the cooling roller 22, drained after traveling inside the cooling roller 22, then fed to the tank 26 and the pump 25, and returned to the radiator 24 again as indicated by an arrow of the liquid feed tube 27. The cooling liquid is circulated by rotation pressure of the pump 25, and heat radiation is performed by the radiator 24, so that the cooling liquid, that is, the cooling roller 22 is cooled down. Power of the pump 25 or the size of the radiator 24 is selected based on a flow quantity, pressure, and cooling efficiency which are determined according to a heat design condition (a condition of a heat quantity and a temperature that should be cooled down by the cooling roller 22).

An image forming process will be explained in connection with the first image station 4Y. The image forming process is based on a general, electrostatic recording technique. Light exposure is performed by the optical writing unit 12Y in the dark to form an electrostatic latent image on the photoreceptor 11Y uniformly charged by the charging unit 10Y. The electrostatic latent image is converted to a toner image that is a visible image by the developing device 13Y. The toner image is transferred from the photoreceptor 11Y to the intermediate transfer belt 1 by the primary transfer roller 15Y. After transfer, a surface of the photoreceptor 11Y is cleaned by the cleaning unit 14. The other image stations 4 have the same configuration as the first image station 4Y and perform the same image forming process.

The developing devices 13 in the image stations 4Y, 4C, 4M, and 4Bk have functions of forming visible images by toners of four different colors. If the image stations 4Y, 4C, 4M, and 4Bk are assigned yellow, cyan, magenta, and black, respectively, it is possible to form a full color image. Therefore, while a same image formation area of the intermediate transfer belt 1 passes through the four image stations 4Y, 4C, 4M, and 4Bk in order, the primary transfer roller 15 arranged opposite to each photoreceptor 11 with the intermediate transfer belt 1 arranged therebetween applies transfer bias, so that each image station causes the toner image of one color to be superposed and transferred onto the intermediate transfer belt 1. Therefore, at a point in time when the same image formation area passed through the image stations 4Y, 4C, 4M, and 4Bk once, a full color toner image can be formed on the same image area by the superposed transfer.

The full color toner image formed on the intermediate transfer belt 1 is transferred onto the paper P. After the transfer, the intermediate transfer belt 1 is cleaned by the cleaning unit 9. The transfer onto the paper P is performed by, at the time of transfer, applying a transfer bias from the roller 5 to the secondary transfer roller 6 through the intermediate transfer belt 1 and passing the paper P through a nip section between the secondary transfer roller 6 and the intermediate transfer belt 1. After the transfer onto the paper P, the full color image supported on the paper P is fixed by the heat fixing unit 16, so that a final full color image is formed on the paper P, and then the paper P is stacked on the discharge paper receiving unit 17.

In the image forming device of the present embodiment, before the paper P is stacked on the discharge paper receiving unit 17, the paper P passes through the cooling device 18 disposed directly behind the heat fixing unit 16. At this time, the paper P heated by the heat fixing unit 16 passes through while contacting the cooling roller 22 that is the heat receiving unit. The surface of the cooling roller 22 absorbs heat from the paper P and transfers the heat to the cooling liquid inside the cooling roller 22. The cooling liquid that became a high temperature by the transferred heat is thereafter drained from the cooling roller 22 and fed to the radiator 24 having the cooling fan 23 mounted therein via the tank 26 and the pump 25. The heat is exhausted to the outside of the image forming device. The cooling liquid whose temperature has dropped down to nearly room temperature since the heat is dissipated by the radiator 24 is thereafter fed to the cooling roller 22 again. The paper P that was heated by the heat fixing unit 16 to have a high temperature is efficiently cooled down by the heat exhaust cycle of a high cooling performance using the cooling liquid. Therefore, at a point in time when the paper P is stacked on the discharge paper receiving unit 17, the toner on the paper P can be hardened with high degree of certainty. Particularly, it is possible to avoid the blocking phenomenon that was a big problem at the time of two-sided image formation output.

In addition, cooling by the cooling liquid does not require a large space as in the conventional art but can perform local cooling with high efficiency, thereby contributing to reducing the size of the image forming device. Further, the cooling roller 22 of the present invention uses a duplex rotary joint in which feeding and draining of the cooling liquid can be performed by a common (a single) rotary joint. Thus, when the rotary joint is installed only at a longitudinal direction one side of the cooling roller 22, compared to the configuration in which the rotary joints are installed at both longitudinal direction sides of the cooling roller 22, the space inside the image forming device can be saved.

Further, the outer tube 22*a*, the inner tube 22*b*, and the rotary joint 35 of the cooling roller 22 of the present invention are fixedly or rotatably supported to each other in a fitting relationship, and both ends of the inner tube 22*b* are supported. Thus, axis alignment among the three components is performed with high degree of certainty, so that the high coaxiality accuracy can be realized. As a result, rattling or rotational vibration caused by axis misalignment among the three components of the outer tube, the inner tube, and the rotary joint that was a problem in the conventional art is prevented, and the rotation accuracy and durability of the cooling roller 22 are improved. Thus, it is possible to avoid a risk of a leak caused by vibration or breakage and reduce the frequency of maintenance or component replacement. When the rotation accuracy of the cooling roller 22 is improved, since it is possible to properly transport the paper P, a high quality image can be obtained, and a jam or a skew caused by faulty rotation of the cooling roller 22 can be reduced. Therefore, when a high-speed image forming process of 100 or more pieces of A4-size papers per minute is continuously performed for a long time (for example, during several days), since a risk of a leak of the cooling liquid from the cooling roller 22 can be avoided, the image forming process can be continuously performed without interruption.

Here, the higher the cooling performance is, the more preferable, but it is difficult to say so categorically. Depending on a requirement specification of the image forming device, for example, in the case of a low-speed image forming device, the cooling performance is too high and is likely to have an over specification, leading to the high cost. Thus, in the case of the image forming device in which the requirement specification of the cooling performance is low, the cooling roller in which the cooling performance is not too high and the number of components is small (low cost) as in the embodiment 1 may be used, whereas in the case of the image forming device requiring the high cooling performance, the cooling roller of high efficiency as in the embodiment 2 may be used. That is, it is preferable to select a cooling roller configuration suitable for the requirement specification.

As described above, according to the embodiment 1-1, the cooling device 18 has a dual tube structure in which the inner tube 22*b* is disposed inside the outer tube 22*a* composed of the outer tube barrel section 22*z*, the flange 22*c*, and the flange 22*d*, and the outside flow passage that allows the cooling liquid to flow through between the outer tube 22*a* and the inner tube 22*b* and the inside flow passage that allows the cooling liquid to flow inside the inner tube 122*b* are formed, includes the opening hole 22*k* as an opening that is formed to allow the outside flow passage to communicate with the inside flow passage, the cooling roller 22 that is rotatable to the bracket 34 as the housing of the device main body through the bearing 41, the pump 25 as the cooling medium transport unit that transports the cooling liquid, and the rotary joint 35 as the rotating tube joint unit that is mounted to one end side of the cooling roller in a state in which the cooling roller 22 is rotatable and connects the cooling roller 22 with the pump through the tube, and enables the cooling roller 22 to contact the paper P as the sheet-like member to cool down the paper P. One end side of the outer tube 22*a* is coaxially fitted into and rotatably mounted to the fitting section 35*c* as a first fitting section of the rotary joint 35. One end side of the inner tube 22*b* is coaxially fitted into and fixedly or rotatably supported to the fitting section as a second fitting section of the rotary joint 35, and the other end side thereof is coaxially fitted into and fixedly or rotatably supported to the fitting section 22*i* disposed at the other end side of the outer tube 22*a*. Thus, in the present embodiment, since both ends of the inner tube 22*b* are supported by the rotary joint 35 and the outer tube 22*a*, compared to the case where only one side of the inner tube 22*b* is supported, the inner tube 22*b* is further prevented from vibrating due to the flow of the cooling liquid. Therefore, it is possible to reduce vibration transmitted from the inner tube 22*b* to the rotary joint 35. Further, since the outer tube 22*a* and the rotary joint 35 are mounted in a fitting relationship of being capable of preventing rattling more than screw coupling, axis misalignment between the outer tube 22*a* and the rotary joint 35 is prevented, thereby reducing vibration generated in the rotary joint 35. Further, since one end side of the inner tube 22*b* and the rotary joint 35 are mounted in a fitting relationship, and the three components of the inner tube 22*b*, the outer tube 22*a*, and the rotary joint 35 are mounted in a fitting relationship, axis misalignment among the three components of the inner tube 22*b*, the outer tube 22*a*, and the rotary joint 35 can be prevented. Therefore, it is possible to reduce vibration of the rotary joint 35 generated due to eccentricity when the outer tube 22*a* rotates.

Further, according to the embodiment 1-1, one end side of both ends of the inner tube 22*b* is fixedly supported to the rotary joint 35, and the other end side is rotatably supported to the outer tube 22*a*. Since both ends of the inner tube 22*b* are supported, compared to the case where only one side of the inner tube 22*b* is supported, axis alignment can be performed with the higher degree of accuracy, whereby the cooling roller having the high rotation accuracy can be provided. Since the outer tube 22*a* rotates but the inner tube 22*b* is fixed and does not rotate, the cooling roller of the present embodiment is appropriate to the case of desiring to actively generate the turbulence in the flow (the flow in the axial direction and the rotation direction) of the cooling liquid flowing through the space formed between the outer tube 22*a* and the inner tube 22*b*, and particularly, is effective in the case where the supply flow quantity of the cooling liquid is small or the flow velocity in the space formed between the outer tube 22*a* and the inner tube 22*b* is slow. Therefore, the cooling performance can be improved by generating the turbulence in the flow of the cooling liquid.

Further, according to the embodiment 1-1, one end side of both ends of the inner tube 22*b* is rotatably supported to the rotary joint 35, and the other end side is fixedly supported to the outer tube 22*a*. Since both ends of the inner tube 22*b* are supported, compared to the case where only one side of the inner tube 22*b* is supported, axis alignment can be performed with the higher degree of accuracy, whereby the cooling roller having the high rotation accuracy can be provided. Since the outer tube 22*a* rotates but the inner tube 22*b* is fixed and does not rotate, the cooling roller of the present embodiment is appropriate to the case of desiring to make smooth the flow (the flow in the axial direction and the rotation direction) of the cooling liquid flowing through the space formed between the outer tube 22*a* and the inner tube 22*b*, and particularly, is effective in the case where the supply flow quantity of the cooling liquid is abundant or the flow velocity in the space formed between the outer tube 22*a* and the inner tube 22*b* is fast. Therefore, the cooling performance can be improved by making smooth the flow of the cooling liquid.

Further, according to the embodiment 1-1, the inner tube 22*b* and the outer tube 22*a* of the cooling roller 22 are assembled with reference to the rotary joint 35 and can be mounted or detached, respectively. One end sides of both sides of both the inner tube 22*b* and the outer tube 22*a* are mounted to the rotary joint 35 with reference to the fitting section disposed in the rotary joint 35, and the other end side of the inner tube 22*b* is mounted to the outer tube 22*a* in a fitting relationship. Therefore, since the components can be easily mounted or detached to assemble or disassemble the cooling roller 22, it is possible to respond to reuse, recycling, or component replacement when a failure occurs.

Further, according to the embodiment 1-1, the inner tube 22*b* has a large diameter section and a small diameter section, and thus the flow velocity near the inner wall of the outer tube 22*a* increases, thereby improving the cooling performance.

Further, according to the embodiment 1, the large diameter section and the small diameter section of the inner tube 22*b* can be mounted or detached. Thus, since the components can be easily mounted or detached to assemble or disassemble the cooling roller 22, it is possible to respond to reuse, recycling, or component replacement when a failure occurs.

Further, according to the embodiment 1-2, the cylinder 22*s* is disposed between the outer tube 22*a* and the inner tube 22*b* so that the space is formed between the inner wall of the outer tube 22*a* and the outer wall thereof. The cylinder 22*s* is coaxially fitted into the fitting section of the inner tube 22*b* and rotatably or fixedly supported to the inner tube 22*b*. This makes the flow velocity near the inner wall of the outer tube 22*a* fast, thereby improving the cooling performance. Further, it is possible to reduce vibration caused due to axis misalignment among the four components of the outer tube 22*a*, the inner tube 22*b*, the cylinder 22*s*, and the rotary joint 35.

Further, according to the embodiment 1-2, the cylinder 22*s* is fixedly supported to the inner tube 22*b* in a fitting relationship, one end side of the inner tube 22*b* is fixedly supported to the rotary joint 35, and the other end side thereof is rotatably supported to the outer tube 22*a*. Since both ends of both the inner tube 22*b* and the cylinder 22*s* are supported, compared to the case where only one side of either the inner tube 22*b* or the cylinder 22*s* is supported, axis alignment can be performed with the higher degree of accuracy, whereby the cooling roller having the high rotation accuracy can be provided. Since the outer tube 22*a* rotates but the inner tube 22*b* is fixed and does not rotate, the cooling roller of the present embodiment is appropriate to the case of desiring to actively generate the turbulence in the flow (the flow in the axial direction and the rotation direction) of the cooling liquid flowing through the space formed between the outer tube 22*a* and the cylinder 22*s*, and particularly, is effective in the case where the supply flow quantity of the cooling liquid is small or the flow velocity in the space formed between the outer tube 22*a* and the cylinder 22*s* is slow. Therefore, the cooling performance can be improved by generating the turbulence in the flow of the cooling liquid.

Further, according to the embodiment 1-2, the cylinder 22*s* is engaged with or fixedly support to the inner tube 22*b* in a fitting relationship, one end side of the inner tube 22*b* is rotatably supported to the rotary joint 35, and the other end side thereof is fixedly supported to the outer tube 22*a*. Since both ends of both the inner tube 22*b* and the cylinder 22*s* are supported, compared to the case where only one side of either the inner tube 22*b* or the cylinder 22*s* is supported, axis alignment can be performed with the higher degree of accuracy, whereby the cooling roller having the high rotation accuracy can be provided. The cooling roller of the present embodiment is appropriate to the case of desiring to make smooth the flow (the flow in the axial direction and the rotation direction) of the cooling liquid flowing through the space formed between the outer tube 22*a* and the cylinder 22*s*, and particularly, is effective in the case where the supply flow quantity of the cooling liquid is abundant or the flow velocity in the space formed between the outer tube 22*a* and the cylinder 22*s* is fast. Therefore, the cooling performance can be improved by making smooth the flow of the cooling liquid.

Further, according to the embodiment 1-2, the cylinder 22*s* is engaged with or fixedly supported to the outer tube 22*a* in a fitting relationship, one end side of the inner tube 22*b* is fixedly supported to the rotary joint 35, and the other end side thereof is rotatably supported to the outer tube 22*a* or the cylinder 22*s*. Since both ends of both the inner tube 22*b* and the cylinder 22*s* are supported, compared to the case where only one side of either the inner tube 22*b* or the cylinder 22*s* is supported, axis alignment can be performed with the higher degree of accuracy. Since the inner tube 22*b* is fixed and does not rotate, vibration caused by the inner tube 22*b* can be prevented, and the cooling roller having the high rotation accuracy can be provided.

Further, according to the embodiment 1-2, the inner tube 22*b* and the outer tube 22*a* can be mounted to or detached from the rotary joint 35. Since the components can be easily mounted or detached to assemble or disassemble the cooling roller 22 or the rotary joint 35, it is possible to respond to reuse, recycling, or component replacement when a failure occurs.

Further, according to the embodiment 1-2, the cylinder 22*s* can be mounted to or detached from the inner tube 22*b* or the outer tube 22*a*. Since the components can be easily mounted or detached to assemble or disassemble the cooling roller 22, it is possible to respond to reuse, recycling, or component replacement when a failure occurs.

Further, according to the embodiment 1-2, the agitating unit that agitates the cooing liquid in the space formed between the outer tube 22*a* and the cylinder 22*s* is disposed. Therefore, the cooling efficiency can be improved by actively greatly agitating the flow of the cooling liquid flowing inside the space formed between the outer tube 22*a* and the cylinder 22*s*.

Further, according to each of the embodiments, in the image forming device including the toner image forming unit for forming the toner image on the paper P as the sheet-like member, the heat fixing unit for fixing the toner image formed on the paper P on the paper P by at least heat, and the cooling unit for cooling down the paper P on which the toner image is fixed by the heat fixing unit, the cooling device of the present invention is used as the cooling unit. Since the cooling device 18 having the cooling roller 22 having the cooling performance and the rotation accuracy significantly higher than the conventional art is installed in the image forming device, the image forming device in which the paper cooling effect and the paper transport accuracy are improved and the space is saved can be provided.

Embodiment 2

Embodiment 2-1

Next, an embodiment 2-1 of the present invention will be described.

Figure 31:
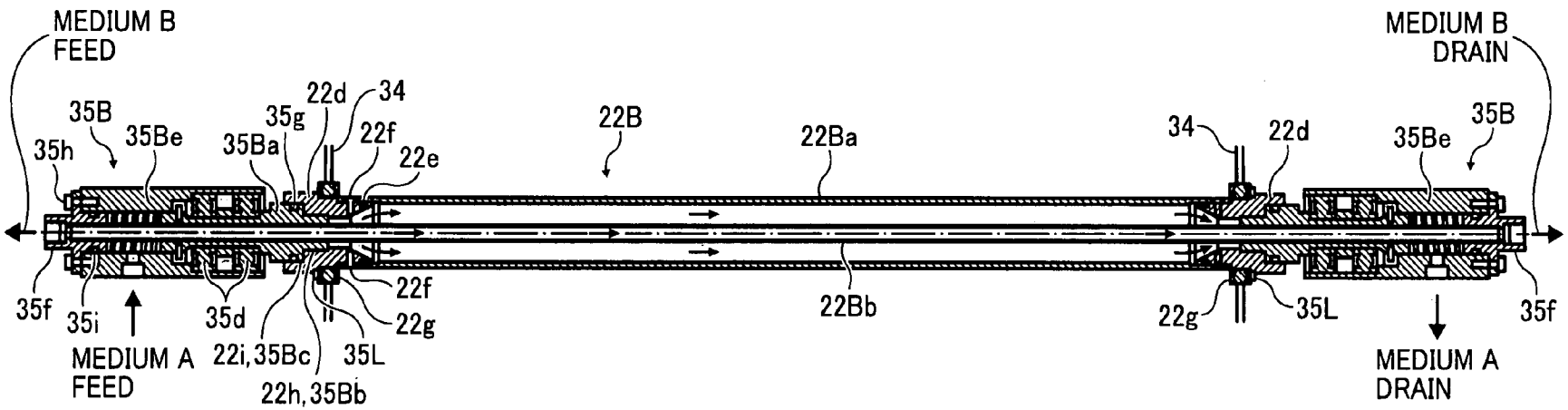
FIG. 31 is a schematic cross-sectional view illustrating a cooling roller in which a duplex rotary joint as a rotating tube joint unit is mounted to both ends according to an embodiment 2-2.
Figure 32:
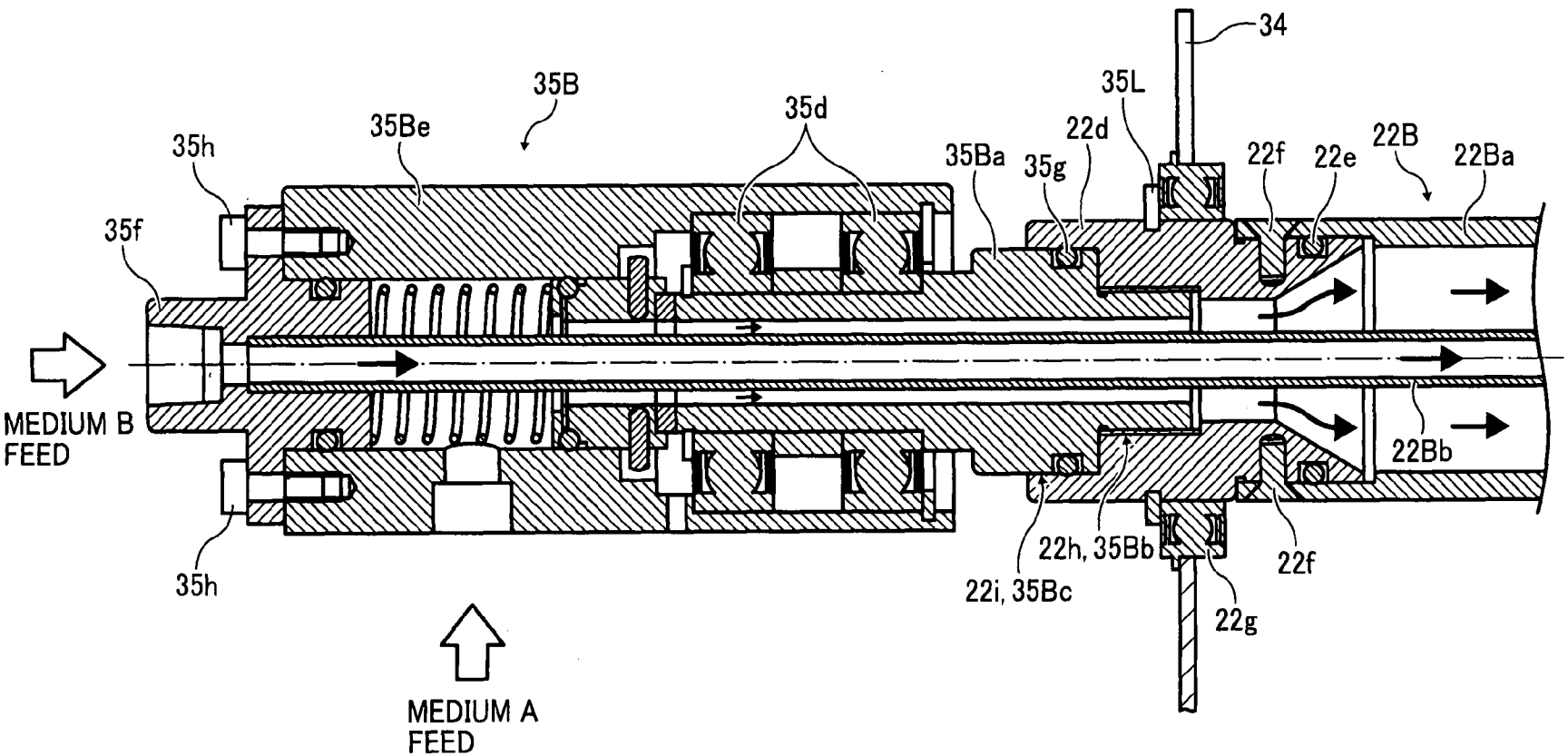
FIG. 32 is an enlarged view illustrating a left end section of the cooling roller according to the embodiment 2-2.
Figure 33:
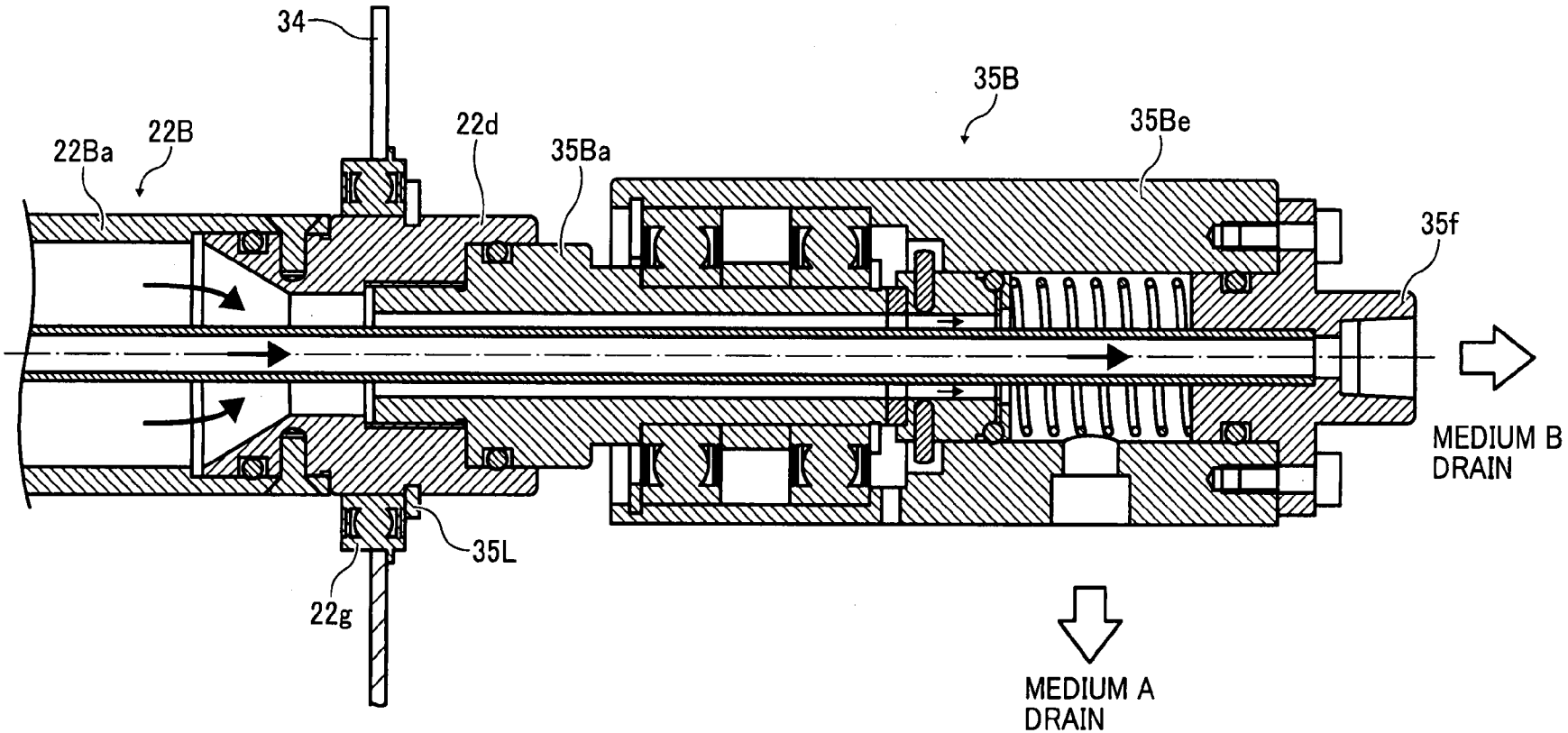
FIG. 33 is an enlarged view illustrating a right end section of the cooling roller according to the embodiment 2-2.

FIG. 31 is a schematic cross-sectional view illustrating a cooling roller 22B of the present invention in which a duplex rotary joint 35B as a rotating tube joint unit is mounted to both ends thereof. FIGS. 32 and 33 are enlarged views illustrating a left end section and a right end section thereof.

As illustrated in FIGS. 31 to 33, the cooling roller 22B has a dual tube structure composed of an outer tube and an inner tube, that is, a dual tube structure of a hollow type composed of an outer tube including a roller outer tube 22Ba and flanges 22*d* mounted to both ends of the roller outer tube 22Ba and an inner tube including a roller inner tube 22Bb. The roller outer tube 22Ba rotates to contact and transport the paper P. The roller outer tube 22Ba and the roller inner tube 22Bb form a one directional flow passage. That is, the cooling roller 22B of the dual tube structure forms two separate one directional flow passages and cools down the cooling liquid flowing inside the roller outer tube 22Ba by the cooling liquid flowing inside the roller inner tube 22Bb, thereby improving the cooling performance more than the cooling roller of the single tube structure.

A configuration of the cooling roller 22B will be described below. The left end section and the right end section of the cooling roller 22B have the same configuration, and a configuration of the cooling roller 22B will be described focusing on the left end section. Thus, detailed designation symbols on the right end section in FIGS. 31 and 33 are omitted.

The roller outer tube 22Ba of the cooling roller 22B has both ends composed of flanges 22*d* to which bearings 22*g* are mounted. An O-ring 22*e* for leakage prevention is inserted into the flange 22*d*, and the flange 22*d* is mounted to the roller outer tube 22Ba by a screw 22*f*. At this time, the flange 22*d* is inserted into and mounted to the roller outer tube 22Ba in a fitting relationship and has coaxiality with the roller outer tube 22Ba. Both ends of the cooling roller 22B are supported rotatably with respect to a bracket 34 of the cooling device 18B using the bearings 22*g* of the flanges 22*d* at both ends.

Further, a coupling section including a parallel screw section 22*h* and a fitting section 22*i* is formed in the flange 22*d*. A rotor 35Ba, which has a parallel screw section 35Bb and a fitting section 35Bc, formed to face the coupling section is mounted to the flange 22*d*. The parallel screw sections are screw-processed in a direction that is tightened against the rotation direction of the roller outer tube 22Ba (the transport direction of the paper P). The rotor 35Ba is a component of the rotary joint 35B and is rotatable. The rotary joint 35 and the flange 22*d* are inserted and mounted in a fitting relationship as described above, and the rotor 35Ba and the flange 22*d* have the coaxiality with each other. The rotor 35Ba is rotatably supported to a casing 35Be of the rotary joint 35B through a fitting relationship with two bearings 35*d* disposed with an interval therebetween. Therefore, the roller outer tube 22Ba is in a state which is coaxial to the casing 135Be of the rotary joint 35B through the rotor 35Ba and the flange 22*d* mounted in the fitting relationship and thus can perform rotation with the high degree of accuracy. Further, an O-ring 35*g* is inserted into the rotor 35Ba to prevent the cooling liquid from leaking from the flange 22*d*.

Subsequently, different types of cooling roller will be described below. These cooling roller have the above-described configuration in common, however, a manner of supporting the roller inner tube 22Bb is different. There are two types: a type 1; and a type 2, and a configuration of each of the two types will be described.

Configuration Example 1

Cooling Roller of the Type 1

The cooling roller of the type 1 is configured such that the roller outer tube 22Ba rotates, and the roller inner tube 22Bb does not rotate.

The cooling roller 22B of the type 1 will be described below. This type has the configuration of the cooling roller 22B illustrated in FIG. 31 and will be described focusing on the left end section of the cooling roller 22B. It is preferable to use the cooling roller 22B of the type 1 when desiring to generate the turbulence in the flow of the cooling liquid flowing through an outside flow passage between the roller outer tube 22Ba and the roller inner tube 22Bb.

As illustrated in FIG. 31, the rotary joints 35B mounted to both ends of the cooling roller 22B fixedly supports one end side of the roller inner tube 22Bb and fitting-supports or fixedly supports the other end thereof, respectively, so that the roller inner tube 22Bb does not rotate. Specifically, the roller inner tube 22Bb is mounted to the rotary joints 35B, for example, such that the roller inner tube 22Bb is fixedly supported to one rotary joint 35B by press-fitting into the flange 35*f* mounted to the casing 35Be, and is supported to or fixed to the other rotary joint 35B by or after fitting and inserting into the flange 35*f*. Since the casing 35Be, the flange 35*f*, and the roller inner tube 22Bb are mounted by inserting or press-fitting into each other in a fitting relationship, the roller inner tube 22Bb has the coaxiality with the casing 35Be. An O-ring 35*i* for leakage prevention is inserted into the flange 35*f*, and the flange 35*f* is fitted and inserted into and fixed to the casing 35Be by a screw 35*h*.

By the above-described configuration, at both ends of the cooling roller 22B, the roller outer tube 22Ba and the roller inner tube 22Bb have the coaxiality with reference to the rotary joint 35B (the casing 35Be). With respect to the rotary joint 35B (the casing 35Be), in a fitting relationship, the roller outer tube 22Ba is rotatably supported, and the roller inner tube 22Bb is supported not to rotate.

A flow passage of the cooling liquid is indicated by an arrow. A cooling liquid of a medium A and a cooling liquid of a medium B are fed from feed ports of the rotary joint 35B, at a lower side in the drawing, which leads to the inside of the roller outer tube 22Ba and the inside of the roller inner tube 22Bb respectively. The cooling liquid of the medium A passes through a narrow space between the roller inner tube 22Bb and the rotor 35Ba, flows through a wide space formed between the roller outer tube 22Ba and the roller inner tube 22Bb in an axial direction, forms a one directional flow passage, and is drained from the rotary joint 35B at an opposite side. The cooling liquid of the medium B is fed from the rotary joint 35 at a lower side in the drawing, flows through the inside of the roller inner tube 22Bb up to the rotary joint 35B at the opposite side, forms another one directional flow passage, and is drained. The cooling roller 22B of the dual tube structure has the two one directional flow passages as described above and forms a closed-loop flow passage together with a cooling liquid circulating unit through the rotary joints 35B at both ends to thereby circulate the cooling liquid of the medium A and the cooling liquid of the medium B.

The cooling liquid of the medium A and the cooling liquid of the medium B flow through the inside of the roller outer tube 22Ba and the inside of the roller inner tube 22Bb, respectively, to prevent the surface temperature of the roller outer tube 22Ba from being raised. Accordingly, the cooling performance of the cooling roller can be increased.

Further, the components of the cooling roller 22B can be mounted or detached so that it is possible to respond to reuse, recycling, or component replacement when a failure occurs.

Figure 34:
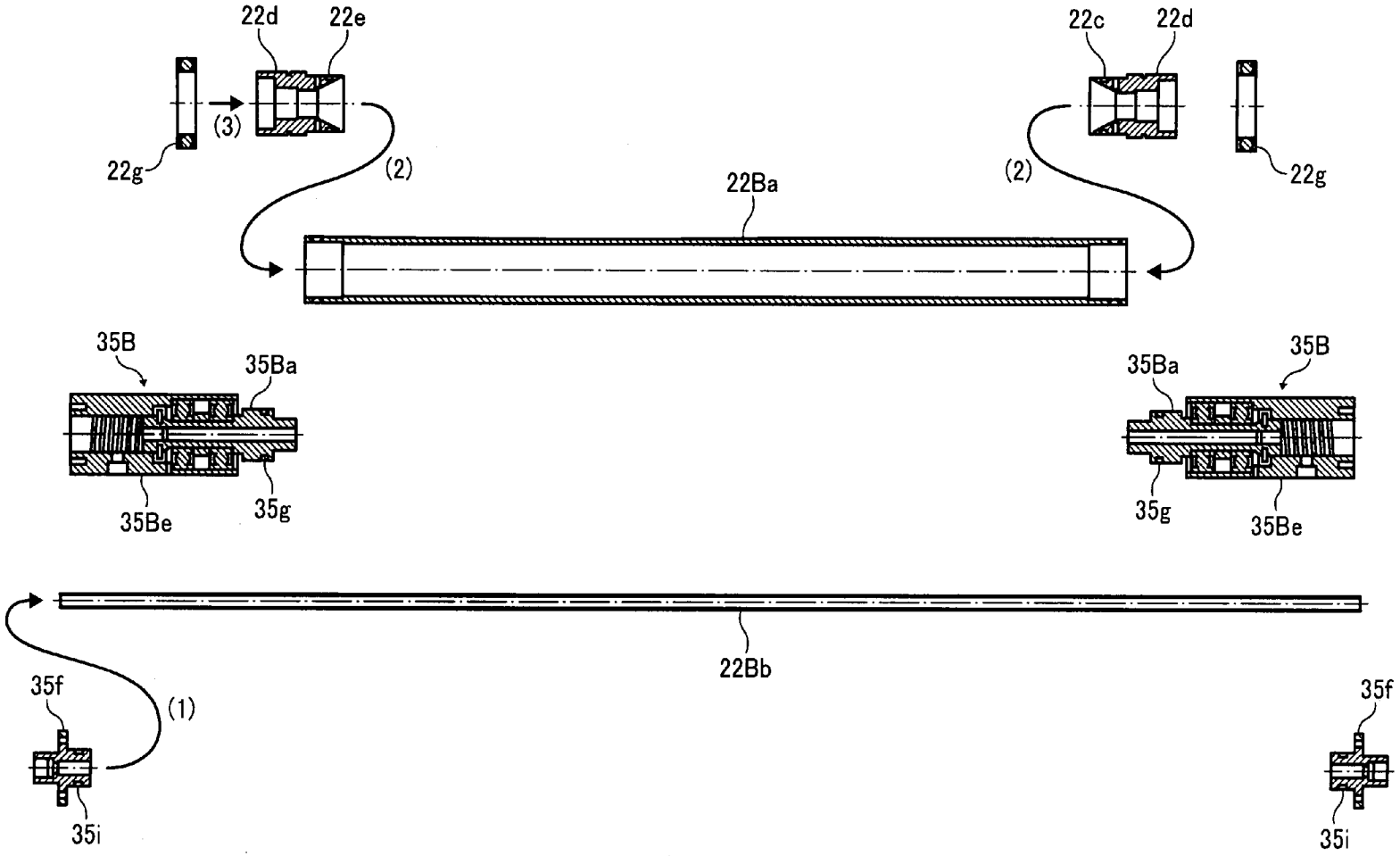
FIG. 34 is an explanation view used for explaining the assembly of the cooling roller according to the embodiment 2-2.

FIG. 34 illustrates the components of the cooling roller 22B, that is, the roller outer tube 22Ba, the roller inner tube 22Bb, the flange 22*d*, and the rotary joint 35B, which are arranged in line. Particularly, FIG. 34 illustrates a state before the cooling roller 22B is assembled and the rotary joint 35B is mounted. In FIG. 34, an O-ring 22*e* is in a state combined with the flange 22*d*, but, of course, the components can be mounted or detached in units of components. The rotary joint 35 can be also mounted to or detached from the cooling roller 22B, so that the rotary joint 35 can be replaced.

The cooling roller 22B is configured so that assembly or disassembly (attachment or detachment of a component) can be easily performed. An assembly procedure will be described. At the same time, a mounting procedure of the cooling device 18B will be described (see procedure arrow numbers in the drawings)

First, one end side of the roller inner tube 22Bb is press-fitted into and fixedly supported to the flange 35*f* removed from the casing 35Be of the rotary joint 35B (procedure 1). Next, the flange 22*d* is fitted and inserted into and fixed to the roller outer tube 22Ba by a screw 22*f* (not shown) (procedure 2). The bearing 22*g* is fitted and inserted into and mounted to the flange 22*d*, and is slidable in an axial direction without rattling (procedure 3). The work procedure of the procedure 1 and the procedure 2 may be reversed.

Figure 35:
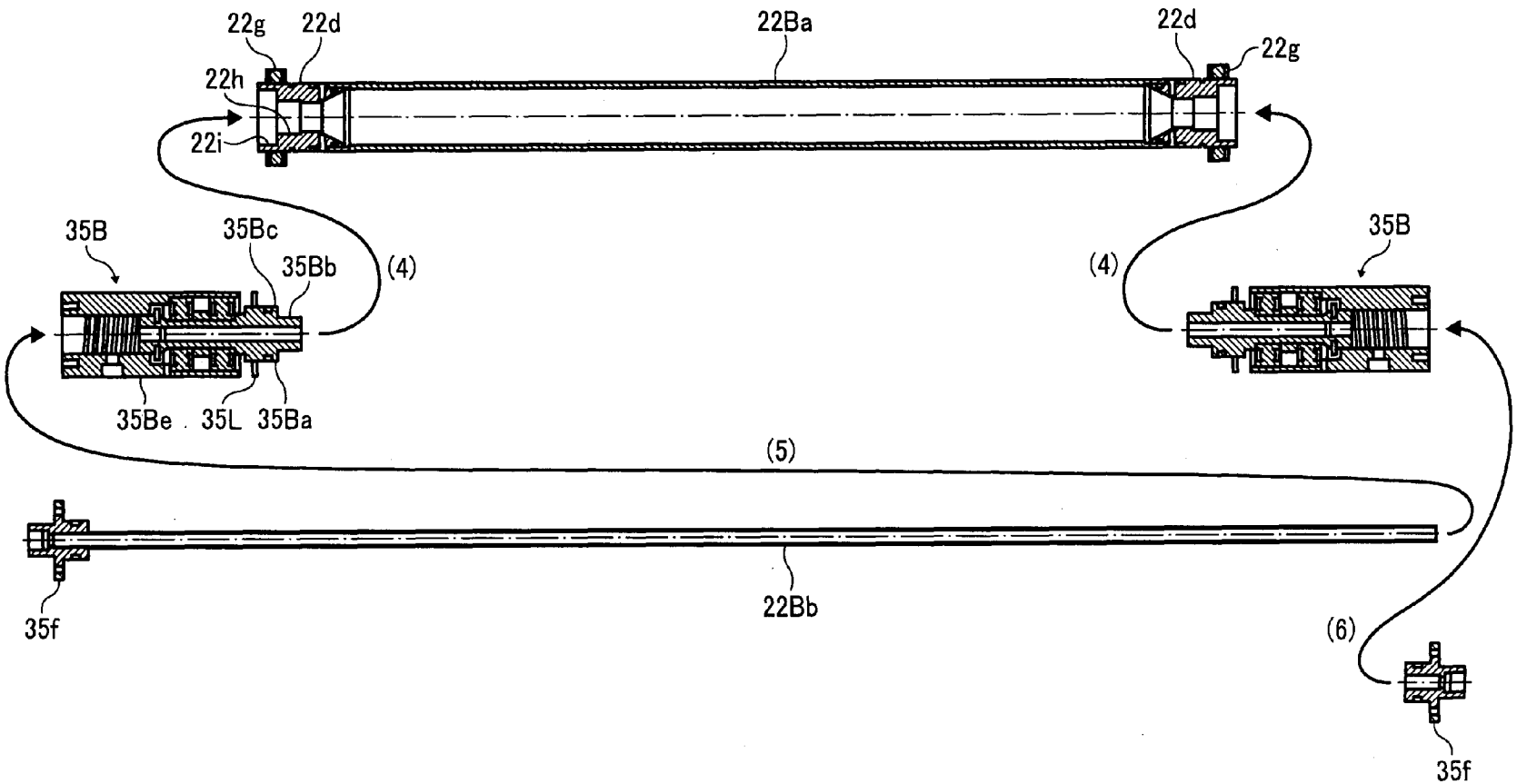
FIG. 35 is an explanation view used for explaining the assembly of the cooling roller according to the embodiment 2-2.

FIG. 35 illustrates a state after the works of the procedures 1 to 3 are performed.

Figure 36:
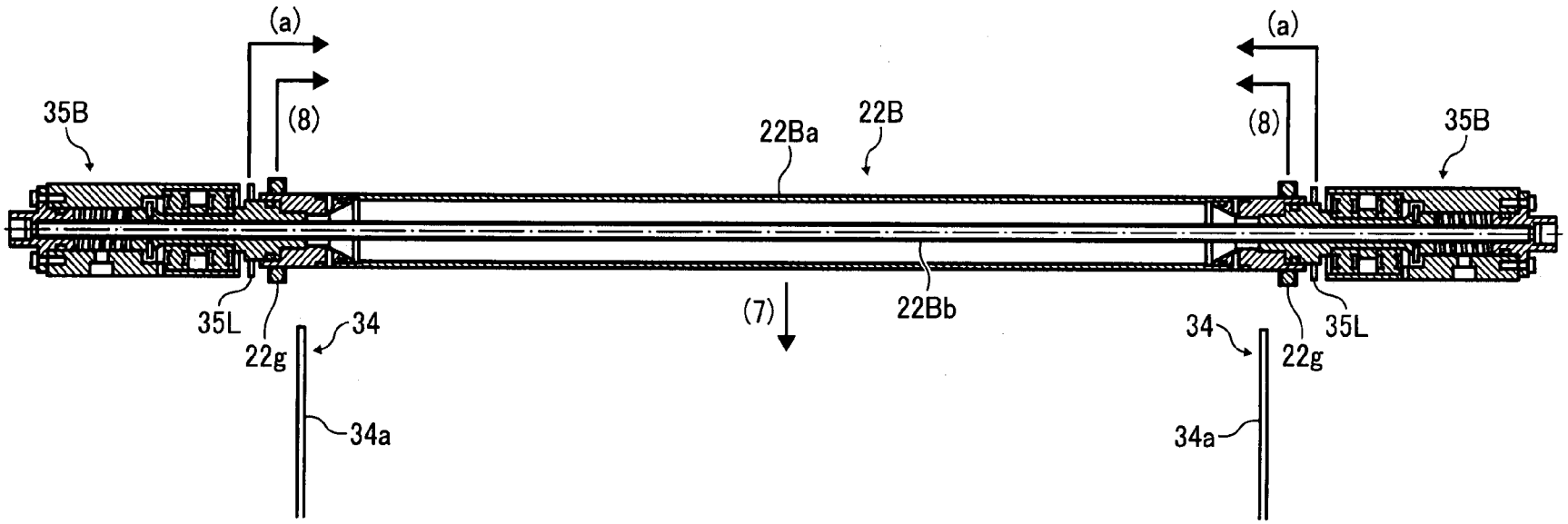
FIG. 36 is an explanation view used for explaining the assembly of the cooling roller according to the embodiment 2-2.

After the procedure 3, a C-shaped retaining ring 35L, which will fix a position of the bearing 22*g* in a later process, is first put in the rotor 35Ba of the rotary joint 35B (the C-shaped retaining ring 35L may be put in at the flange 22*d* side). The flange 22*d* of the roller outer tube 22Ba and the rotor 35Ba are fitted and inserted into each other (fitted into each other through a fitting section 22*i* and a fitting section 35Bc) and fixed by a parallel screw section (screw-coupled by a parallel screw section 22*h* and a parallel screw section 35Bb) (procedure 4). Thereafter, the roller inner tube 22Bb to which the flange 35*f* is mounted is inserted, starting from a rear opening section of the casing 35Be at a lower side in the drawing, to penetrate the insides of the rotor 35Ba and the roller outer tube 22Ba at the lower side in the drawing and the inside of the rotor 35Ba at an upper side in the drawing. The roller inner tube 22Bb is inserted until the flange 35*f* contacts the rear end section of the casing 35Be at the lower side in the drawing, and the flange 35*f* is fitted into and fixed to the casing (barrel section) 35Be by the screw 35*h* (not shown) (procedure 5). Finally, the flange 35*f* is fitted and inserted into the rear end opening section of the casing 35Be of the rotary joint 35B at the upper side in the drawing and fixed by the screw 35*h* (not shown) (procedure 6). At this time, a right end of the roller inner tube 22Bb is fitted and inserted into and supported to or fixed to the flange 35*f*. Accordingly, the assembly of the cooling roller 22B and mounting of the rotary joint 35B are completed as illustrated in FIG. 36. The disassembly of the cooling roller 22 or the rotary joint 35B is performed by performing the above-described works reversely to the above-described work procedure. Thus, the components of the cooling roller 22 can be mounted or detached, and the rotary joint 35 can be mounted or detached in units of components.

The cooling roller 22B in which the rotary joints 35B are mounted to both ends thereof is mounted to the cooling device 18B such that the cooling roller 22B is inserted into a notched opening 34*a* formed in a bracket 34 of the cooling device 18B (procedure 7) up to a set position as illustrated in FIG. 36. The bearing 22*g* positioned outside the bracket 34 slides until bumping into the bracket 34 (procedure 8). Finally, a position of the bearing 22*g* is fixed by the C-shaped retaining ring 35L such that the bearing 22*g* would not be removed (procedure 9). Accordingly, mounting of the cooling roller 22B to the cooling device 18B is completed as illustrated in FIG. 31, and both ends of the cooling roller 22B are rotatably supported to the bracket 34.

As described above, when attachment or detachment between the rotor 35Ba and the flange 22*d*, between the roller outer tube 22Ba and the flange 22*d*, between the roller inner tube 22Bb and the flange 35*f*, and the casing 35Be and the flange 35*f* is performed only by the screw coupling method, the cooling roller 22B has axis misalignment.

If axis misalignment happens, the rotary joint 35B vibrates due to eccentricity when the outer tube rotates. If the rotary joint vibrates, a load is applied to the coupling section between the cooling roller 22B and the rotary joint 35B, leading to a problem in that durability is lowered, and the cooling liquid leaks from the coupling section. Further, the vibration of the rotary joint 35 is transmitted to the roller outer tube 22Ba, and thus there occurs a problem in that the rotation accuracy of the roller outer tube 22Ba is lowered, and it is difficult to properly transport the paper through the cooling roller 22B. For this reason, in the configuration example 1, the coupling section should have a fitting section for axis alignment that can further prevent rattling compared to the screw coupling.

Configuration Example 2

Cooling Roller of the Type 2

The cooling roller of the type 2 is configured such that the roller outer tube 22Ba rotates, and the roller inner tube 22Bb rotates together with the roller outer tube 22Ba.

Figure 37:
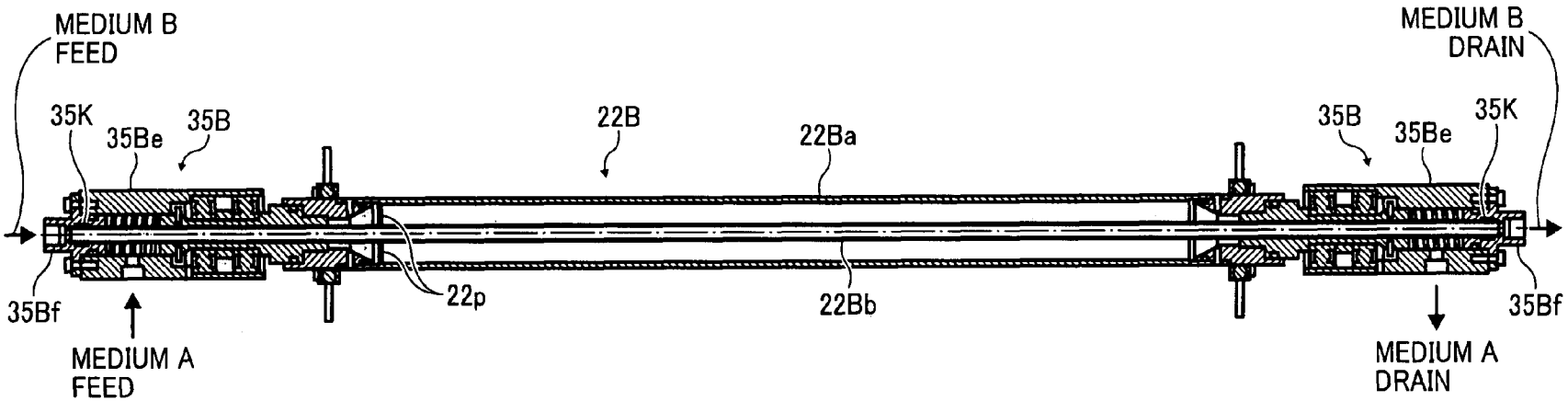
FIG. 37 is a schematic cross-sectional view illustrating a cooling roller in which a duplex rotary joint as a rotating tube joint unit is mounted to both ends according to the embodiment 2-2.
Figure 38:
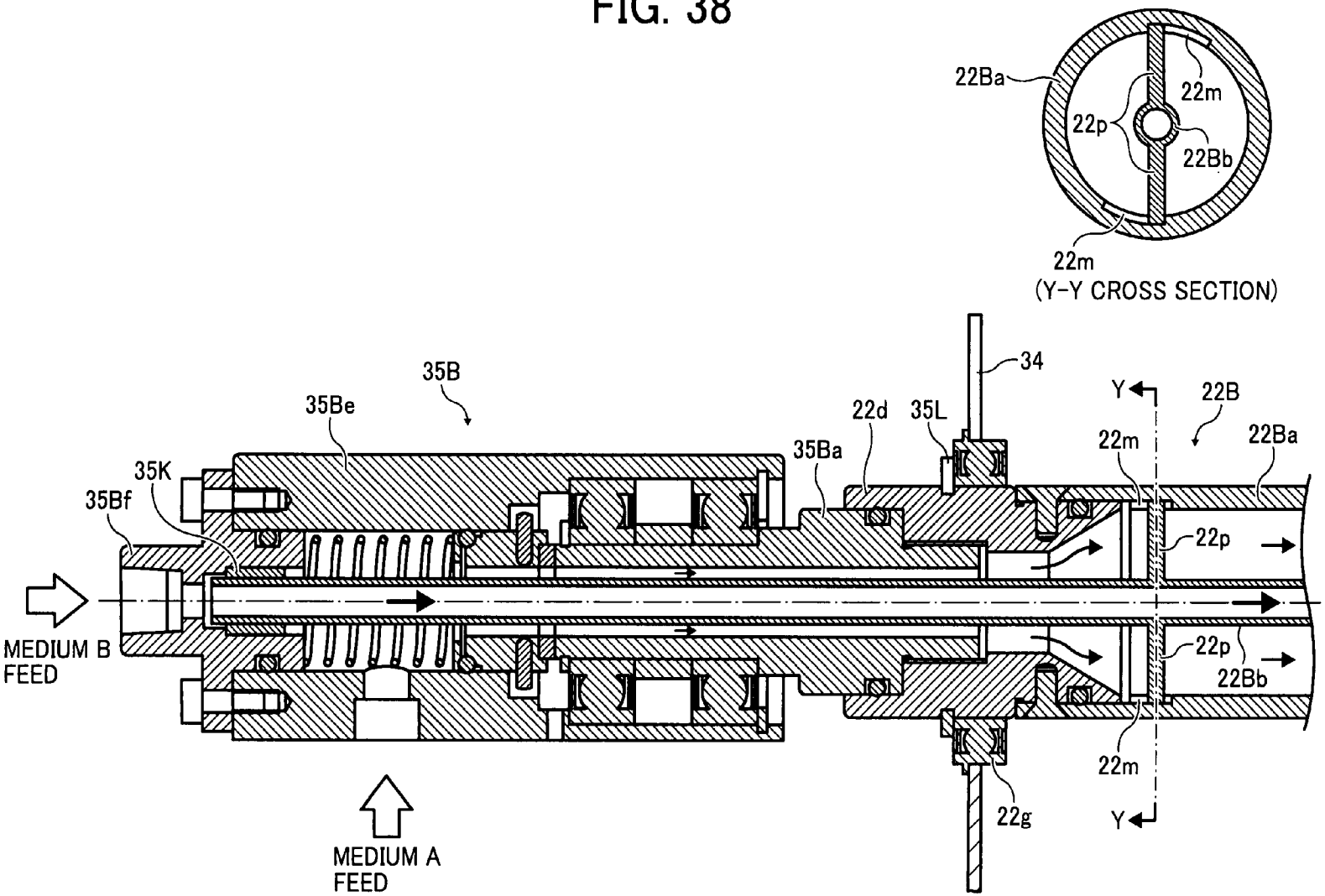
FIG. 38 is an enlarged view illustrating a left end section of the cooling roller of FIG. 37.
Figure 39:
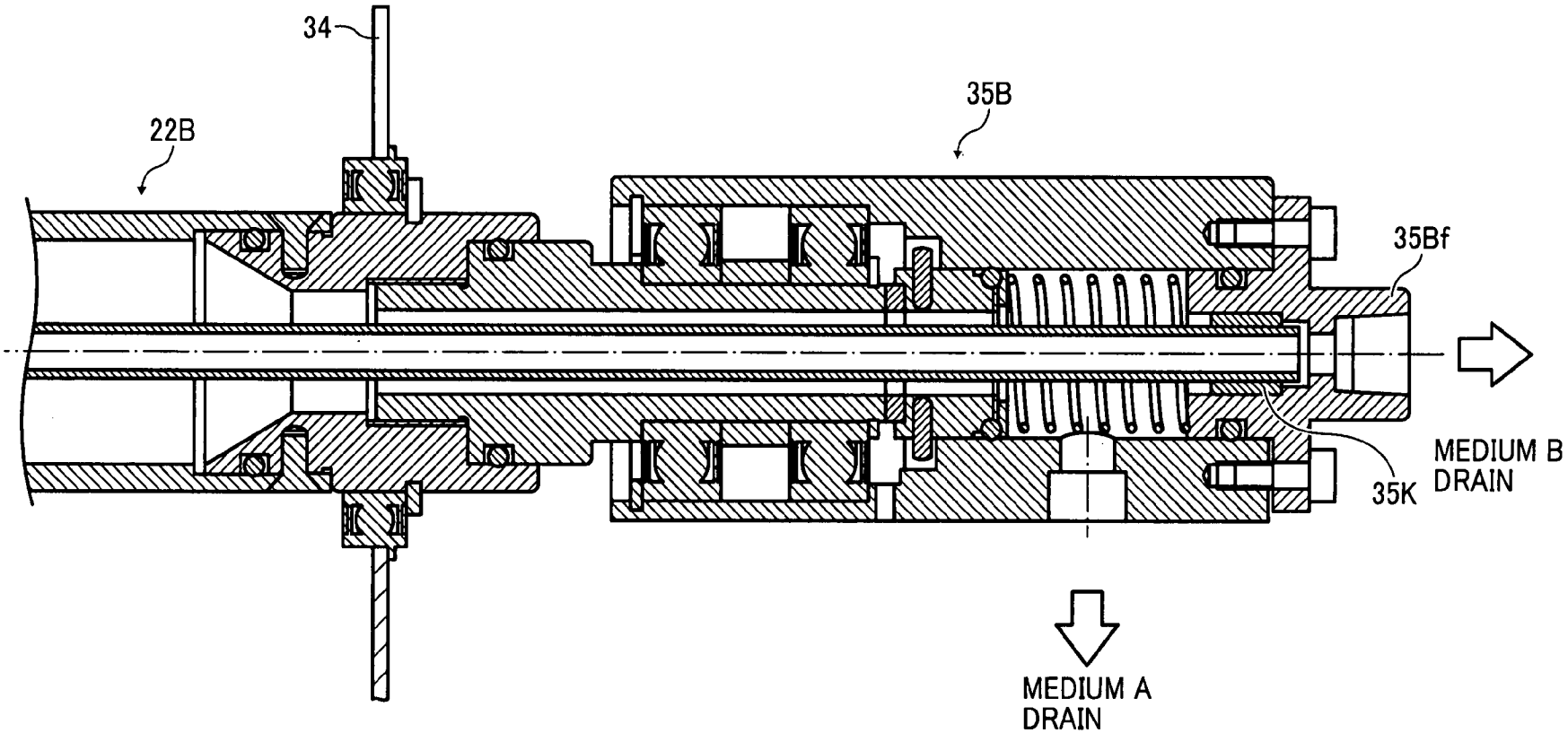
FIG. 39 is an enlarged view illustrating a right end section of the cooling roller of FIG. 37.

The cooling roller 22B of the type 2 will be described below with reference to FIG. 37 and FIGS. 38 and 39 which are enlarged views of a left end section and a right end section thereof. Particularly, the cooling roller 22B of the type 2 will be described focusing on the left end section, and thus detailed designation symbols on the right section of FIG. 37 and FIG. 39 are omitted. It is preferable to use the cooling roller 22B of the type 2 when desiring to make smooth the one directional flow (the flow in the axial direction and the rotation direction) of the cooling liquid flowing through the outside flow passage between the roller outer tube 22Ba and the roller inner tube 22Bb.

An idea of performing axis alignment through a support method based on a fitting relationship is the same as in the cooling roller of the type 1. Unlike the cooling roller of the type 1, as illustrated in FIG. 37, both ends of the roller inner tube 22Bb are mounted to a flange 35Bf of the casing 35Be of the rotary joint 35B through the bearing 35*k* and rotatably supported so that the roller inner tube 22Bb can rotate. Thus, the roller inner tube 22Bb is supported to rotate together with the roller outer tube 22Ba with respect to the rotary joints 35B (the casings 35*e*) at both ends thereof. The roller inner tube 22Bb rotates such that rotational force of the roller outer tube 22Ba is transmitted to the roller inner tube 22Bb through, for example, an engagement unit, so that the roller inner tube 22Bb rotates together with the roller outer tube 22Ba. The roller inner tube 22Bb rotates, for example, following the rotation of the roller outer tube 22Ba using an engagement unit including the engagement pin 22*p* of the roller inner tube 22Bb and the engagement groove 22*m* of the roller outer tube 22Ba such that an engagement pin 22*p* is engaged with an engagement groove 22*m*, as illustrated in a Y-Y cross-sectional view of FIG. 38. The flow passages of the cooling liquid of the medium A and the cooling liquid of the medium B that flow through the inside of the cooling roller 22B in one direction are the same as in the type 1, and thus description thereof is omitted.

Further, the components of the cooling roller 22B of the type 2 and the rotary joint 35 can be also mounted or detached.

Figure 40:
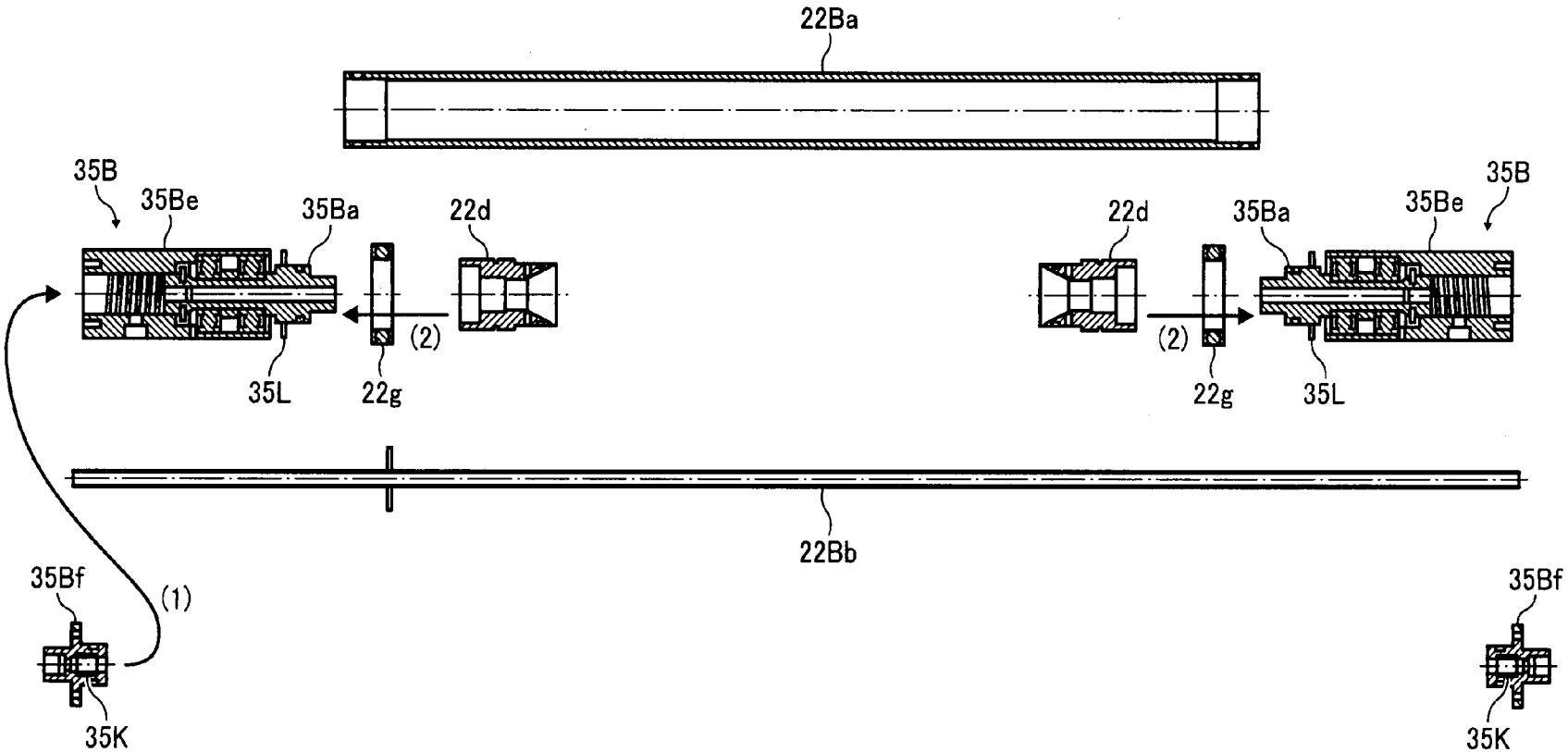
FIG. 40 is an explanation view used for explaining the assembly of the cooling roller according to the embodiment 2-2.
Figure 41:
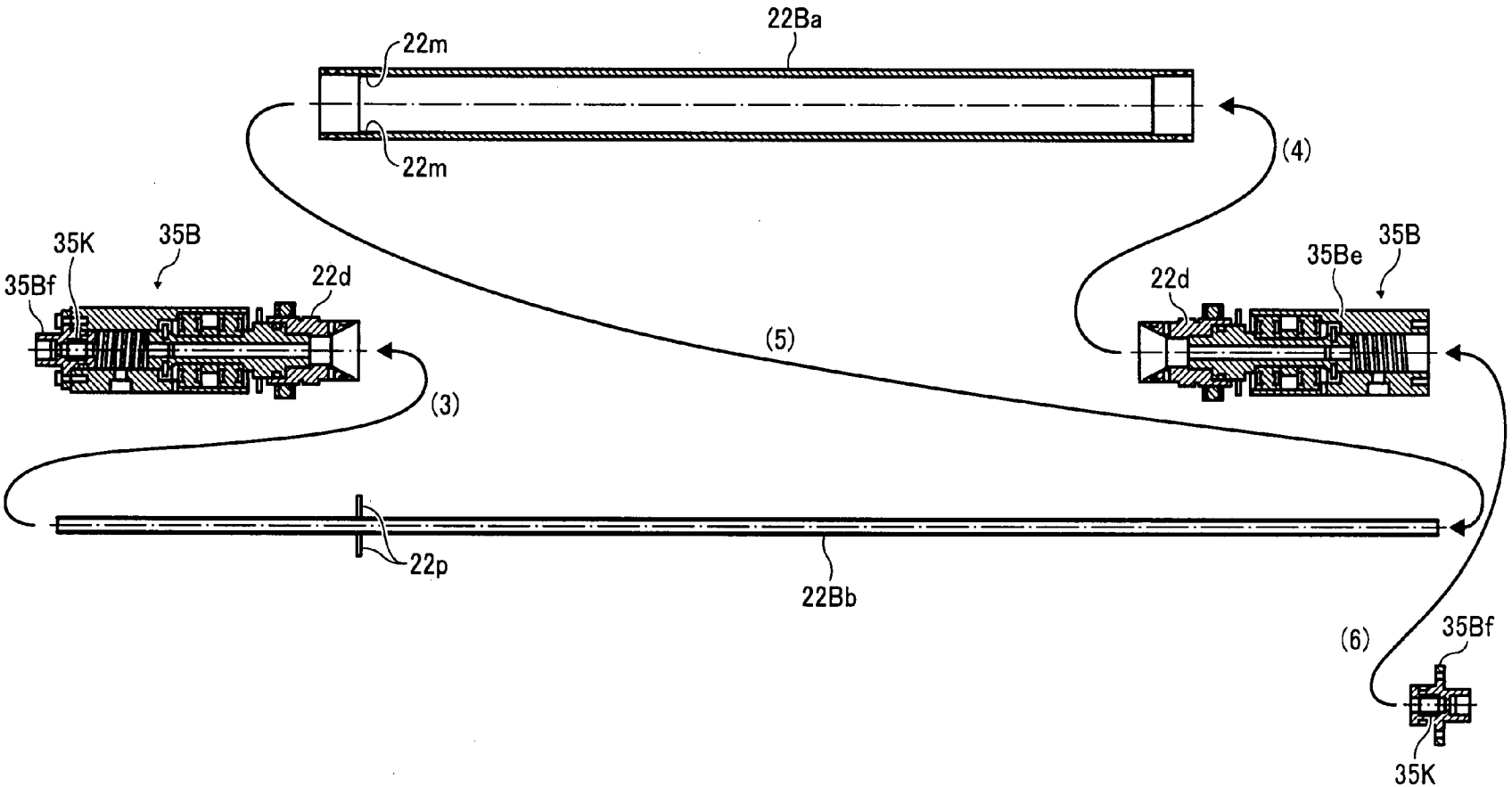
FIG. 41 is an explanation view used for explaining the assembly of the cooling roller according to the embodiment 2-2.
Figure 42:
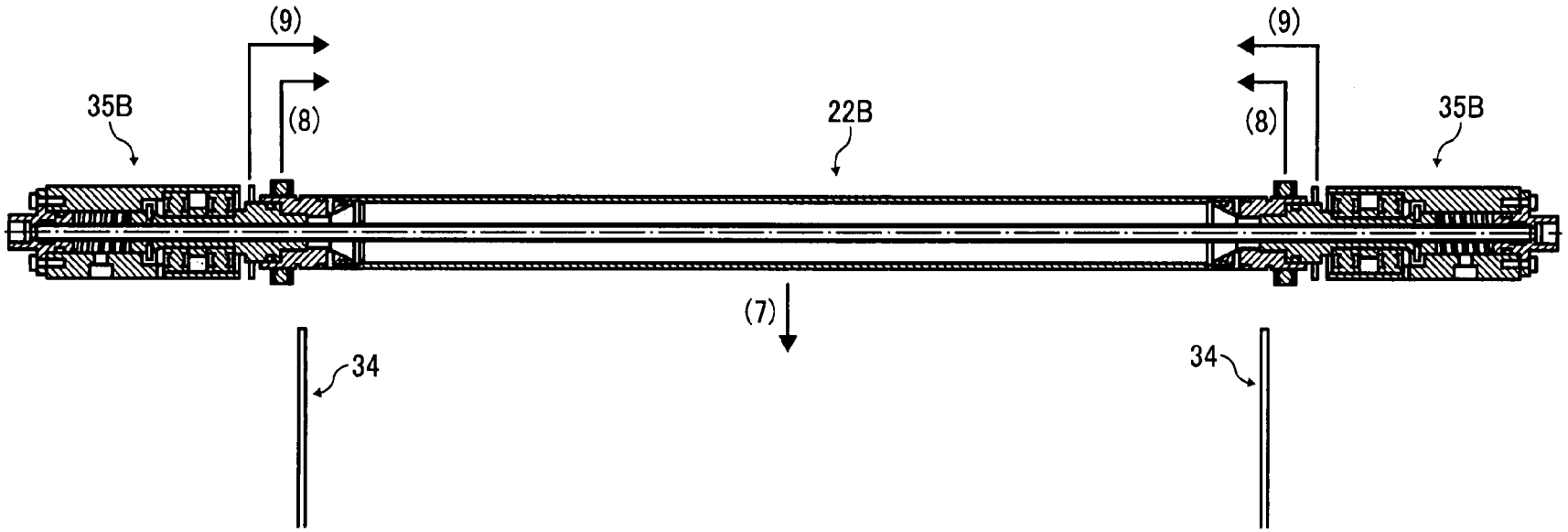
FIG. 42 is an explanation view used for explaining the assembly of the cooling roller according to the embodiment 2-2.

An assembly procedure of the cooling roller 22B and a mounting procedure of the cooling roller 22B to the cooling device 18B are illustrated in FIGS. 40 to 42 (see procedure arrow numbers in the drawings).

First, as illustrated in FIG. 40, the flange 35Bf, inside of which the bearing 35*k* is fixedly installed, is fitted and inserted into only the casing 35Be of the rotary joint 35B at one side (for example, a lower side in the drawing) and fixed by the screw 35*h* (not shown) (procedure 1). Next, the flanges 22*d* are fitted and inserted, while passing through the bearing 22*g*, and fixed to the rotors 35Ba of the rotary joints 35B, at both sides, in which the C-shaped retaining ring 35L is temporarily put (procedure 2).

FIG. 41 illustrates a state after the procedure 1 and the procedure 2 are performed. After the procedure 2, the roller inner tube 22Bb is inserted into the rotary joint 35B at the lower side in the drawing, and a front end thereof is fitted and inserted into the bearing 35*k* of the flange 35Bf (procedure 3). Next, the rotary joint 35B at the other side is mounted to and fixed to the roller outer tube 22Ba through a fitting relationship with the flange 22*d* (procedure 4). At this time, the roller outer tube 22Ba is mounted, starting from a free end side of the roller inner tube 22Bb, to cover the roller inner tube 22Bb. When the free end passes through the rotary joint 35B at the upper side in the drawing, the rotary joint 35B at the lower side in the drawing and the roller outer tube 22Ba are mounted in a fitting relationship through the flange 22*d* and fixed (procedure 5). Since the engagement pin 22*p* and the engagement groove 22*m* are formed at the roller inner tube 22Bb and the roller outer tube 22Ba, respectively, when mounting the roller outer tube 22Ba to cover the roller inner tube 22Bb, as the engagement unit that enables the roller inner tube 22Bb to rotate together with the roller outer tube 22Ba, the engagement pin 22*p* is engaged with the engagement groove 22*m* to make the accompanying rotation relationship. The accompanying rotation relationship is illustrated in the Y-Y cross-sectional view of FIG. 38. Finally, the free end side of the roller inner tube 22Bb (the upper side in the drawing) is fitted and inserted into the bearing 35*k* of the flange 35Bf at the upper side in the drawing to be rotatable, and the flange 35Bf is fitted and inserted into the casing 35Be of the rotary joint 35B and fixed by the screw 35*h* (not shown) (procedure 6). Accordingly, the assembly of the cooling roller 22B of the type 2 and mounting of the rotary joint 35B are completed as illustrated in FIG. 42. The disassembly of the cooling roller 22 or the rotary joint 35 is performed by performing the above-described works reversely to the above-described work procedure. Thus, the components of the cooling roller 22 can be mounted or detached, and the rotary joint 35 can be mounted or detached in units of components.

A procedure of mounting the cooling roller 22B in which the rotary joints 35B are mounted to both ends thereof to the cooling device 18B is the same as the procedure of the configuration example 1 described with reference to FIG. 36, and thus description thereof is omitted.

As described above, when attachment or detachment between the rotor 35Ba and the flange 22*d*, between the roller outer tube 22Ba and the flange 22*d*, and the casing 35Be and the flange 35*f* is performed only by the screw coupling method or the rotation sections of the roller inner tube 22Bb and the bearing 35*k* are roughly fitted, the cooling roller 22B has axis misalignment. Thus, in order to increase the rotation accuracy of the cooling roller 22B, as in the present configuration example, it is necessary that the coupling section has the fitting section for axis alignment, and both ends of the rotation section are supported with the high degree of certainty, increasing the fitting accuracy.

Further, the cooling roller 22B of the dual tube structure can also increase the cooling efficiency by disposing the agitating unit inside the space formed between the roller outer tube 22Ba and the roller inner tube 22Bb, but axis alignment among the roller outer tube 22Ba, the roller inner tube 22Bb, and the rotary joint 35B needs to be performed. If such axis alignment is not performed, the rotation accuracy or durability of the cooling roller 22B deteriorates.

Configuration Example 3

Figure 43:
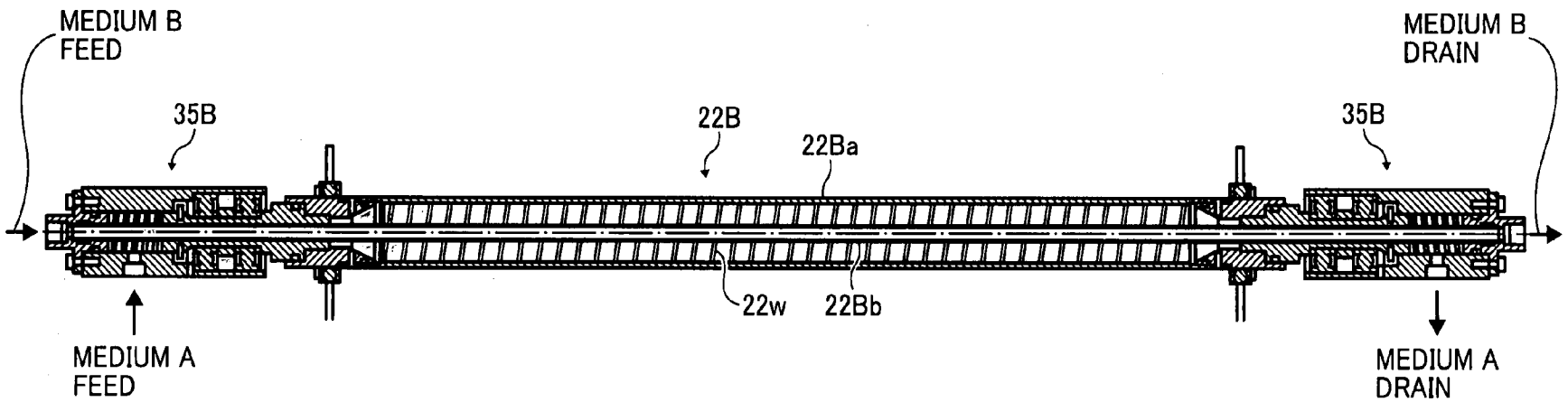
FIG. 43 is a schematic cross-sectional view illustrating a cooling roller in which a coil spring as an agitating unit is mounted to come in close contact with an inner wall of a roller tube according to the embodiment 2-2.

FIG. 43 is a schematic cross-sectional view illustrating a cooling roller 22B in which a coil spring 22*w* as an agitating unit is in close contact with and mounted to the inner wall of the roller outer tube 22Ba of the cooling roller 22B of the type 1 illustrated in the configuration example 1. The coil spring 22*w* rotates together with rotation of the roller outer tube 22Ba. As the coil spring 22*w* rotates, the cooling liquid (the medium A) is agitated and fed in the rotation direction and the axial direction, thereby improving the cooling performance of the roller outer tube 22Ba. Due to the same reason as described above, the cooling performance of the roller outer tube 22Ba in the cooling roller 22 of the type 2 illustrated in the configuration example 2 can be improved in a similar manner by mounting the coil spring 22*w* as the agitating unit in close contact with the inner wall of the roller outer tube 22Ba.

Figure 44:
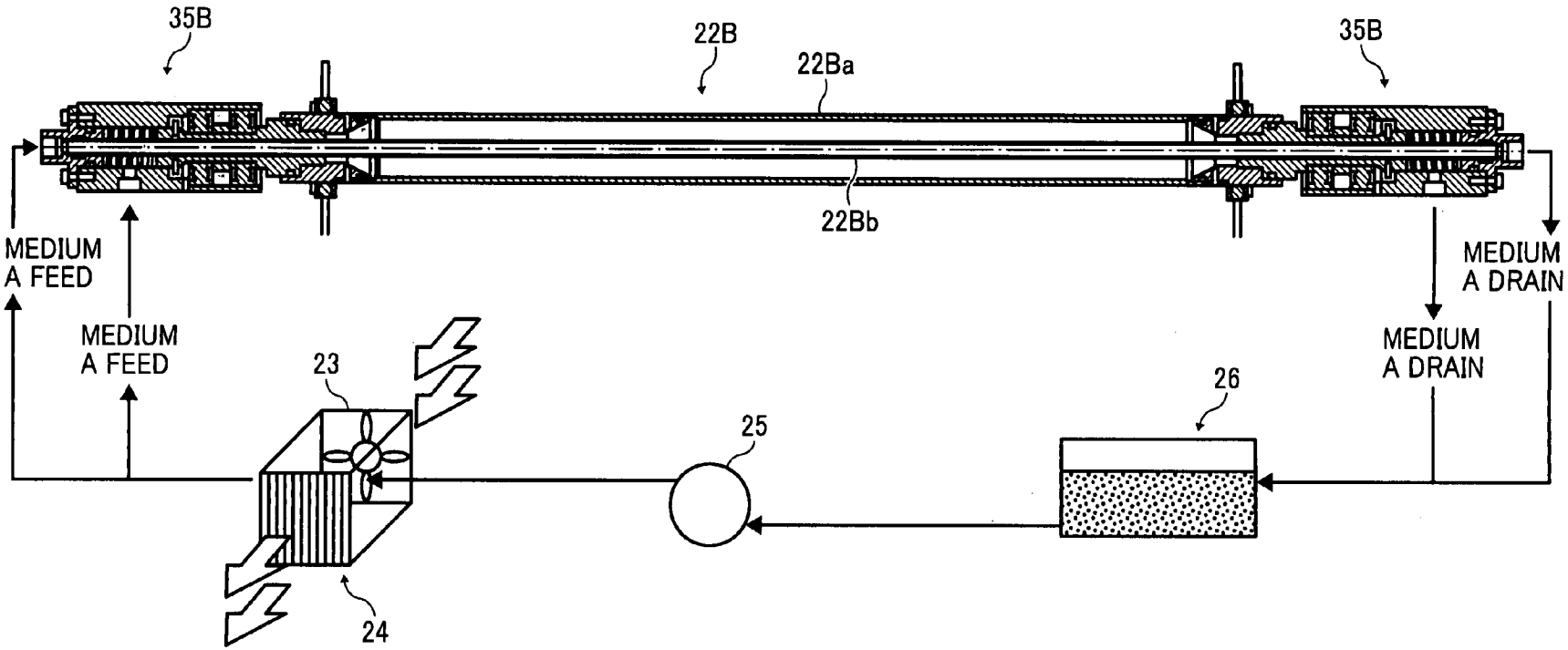
FIG. 44 is a schematic view illustrating a cooling liquid circulating system according to the embodiment 2-2.
Figure 45:
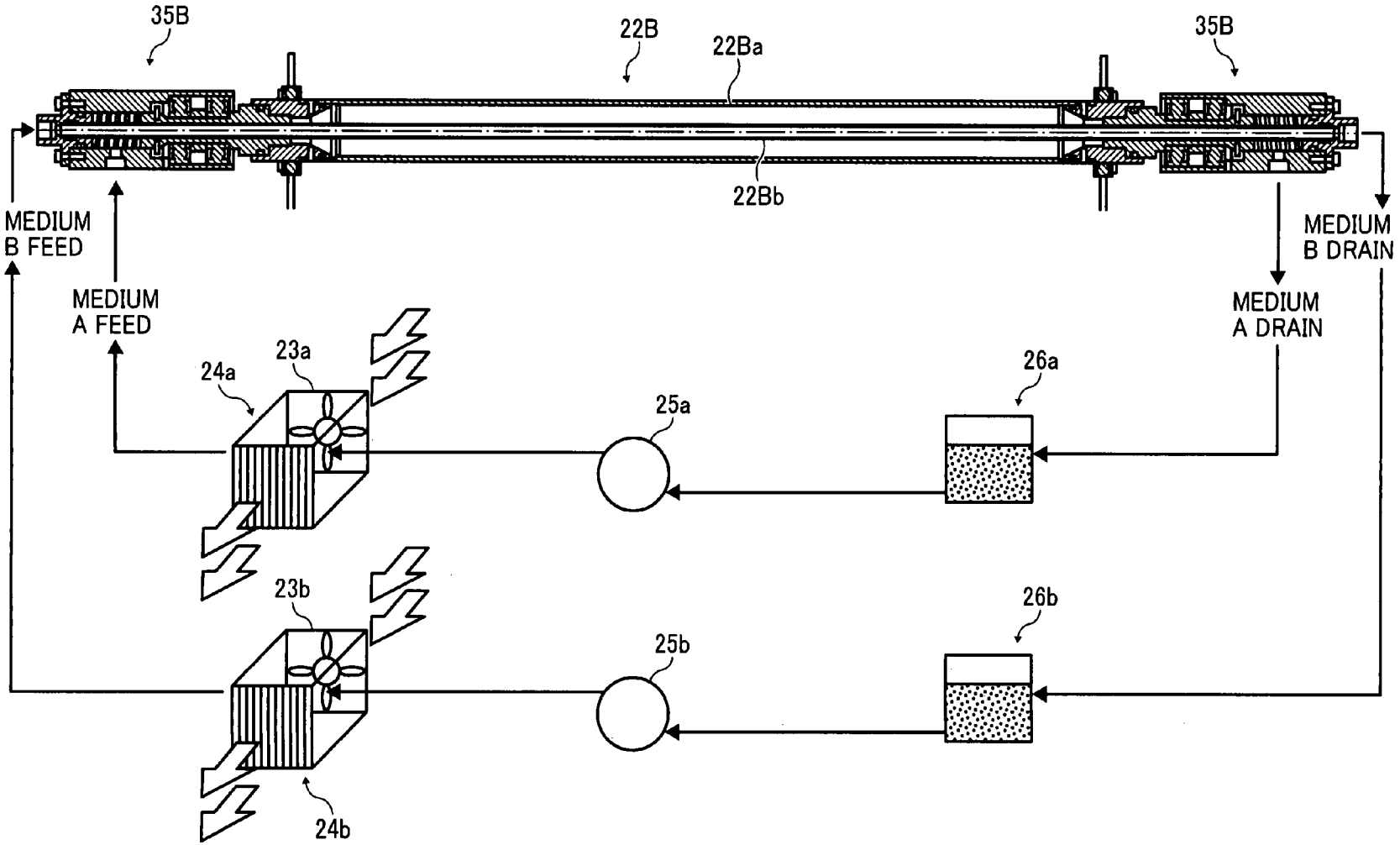
FIG. 45 is a schematic view illustrating a cooling liquid circulating system according to the embodiment 2-2.
Figure 46:
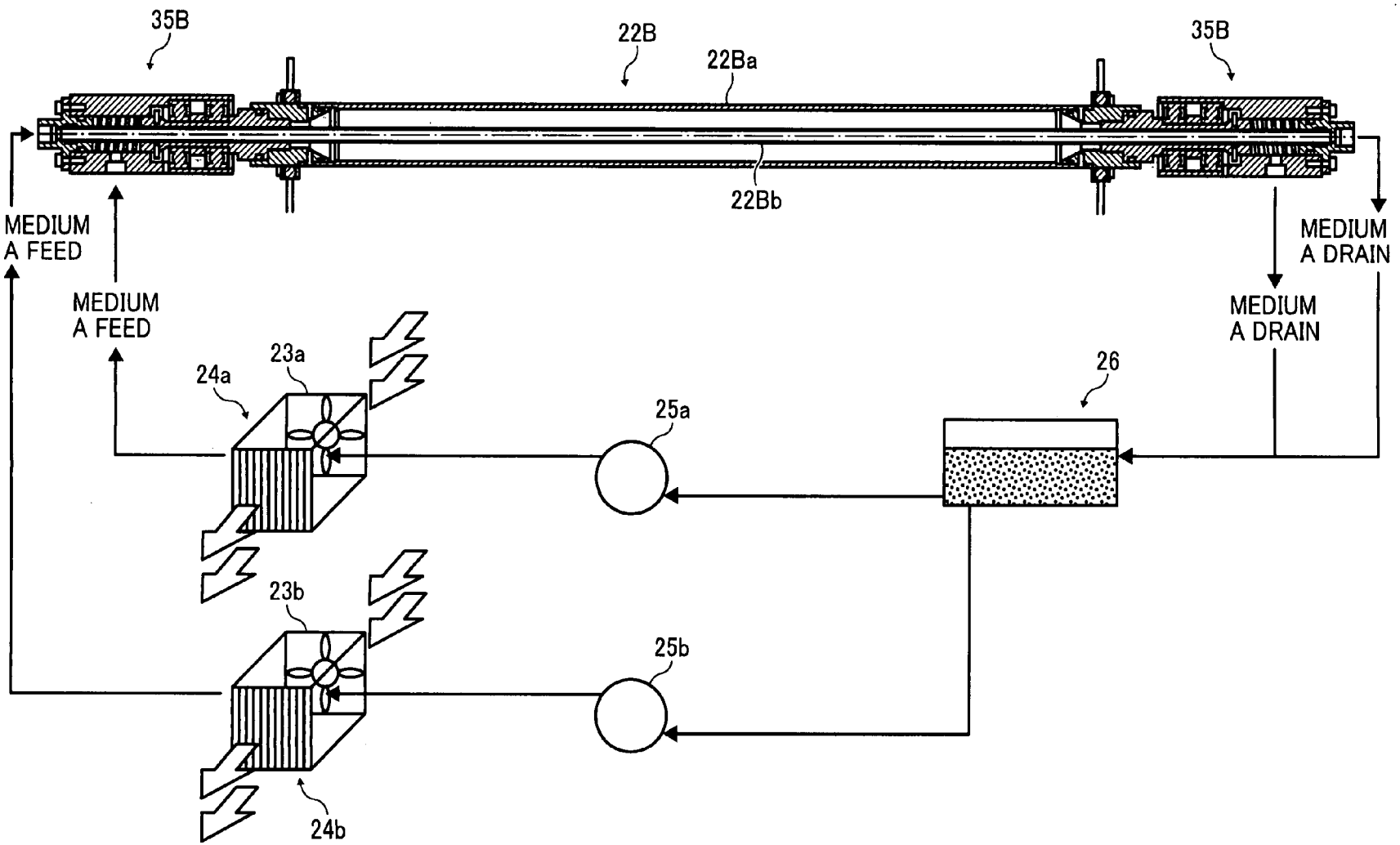
FIG. 46 is a schematic view illustrating a cooling liquid circulating system according to the embodiment 2-2.

Next, a cooling liquid circulating system in the cooling roller 22B in which individual flow passages are formed in the roller outer tube 22Ba and the roller inner tube 22Bb, respectively, by the dual tube structure is illustrated in FIGS. 44, 45, and 46. Each of FIGS. 44, 45, and 46 uses the cooling roller 22B of the type 1, but the same circulating system may be used even when the cooling roller 22B of the type 2 is used.

The cooling liquid circulating system forms a closed loop flow passage by the cooling roller 22B having two one directional flow passages thereinside and a cooling liquid circulating unit to circulate the cooling liquid. However, the circulating system becomes different depending on whether or not the flow passages of the roller outer tube 22Ba and the roller inner tube 22Bb share or individually have the cooling liquid circulating unit and whether the cooling liquid flowing through the roller outer tube 22Ba and the cooling liquid flowing through the roller inner tube 22Bb are the same or different, which will be described with reference to FIGS. 44, 45, and 46.

FIG. 44 schematically illustrates the circulating system in which the cooling liquid circulating unit that lets the cooling liquid to flow to the outside flow passage between the roller outer tube 22Ba and the roller inner tube 22Bb and the inside flow passage inside the inner tube is shared, and the same cooling liquid flows through the outside flow passage and the inside flow passage. As described above, since the same cooling liquid (the medium A) is used as the cooling liquid that is fed to and flows through the outside flow passage and the inside flow passage, the cooling liquid circulating unit is shared, and the closed loop flow passage of one system is configured.

A circulating process of the cooling liquid (the medium A) is as follows. In the roller outer tube 22Ba, heat received from the surface of the roller outer tube 22Ba that is rotating is transmitted to the inside, so that the cooling liquid (the medium A) inside the roller outer tube 22Ba is heated. The heated cooling liquid (the medium A) is drained from the rotary joint 35B at one side (at the upper side in the drawing) and passes through the cooling liquid circulating unit, that is, a tank 26, a pump 25, and a radiator 24 (including a cooling fan 23), so that the temperature of the cooling liquid (the medium A) drops to near the room temperature. The cooling liquid (the medium A) is fed from the rotary joint 35B at the other side (at the lower side in the drawing) to the roller outer tube 22Ba again. Further, in the roller inner tube 22Bb, the surface of the roller inner tube 22Bb receives heat from the heated cooling liquid (the medium A) inside the roller outer tube 22Ba to lower the temperature of the cooling liquid (the medium A) inside the roller outer tube 22Ba. The cooling liquid (the medium A), which is heated by receiving heat, inside the roller inner tube 22Bb is drained from the rotary joint 35B at one side (at the upper side in the drawing). Thereafter, the cooling liquid (the medium A) that is lowered in temperature by the cooling liquid circulating unit shared by the roller outer tube 22Ba is fed to the roller inner tube 22Bb again.

According to the heat exhaustion cycle of the two flow passages sharing the cooling liquid circulating unit, due to the heat receiving effect of the roller inner tube 22Bb, it is possible to lower the temperature of the cooling liquid in the outside flow passage in the roller outer tube 22Ba as well as in the radiator 24 section, that is, it is possible to prevent the surface temperature of the roller outer tube 22Ba from being raised. Therefore, it is possible to further improve the cooling efficiency compared to the single tube structure. Further, according to this configuration, the cooling efficiency can be improved, and since the cooling liquid circulating unit is shared and the same cooling liquid is used, the cost of the cooling liquid circulating system can be reduced, and the space can be saved.

FIG. 45 schematically illustrates the circulating system in which the cooling liquid circulating unit that lets the cooling liquid flow to the outside flow passage between the roller outer tube 22Ba and the roller inner tube 22Bb and the cooling liquid circulating unit that lets the cooling liquid flow to the inside flow passage inside the inner tube are individually disposed, and the same cooling liquid flows through the outside flow passage and the inside flow passage.

For example, the cooling liquid of the medium B flowing to the roller inner tube 22Bb illustrated in the drawing is changed to the medium A, the cooling liquid of the medium A which is the same as in the roller outer tube 22Ba flows, and the cooling liquid circulating unit are individually disposed. Even in the case of the same cooling liquid, unlike the circulating system of FIG. 44, closed loop flow passages of two systems are formed.

The cooling liquid circulating process of each of the roller outer tube 22Ba and the roller inner tube 22Bb is the same as in the circulating system illustrated in FIG. 44 except that the same cooling liquid (the medium A) flows through the individual cooling liquid circulating unit.

In the case of the circulating system illustrated in FIG. 44, at a point in time when drained from the roller outer tube 22Ba and the roller inner tube 22*b*, the cooling liquids (the media A) have a large temperature difference (the temperature of the cooling liquid drained from the roller outer tube 22Ba is higher), but since they pass through the same cooling liquid circulating unit, the cooling liquid having the same temperature are fed to the roller outer tube 22Ba and the roller inner tube 22Bb again. In order to lower the temperature of the cooling liquid, raised since the drained cooling liquids (the media A) are mixed in the tank 26, to near the room temperature, appropriate cooling power of the radiator 24 and the cooling fan 23 are necessary. Further, in order to further improve the cooling efficiency of the cooling roller 22B, it is effective to individually control the flow velocity or the temperature of the cooling liquid (the medium A) in the outside flow passage or the inside flow passage, but it is impossible to do it in the circulating system illustrated in FIG. 44.

However, since the circulating system illustrated in FIG. 45 can individually reduce the cooling powers of the radiators 24*a* and 24*b* and the cooling fans 23*a* and 23*b* and does not mix the cooling liquids (the media A), it is possible to individually adjust the temperatures of the cooling liquids (the media A) drained from the roller outer tube 22Ba and the roller inner tube 22Bb to the desired temperatures at a point in time when feeding resumes by individually setting the cooling performance of the radiator or the cooling fan. Since the cooling liquid circulating units are individually disposed, it is possible to individually control the rotation number of the pump 25*a* or 25*b* or the cooling fan 23*a* or 23*b*. Therefore, it is possible to adjust the flow velocity or the temperature of the cooling liquid (the medium A) inside the roller outer tube 22Ba or the roller inner tube 22Bb to a desired value.

As described above, the cooling performance can be controlled by taking appropriate measure in each flow passage. Further, according to this configuration, the cooling performance is improved, and even though the cooling liquid circulating units are individually disposed, since the same cooling liquid is used, a mistake of using a wrong cooling liquid when filling or replenishing the cooling liquid is prevented. Further, since the cooling liquid of one kind is used, it is easy to store or manage it.

Further, the circulating system illustrated in FIG. 45 may be configured such that the cooling liquid flowing through the outside flow passage between the roller outer tube 22Ba and the roller inner tube 22Bb is different from the cooling liquid flowing through the inside flow passage inside the inner tube.

That is, the closed loop flow passages of two systems are formed by individually disposing the cooling liquid circulating units, and the different cooling liquids flow such that the medium A flows to the roller outer tube 22Ba, and the medium B flows to the roller inner tube 22Bb. Circulating processes of the cooling liquid (the medium A) and the cooling liquid (the medium B) of the roller outer tube 22Ba and the roller inner tube 22Bb are the same as in the circulating system illustrated in FIG. 45, and description thereof is omitted. In the case of this configuration, measures such as individual setting or control of the cooling liquid circulating unit can be taken, an optimum medium can be used as the cooling liquid, and combination thereof can be variously set, whereby the cooling efficiency can be further improved. According to this configuration, compared to the circulating system of FIG. 44 or the circulating system of FIG. 45 that let the same cooling liquid to flow to the outside flow passage and the inside flow passage, the cooling performance is significantly improved. For this reason, the circulating system can be applied to a device in which the cooling performance is regarded as most important.

FIG. 46 schematically illustrates the circulating system in which the tank is shared by the outside flow passage between the roller outer tube 22Ba and the roller inner tube 22Bb and the inside flow passage inside the inner tube, the other circulating units are individually disposed for the outside flow passage and the inside flow passage, and the same cooling liquid flows to the outside flow passage and the inside flow passage.

As illustrated in FIG. 46, the tank 26 is shared by the outside flow passage and the inside flow passage, the same cooling liquid (the medium A) is fed and flows to the outside flow passage and the inside flow passage. However, the other cooling liquid circulating unit such as the pumps 25*a* and 25*b* and the radiators 24*a* and 24*b* (including the cooling fans 23*a* and 23*b*) are individually disposed for the outside flow passage and the inside flow passage, and thus, other than the tank, the closed loop flow passages of the two systems are formed. That is, except that the tank 26 is shared, it is the same as in the circulating system illustrated in FIG. 45. The circulating process of the cooling liquid (the medium A) is also the same as in the circulating system illustrated in FIG. 45 except that the cooling liquids (the media A) drained from the roller outer tube 22Ba and the roller inner tube 22Bb are first mixed in the tank 26 and then flow to the individual pumps 25*a* and 25*b*. According to this configuration, not only the merit of the circulating system illustrated in FIG. 45 is achieved, but also since the tank 26 is shared, the space is saved compared to the circulating system illustrated in FIG. 45.

Further, in the present embodiment, a liquid is used as the cooling medium, but the present invention is not limited thereto, but a gaseous body such as air or gas can be used as the cooling medium. Further, in the cooling roller 22B of the dual tube structure, a liquid may be used as a medium flowing to one of the roller outer tube 22Ba and the roller inner tube 22Bb, and a gaseous body may be used as a medium flowing to the other, thereby further improving the cooling effect.

In the meantime, the cooling liquid circulating system illustrated in FIG. 44 may be employed in the above-described image forming device of FIG. 14. Further, the above-described cooling liquid circulating system illustrated in FIG. 44 may be employed in the image forming device illustrated in FIG. 47. A basic operation of the image forming device is the same as in FIG. 14, and thus duplicated description thereof is omitted.

In the color image forming device of the present embodiment, the heat exhaustion cycle of the high cooling performance by the cooling liquid medium efficiently cools down the paper P heated by the heat fixing unit 16. Therefore, at a point in time when the paper P is discharged to and stacked on the discharge paper receiving unit 17, it is possible to harden the toner on the paper P with the high degree of certainty. Particularly, it is possible to avoid a blocking phenomenon that is a big problem at the time of two-sided image formation output. In addition, cooling using the cooling liquid does not require a large space that was required when using the conventional fan and can perform local cooling with high efficiency, thereby contributing to reducing the size of the image forming device.

Further, since the roller outer tube 22Ba and the roller inner tube 22Bb of the cooling roller 22B of the present invention and the rotary joints 35 at both sides are in a fixed or rotatable state with respect to each other by the fitting relationship, axis alignment among them can be performed with the high degree of certainty, realizing the coaxiality of the high accuracy. Accordingly, eccentricity or vibration caused by axis misalignment at the time of rotation is eliminated, and so the rotation accuracy or durability of the cooling roller 22B is improved, and it is possible to avoid a risk of a leak caused by eccentricity, vibration, or breakage and reduce the frequency of maintenance or component replacement. Further, if the rotation accuracy of the cooling roller 22B is improved, since the paper P can be properly transported, a high quality image can be obtained, and a jam or a skew caused by faulty rotation of the cooling roller 22B can be reduced. Therefore, when a high-speed image forming process of 100 or more pieces of A4-size papers per minute is continuously performed for a long time (for example, during several days), since a risk of a leak of the cooling liquid from the cooling roller 22 can be avoided, the image forming process can be continuously performed without interruption.

As described above, according to the present embodiment, the cooling device 18B has a dual tube structure in which the roller inner tube 22Bb as the inner tube is disposed inside the outer tube composed of the roller outer tube 22Ba and the flanges 22*d* mounted to both ends of the roller outer tube 22Ba, and the outside flow passage that allows the cooling liquid to flow through between the roller outer tube 22Ba and the roller inner tube 22Bb and the inside flow passage that allows the cooling liquids to flow inside the roller inner tube 22Bb are formed, includes the cooling roller 22B that is rotatably supported to the housing of the device main body through the bearing, the pump 25 as the cooling medium transport unit that transports the cooling medium, and the rotary joints 35 as the rotating tube joint unit that is mounted to both ends of the cooling roller 22B in a state in which the cooling roller 22B is rotatable and the cooling roller 22B is connected with the pump 25 through the tube, and enables the cooling roller 22B to contact the sheet-like member to cool down the sheet-like member. Both ends of the outer tube are coaxially rotatably fitted into and mounted to the fitting sections 35Bc as first fitting sections of the rotary joints 35B. Both ends of the roller inner tube 22Bb are coaxially fitted into and fixedly or rotatably supported to the bearing 35*k* as second fitting sections of the rotary joints 35. Accordingly, since the three components of the roller outer tube 22Ba, the roller inner tube 22Bb, and the rotary joint 35 are mounted in a fitting relationship of being capable of further preventing rattling compared to screw coupling, axis misalignment among the three components of the roller outer tube 22Ba, the roller inner tube 22Bb, and the rotary joint 35 can be reduced compared to the screw coupling. As axis misalignment among the three components is reduced, vibration of the rotary joint 35 generated due to eccentricity when the roller outer tube rotates can be reduced compared to the case of the screw coupling.

Further, according to the present embodiment, both ends of the roller inner tube 22Bb are fixedly supported to the rotary joints 35, the roller outer tube 22Ba rotates, and the roller inner tube 22Bb is fixed and does not rotate. Thus, the cooling roller of the present embodiment is appropriate to the case of desiring to actively generate the turbulence in the flow (the flow in the axial direction and the rotation direction) of the cooling liquid flowing through the space formed between the outer tube and the roller inner tube 22Bb, and particularly, is effective in the case where the supply flow quantity of the cooling liquid is small or the flow velocity in the space formed between the outer tube and the roller inner tube 22Bb is slow. Therefore, the cooling performance can be improved by generating the turbulence in the flow of the cooling liquid.

Further, according to the present embodiment, both ends of the roller inner tube 22Bb are fixedly supported to the rotary joints 35. Thus, the cooling roller of the present embodiment is appropriate to the case of desiring to make smooth the flow (the flow in the axial direction and the rotation direction) of the cooling liquid flowing through the space formed between the outer tube and the roller inner tube 22Bb, and particularly, is effective in the case where the supply flow quantity of the cooling liquid is abundant or the flow velocity in the space formed between the outer tube and the roller inner tube 22Bb is fast. Therefore, the cooling performance can be improved by making smooth the flow of the cooling liquid.

Further, according to the present embodiment, the roller inner tube 22Bb and the outer tube can be mounted to or detached from the rotary joint 35. Since the components can be easily mounted or detached to assemble or disassemble the cooling roller 22B, it is possible to respond to reuse, recycling, or component replacement when a failure occurs.

Further, according to the present embodiment, the cooling medium is fed to the outside flow passage and the inside flow passage by the common pump 25, and thus it is possible to reduce the cost and save the space.

Further, according to the present embodiment, the cooling medium is fed to the outside flow passage and the inside flow passage by the individual pumps 25, and thus it is possible to further improve the cooling performance of the cooling roller 22B by individual cooling control.

Further, according to the present embodiment, since the same cooling medium is circulated in the outside flow passage and the inside flow passage, the cost can be reduced. Further, it is possible to save the space of the cooling liquid circulating system and reduce a work mistake in storing or replenishing the cooling medium.

Further, according to the present embodiment, the different cooling media are circulated in the outside flow passage and the inside flow passage, and thus the cooling liquid is optimally selected, thereby providing the cooling roller 22B with the significantly excellent cooling performance.

Further, according to the present embodiment, the agitating unit that agitates the cooing liquid is disposed between the outer tube and the roller inner tube 22Bb. Therefore, the cooling efficiency can be improved by actively greatly agitating the flow of the cooling liquid flowing inside the space formed between the outer tube and the roller inner tube 22Bb.

Further, according to the present embodiment, in the image forming device including the toner image forming unit for forming the toner image on the paper P as the sheet-like member, the heat fixing unit 16 for fixing the toner image formed on the paper P on the paper P by at least heat, and the cooling unit for cooling down the paper P on which the toner image is fixed by the heat fixing unit 16, the cooling device 18B of the present invention is used as the cooling unit. Since the cooling device 18B having the cooling roller 22B having the cooling performance and the rotation accuracy significantly higher than the conventional device is mounted in the image forming device, the image forming device in which the paper cooling effect and the paper transport accuracy are improved and the space is saved can be provided.

Embodiment 3

Next, an embodiment 3 of the present invention will be described.

Figure 48:
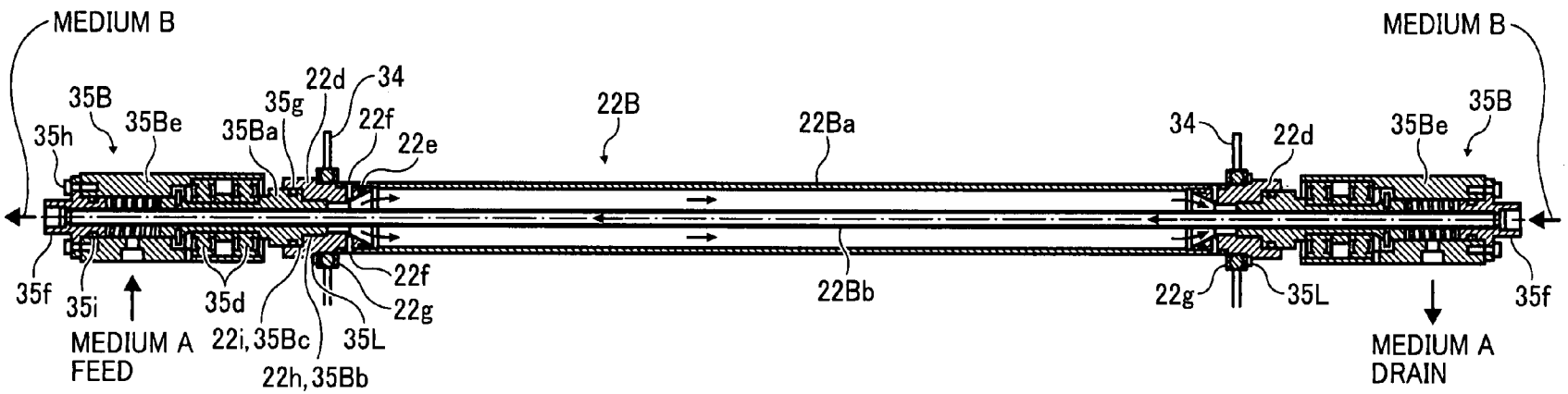
FIG. 48 is a schematic cross-sectional view illustrating a cooling device having a cooling roller of a dual tube structure according to an embodiment 3.

FIG. 48 is a schematic cross-sectional view illustrating a cooling roller 22B of the present invention in which a duplex rotary joint 35B as a rotating tube joint unit is mounted to both ends thereof. The cooling roller of FIG. 48 is different from that of FIG. 31 in a flow direction of the cooling liquid. The basic operation of the cooling roller is the same, and thus description thereof is omitted.

In the present embodiment, the flow direction of the cooling liquid flowing through the outside flow passage between the roller outer tube 22Ba and the roller inner tube 22Bb is reverse to the flow direction of the cooling liquid flowing through the inside flow passage inside the roller inner tube 22Bb in the axial direction of the cooling roller.

The flow direction of the cooling liquid flowing through the outside flow passage is reverse to the flow direction of the cooling liquid flowing through the inside flow passage in the axial direction of the cooling roller. If the cooling liquid flows through the outside flow passage from one end side to the other end side in the axial direction, the cooling liquid flows through the inside flow passage from the other end side to one end side. Thus, the temperature of the cooling liquid in the outside flow passage is higher at position closer the other end side by heat that the cooling roller 22B absorbs from the paper, and the cooling liquid in the outside flow passage closer to the other end side can be cooled down by the cooling liquid having a lower temperature in the inside flow passage. Further, if the cooling liquid flows through the outside flow passage from the other end side to one end side, the cooling liquid in the inside flow passage is made to flow from one end side to the other end side. Thus, the cooling liquid closer to the one end side in the outside flow passage and having higher temperature due to heat absorbed from paper by the cooling roller 22B can be cooled down by the cooling liquid having lower temperature in the inside flow passage. Therefore, compared to the conventional configuration in which the direction in which the cooling liquid flows through the outside flow passage is the same as the direction in which the cooling liquid flows through the inside flow passage, it is possible to further reduce the temperature difference of the cooling liquid flowing through the outside flow passage in the axial direction of the cooling roller. As a result, since the surface temperature difference of the cooling roller in the axial direction of the cooling roller is reduced, it is possible to reduce the difference in the cooling efficiency on the paper that occurs in the axial direction of the cooling roller.

Further, in the configuration of the cooling roller 22B, the direction of the cooling liquid flowing inside the inner tube is reverse to those in FIGS. 32 and 33, and its configuration is the same, and thus description thereof is omitted.

Subsequently, different types of cooling roller will be described below. These cooling roller have the above-described configuration is common, however, a manner of supporting the roller inner tube 22Bb is different. There are two types: a type 1; and a type 2, and a configuration of each of the two types will be described.

Configuration Example 1

Cooling Roller of the Type 1

The cooling roller of the type 1 is configured such that the roller outer tube 22Ba rotates, and the roller inner tube 22Bb does not rotate.

The cooling roller 22B of the type 1 will be described below. This type has the configuration of the cooling roller 22B illustrated in FIG. 48 and will be described focusing on the left end section of the cooling roller 22B. It is preferable to use the cooling roller 22B of the type 1 when desiring to generate the turbulence in the flow of the cooling liquid flowing through an outside flow passage between the roller outer tube 22Ba and the roller inner tube 22Bb.

As illustrated in FIG. 48, the rotary joints 35B mounted to both ends of the cooling roller 22B fixedly supports one end side of the roller inner tube 22Bb and fitting-supports or fixedly supports the other end thereof, respectively, so that the roller inner tube 22Bb does not rotate. Specifically, the roller inner tube 22Bb is mounted to the rotary joints 35B, for example, such that the roller inner tube 22Bb is fixedly supported to one rotary joint 35B by press-fitting into the flange 35*f* mounted to the casing 35Be, and is supported to or fixed to the other rotary joint 35B by or after fitting and inserting into the flange 35*f*. Since the casing 35Be, the flange 35*f*, and the roller inner tube 22Bb are mounted by inserting or press-fitting into each other in a fitting relationship, the roller inner tube 22Bb has the coaxiality with the casing 35Be. An O-ring 35*i* for leakage prevention is inserted into the flange 35*f*, and the flange 35*f* is fitted and inserted into and fixed to the casing 35Be by the screw 35*h*.

By the above-described configuration, at both ends of the cooling roller 22B, the roller outer tube 22Ba and the roller inner tube 22Bb have the coaxiality with reference to the rotary joint 35B (the casing 35Be). With respect to the rotary joint 35B (the casing 35Be), in a fitting relationship, the roller outer tube 22Ba is rotatably supported, and the roller inner tube 22Bb is supported not to rotate.

A flow passage of the cooling liquid is indicated by an arrow. A cooling liquid of a medium A is fed from a feed port of the rotary joint 35B, at a lower side in the drawing, which leads to the inside of the roller outer tube 22Ba, passes through a narrow space between the roller inner tube 22Bb and the rotor 35Ba, flows through a wide space formed between the roller outer tube 22Ba and the roller inner tube 22Bb in an axial direction, forms a one directional flow passage, and is drained from the rotary joint 35B at an opposite side (an upper side in the drawing). A cooling liquid of a medium B is fed from the rotary joint 35, at the upper side in the drawing, which leads to the inside of the roller inner tube 22Bb, flows through the inside of the roller inner tube 22Bb up to the rotary joint 35B at the opposite side, forms another one directional flow passage, and is drained. The cooling roller 22B of the dual tube structure has the two one directional flow passages in which the flow direction of the cooling liquid of the medium A flowing through the outside flow passage (the flow passage between the roller outer tube 22Ba and the roller inner tube 22Bb) is reverse to the flow direction of the cooling liquid of the medium B flowing through the inside flow passage (the flow passage inside the roller inner tube 22Bb) and forms a closed-loop flow passage together with a cooling liquid circulating unit through the rotary joints 35B at both ends to thereby circulate the cooling liquid of the medium A and the cooling liquid of the medium B.

The cooling liquid of the medium A and the cooling liquid of the medium B flow through the inside of the roller outer tube 22Ba and the inside of the roller inner tube 22Bb, respectively, to prevent the surface temperature of the roller outer tube 22Ba from being raised. Accordingly, the cooling performance of the cooling roller can be improved.

Further, the components of the cooling roller 22B can be mounted or detached, so that it is possible to respond to reuse, recycling, or component replacement when a failure occurs.

Next, an assembly procedure of the cooling roller according to the present embodiment is the same as the procedure described in detail with reference to FIGS. 34 to 36, and thus description thereof is omitted.

Configuration Example 2

Cooling Roller of the Type 2

The cooling roller of the type 2 is configured such that the roller outer tube 22Ba rotates, and the roller inner tube 22Bb rotates together with the roller outer tube 22Ba.

Figure 49:
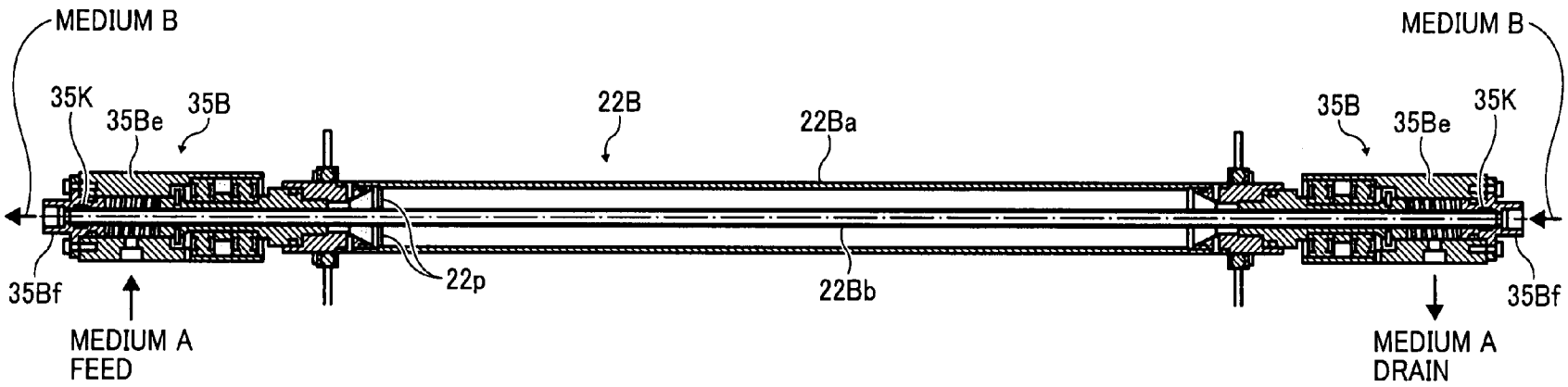
FIG. 49 is a schematic cross-sectional view illustrating a cooling roller in which a duplex rotary joint as a rotating tube joint unit is mounted to both ends according to the embodiment 3.

The cooling roller 22B of the type 2 is illustrated in FIG. 49. A left end section and a right end section of the cooling roller 22B of the type 2 are the same as those illustrated in the enlarged views of FIGS. 29 and 30. The cooling roller 22B of the type 2 is preferably used when desiring to make smooth the flow (the flow in the axial direction and the rotation direction) of the cooling liquid flowing through the outside flow passage between the roller outer tube 22Ba and the roller inner tube 22Bb.

An idea of performing axis alignment through a support method based on a fitting relationship is the same as in the cooling roller of the type 1. Unlike the cooling roller of the type 1, as illustrated in FIG. 49, both ends of the roller inner tube 22Bb are mounted to the flange 35Bf of the casing 35Be of the rotary joint 35B through the bearing 35*k* and rotatably supported so that the roller inner tube 22Bb can rotate. Thus, the roller inner tube 22Bb is supported to rotate together with the roller outer tube 22Ba with respect to the rotary joints 35B (the casings 35*e*) at both ends thereof. The roller inner tube 22Bb rotates such that rotational force of the roller outer tube 22Ba is transmitted to the roller inner tube 22Bb through, for example, an engagement unit, so that the roller inner tube 22Bb rotates together with the roller outer tube 22Ba. As the accompanying rotation method, the method described in detail with reference to FIG. 29 may be used.

Further, the components of the cooling roller 22B of the type 2 and the rotary joint 35B can be mounted or detached.

An assembly procedure of the components of the cooling roller according to the present embodiment is the same as the procedure described in detail with reference to FIGS. 40 to 42, and thus description thereof is omitted.

As described above, when attachment or detachment between the rotor 35Ba and the flange 22*d*, between the roller outer tube 22Ba and the flange 22*d*, and the casing 35Be and the flange 35*f* is performed only by the screw coupling method or the rotation sections of the roller inner tube 22Bb and the bearing 35*k* are roughly fitted, the cooling roller 22B has axis misalignment. Thus, in order to increase the rotation accuracy of the cooling roller 22B, as in the present configuration example, it is necessary that the coupling section has the fitting section for axis alignment, and both ends of the rotation section are supported with the high degree of certainty, increasing the fitting accuracy. Even in the cooling roller 22B of the present type, the flow direction of the cooling liquid (the medium A) flowing through the outside flow passage (the flow passage between the roller outer tube 22Ba and the roller inner tube 22Bb) is reverse to the flow direction of the cooling liquid (the medium B) flowing through the inside flow passage (the flow passage inside the roller inner tube 22Bb) in the axial direction of the cooling roller. Thus, as it is closer to the downstream side at which the temperature of the cooling liquid (the medium A) in the outside flow passage is raised by head that the cooling roller 22B absorbs from the paper P, the cooling liquid in the outside flow passage can be further cooled down by the cooling liquid (the medium B) having a low temperature in the inside flow passage. Accordingly, since the surface temperature difference of the cooling roller in the axial direction of the cooling roller is reduced, it is possible to reduce the difference in the cooling efficiency on the paper that is generated in the axial direction of the cooling roller.

Further, the cooling roller 22B of the dual tube structure can also increase the cooling efficiency by disposing the agitating unit inside the space formed between the roller outer tube 22Ba and the roller inner tube 22Bb.

Configuration Example 3

Figure 50:
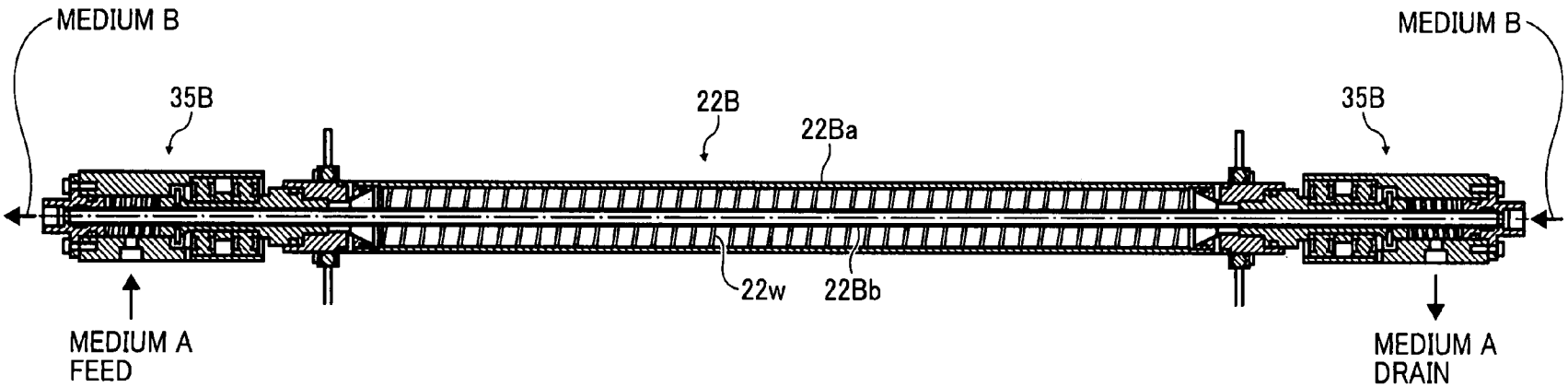
FIG. 50 is a schematic cross-sectional view illustrating a cooling roller in which a coil spring as an agitating unit is mounted to come in close contact with an inner wall of a roller tube according to the embodiment 3.

FIG. 50 is a schematic cross-sectional view illustrating a cooling roller 22B in which a coil spring 22*w* as an agitating unit is in close contact with and mounted to the inner wall of the roller outer tube 22Ba of the cooling roller 22B of the type 1 illustrated in the configuration example 1. The coil spring 22*w* rotates together with rotation of the roller outer tube 22Ba. As the coil spring 22*w* rotates, the cooling liquid (the medium A) is agitated and fed in the rotation direction and the axial direction, thereby improving the cooling performance of the roller outer tube 22Ba. Due to the same reason as described above, the cooling performance of the roller outer tube 22Ba in the cooling roller 22 of the type 2 illustrated in the configuration example 2 can be improved in a similar manner by mounting the coil spring 22*w* as the agitating unit in close contact with the inner wall of the roller outer tube 22Ba.

Figure 51:
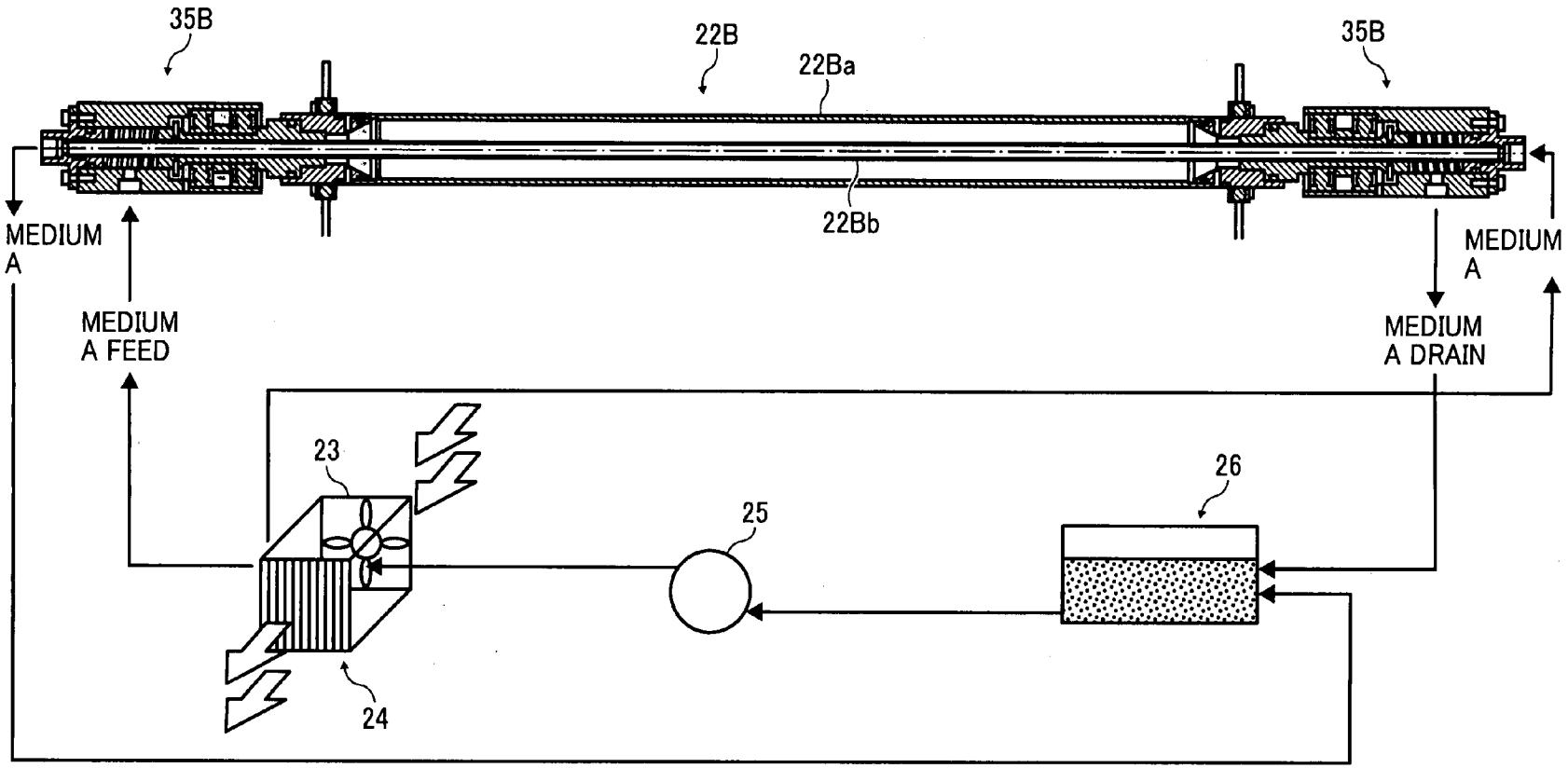
FIG. 51 is a schematic view illustrating a cooling liquid circulating system according to the embodiment 3.
Figure 52:
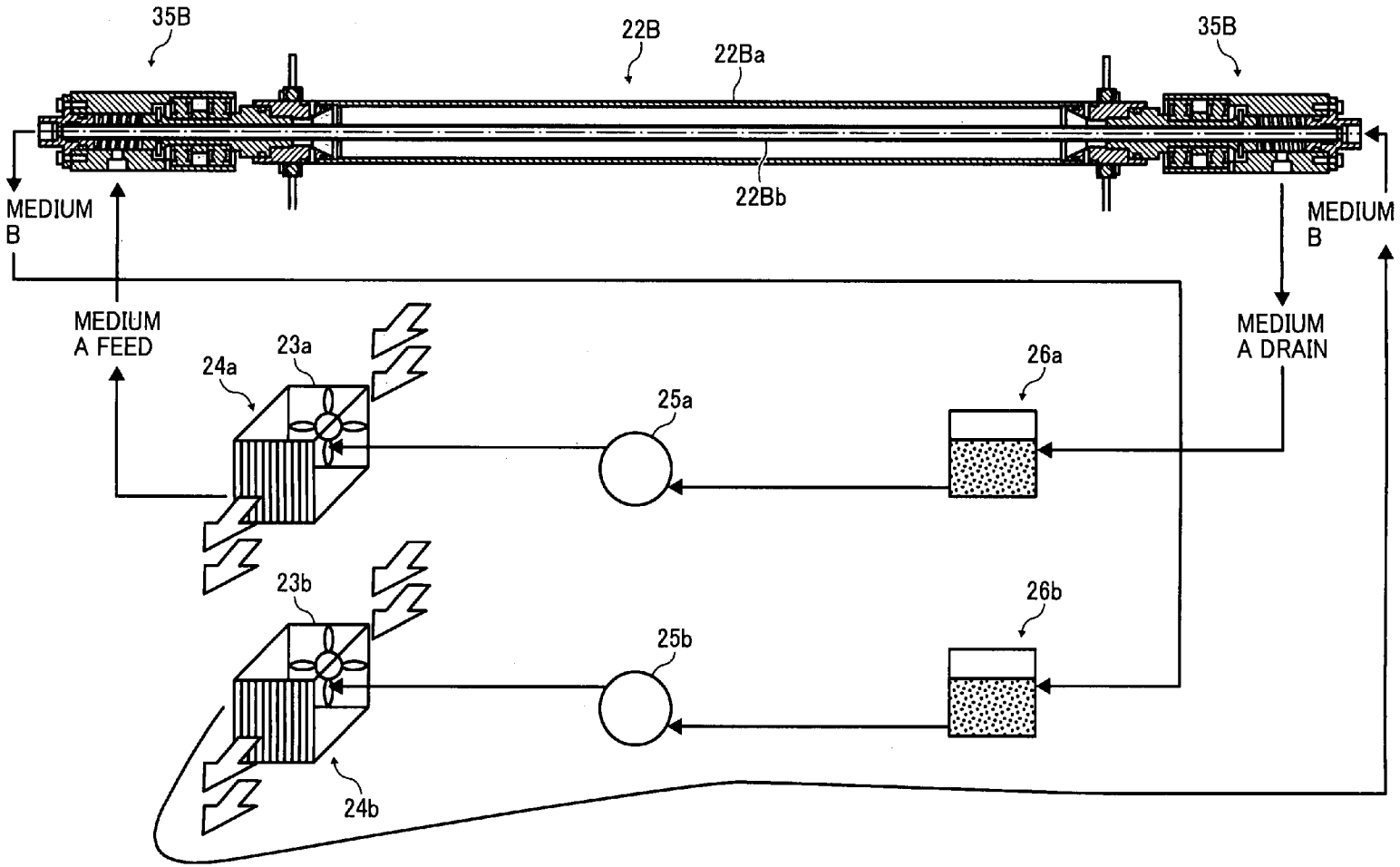
FIG. 52 is a schematic view illustrating a cooling liquid circulating system according to the embodiment 3.
Figure 53:
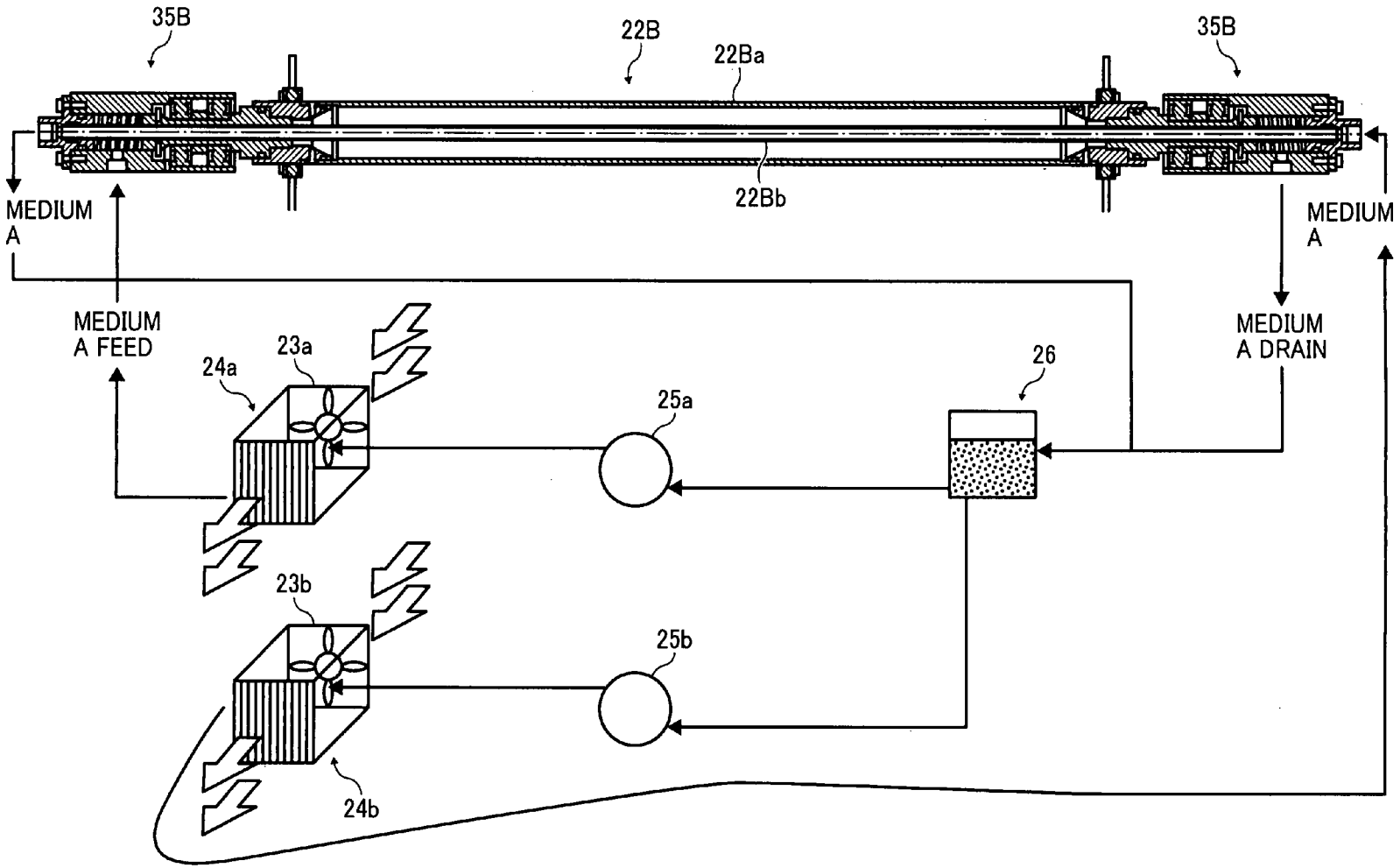
FIG. 53 is a schematic view illustrating a cooling liquid circulating system according to the embodiment 3.
Figure 54:
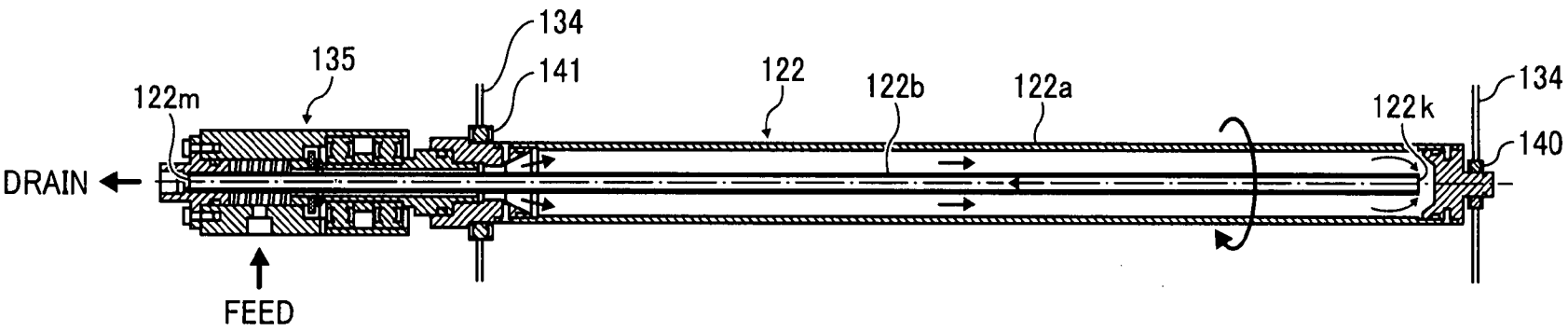
FIG. 54 is a schematic cross-sectional view illustrating a conventional cooling roller.

Next, a cooling liquid circulating system in the cooling roller 22B in which individual flow passages are formed in the roller outer tube 22Ba and the roller inner tube 22Bb, respectively, by the dual tube structure is illustrated in FIGS. 51, 52, and 53. Each of FIGS. 51, 52, and 53 uses the cooling roller 22B of the type 1, but the same circulating system may be used even when the cooling roller 22B of the type 2 is used.

In the cooling roller 22B of the present type, the flow direction of the cooling liquid (the medium A) flowing through the outside flow passage (the flow passage between the roller outer tube 22Ba and the roller inner tube 22Bb) is reverse to the flow direction of the cooling liquid (the medium B) flowing through the inside flow passage (the flow passage inside the roller inner tube 22Bb) in the axial direction of the cooling roller. Thus, the cooling liquid closer to the downstream side in the outside flow passage and having higher temperature due to heat absorbed from paper P by the cooling roller 22B can be cooled down by the cooling liquid (the medium B) having lower temperature in the inside flow passage. Accordingly, since the surface temperature difference of the cooling roller in the axial direction of the cooling roller is reduced, it is possible to reduce the difference in the cooling efficiency on the paper that is generated in the axial direction of the cooling roller.

The cooling liquid circulating system forms a closed loop flow passage by the cooling roller 22B having two one directional flow passages thereinside and a cooling liquid circulating unit to circulate the cooling liquid. However, the circulating system becomes different depending on whether or not the flow passages of the roller outer tube 22Ba and the roller inner tube 22Bb share or individually have the cooling liquid circulating unit and whether the cooling liquid flowing through the roller outer tube 22Ba and the cooling liquid flowing through the roller inner tube 22Bb are the same or different, which will be described with reference to FIGS. 51, 52, and 53.

FIG. 51 schematically illustrates the circulating system in which the cooling liquid circulating unit that lets the cooling liquid flow to the outside flow passage between the roller outer tube 22Ba and the roller inner tube 22Bb and the inside flow passage inside the inner tube is shared, and the same cooling liquid flows through the outside flow passage and the inside flow passage. As described above, since the same cooling liquid (the medium A) is used as the cooling liquid that is fed to and flows through the outside flow passage and the inside flow passage, the cooling liquid circulating unit is shared, and the closed loop flow passage of one system is configured.

A circulating process of the cooling liquid (the medium A) is as follows. In the roller outer tube 22Ba, heat received from the surface of the roller outer tube 22Ba that is rotating is transmitted to the inside, so that the cooling liquid (the medium A) inside the roller outer tube 22Ba is heated. The heated cooling liquid (the medium A) is drained from the rotary joint 35B at one side (at the upper side in the drawing) and passes through the cooling liquid circulating unit, that is, a tank 26, a pump 25, and a radiator 24 (including a cooling fan 23), so that the temperature of the cooling liquid (the medium A) drops to near the room temperature. The cooling liquid (the medium A) is fed from the rotary joint 35B at the other side (at the lower side in the drawing) to the roller outer tube 22Ba again. Further, in the roller inner tube 22Bb, the surface of the roller inner tube 22Bb receives heat from the heated cooling liquid (the medium A) inside the roller outer tube 22Ba to lower the temperature of the cooling liquid (the medium A) inside the roller outer tube 22Ba. The cooling liquid (the medium A), which is heated by receiving heat, inside the roller inner tube 22Bb is drained from the rotary joint 35B at the other side (at the lower side in the drawing). Thereafter, the cooling liquid (the medium A) that is lowered in temperature by the cooling liquid circulating unit shared with the roller outer tube 22Ba is fed from the rotary joint 35B at one side (at the upper side in the drawing) to the roller inner tube 22Bb again.

According to the heat exhaustion cycle of the two flow passages sharing the cooling liquid circulating unit, due to the heat receiving effect of the roller inner tube 22Bb, it is possible to lower the temperature of the cooling liquid in the outside flow passage in the roller outer tube 22Ba as well as in the radiator 24 section, that is, it is possible to prevent the surface temperature of the roller outer tube 22Ba from being raised. Therefore, it is possible to further improve the cooling efficiency compared to the simple tube structure. Further, according to this configuration, the cooling efficiency can be improved, and since the cooling liquid circulating unit is shared and the same cooling liquid is used, the cost of the cooling liquid circulating system can be reduced, and the space can be saved.

FIG. 52 schematically illustrates the circulating system in which the cooling liquid circulating unit that lets the cooling liquid flow to the outside flow passage between the roller outer tube 22Ba and the roller inner tube 22Bb and the cooling liquid circulating unit that lets the cooling liquid flow to the inside flow passage inside the inner tube are individually disposed, and the same cooling liquid flows through the outside flow passage and the inside flow passage.

For example, the cooling liquid of the medium B flowing to the roller inner tube 22Bb illustrated in the drawing is changed to the medium A, the cooling liquid of the medium A which is the same as in the roller outer tube 22Ba flows, and the cooling liquid circulating unit are individually disposed. Even in the case of the same cooling liquid, unlike the circulating system of FIG. 51, closed loop flow passages of two systems are formed.

The cooling liquid circulating process of each of the roller outer tube 22Ba and the roller inner tube 22Bb is the same as in the circulating system illustrated in FIG. 51 except that the same cooling liquid (the medium A) flows through the individual cooling liquid circulating unit.

In the case of the circulating system illustrated in FIG. 51, at a point in time when drained from the roller outer tube 22Ba and the roller inner tube 22*b*, the cooling liquids (the media A) have a large temperature difference (the temperature of the cooling liquid drained from the roller outer tube 22Ba is higher), but since they pass through the same cooling liquid circulating unit, the cooling liquids having the same temperature are fed to the roller outer tube 22Ba and the roller inner tube 22Bb again. In order to lower the temperature of the cooling liquid, raised since the drained cooling liquids (the media A) are mixed in the tank 26, to near the room temperature, appropriate cooling power of the radiator 24 and the cooling fan 23 are necessary. Further, in order to further improve the cooling efficiency of the cooling roller 22B, it is effective to individually control the flow velocity or the temperature of the cooling liquid (the medium A) in the outside flow passage or the inside flow passage, but it is impossible to do it in the circulating system illustrated in FIG. 51.

However, since the circulating system illustrated in FIG. 52 can individually reduce the cooling powers of the radiators 24*a* and 24*b* and the cooling fans 23*a* and 23*b* and does not mix the cooling liquids (the media A), it is possible to individually adjust the temperatures of the cooling liquids (the media A) drained from the roller outer tube 22Ba and the roller inner tube 22Bb to the desired temperatures at a point in time when feeding resumes by individually setting the cooling performance of the radiator or the cooling fan. Since the cooling liquid circulating units are individually disposed, it is possible to individually control the rotation number of the pump 25*a* or 25*b* or the cooling fan 23*a* or 23*b*. Therefore, it is possible to adjust the flow velocity or the temperature of the cooling liquid (the medium A) inside the roller outer tube 22Ba or the roller inner tube 22Bb to a desired value.

As described above, the cooling performance can be controlled by taking appropriate measure in each flow passage. Further, according to this configuration, the cooling performance is improved, and even though the cooling liquid circulating units are individually disposed, since the same cooling liquid is used, a mistake of using a wrong cooling liquid when filling or replenishing the cooling liquid is prevented. Further, since the cooling liquid of one kind is used, it is easy to store or manage it.

Further, the circulating system illustrated in FIG. 52 may be configured such that the cooling liquid flowing through the outside flow passage between the roller outer tube 22Ba and the roller inner tube 22Bb is different from the cooling liquid flowing through the inside flow passage inside the inner tube.

That is, the closed loop flow passages of two systems are formed by individually disposing the cooling liquid circulating units, and the different cooling liquids flow such that the medium A flows to the roller outer tube 22Ba, and the medium B flows to the roller inner tube 22Bb. Circulating processes of the cooling liquid (the medium A) and the cooling liquid (the medium B) of the roller outer tube 22Ba and the roller inner tube 22Bb are the same as in the circulating system illustrated in FIG. 52, and description thereof is omitted. In the case of this configuration, measures such as individual setting or control of the cooling liquid circulating unit can be taken, an optimum medium can be used as the cooling liquid, and combination thereof can be variously set, whereby the cooling efficiency can be further improved. According to this configuration, compared to the circulating system of FIG. 51 or the circulating system of FIG. 52 that let the same cooling liquid to flow to the outside flow passage and the inside flow passage, the cooling performance is significantly improved. For this reason, the circulating system can be applied to a device in which the cooling performance is regarded as most important.

FIG. 53 schematically illustrates the circulating system in which the tank is shared by the outside flow passage between the roller outer tube 22Ba and the roller inner tube 22Bb and the inside flow passage inside the inner tube, the other circulating units are individually disposed for the outside flow passage and the inside flow passage, and the same cooling liquid flows to the outside flow passage and the inside flow passage.

As illustrated in FIG. 53, the tank 26 is shared by the outside flow passage and the inside flow passage, the same cooling liquid (the medium A) is fed and flows to the outside flow passage and the inside flow passage. However, the other cooling liquid circulating unit such as the pumps 25*a* and 25*b* and the radiators 24*a* and 24*b* (including the cooling fans 23*a* and 23*b*) are individually disposed for the outside flow passage and the inside flow passage, and thus, other than the tank, the closed loop flow passages of the two systems are formed. That is, except that the tank 26 is shared, it is the same as in the circulating system illustrated in FIG. 52. The circulating process of the cooling liquid (the medium A) is also the same as in the circulating system illustrated in FIG. 52 except that the cooling liquids (the media A) drained from the roller outer tube 22Ba and the roller inner tube 22Bb are first mixed in the tank 26 and then flow to the individual pumps 25*a* and 25*b*. According to this configuration, not only the merit of the circulating system illustrated in FIG. 52 is achieved, but also since the tank 26 is shared, the space is saved compared to the circulating system illustrated in FIG. 52.

Further, in the present embodiment, a liquid is used as the cooling medium, but the present invention is not limited thereto, but a gaseous body such as air or gas can be used as the cooling medium. Further, in the cooling roller 22B of the dual tube structure, a liquid may be used as a medium flowing to one of the roller outer tube 22Ba and the roller inner tube 22Bb, and a gaseous body may be used as a medium flowing to the other, thereby further improving the cooling effect.

Figure 47:
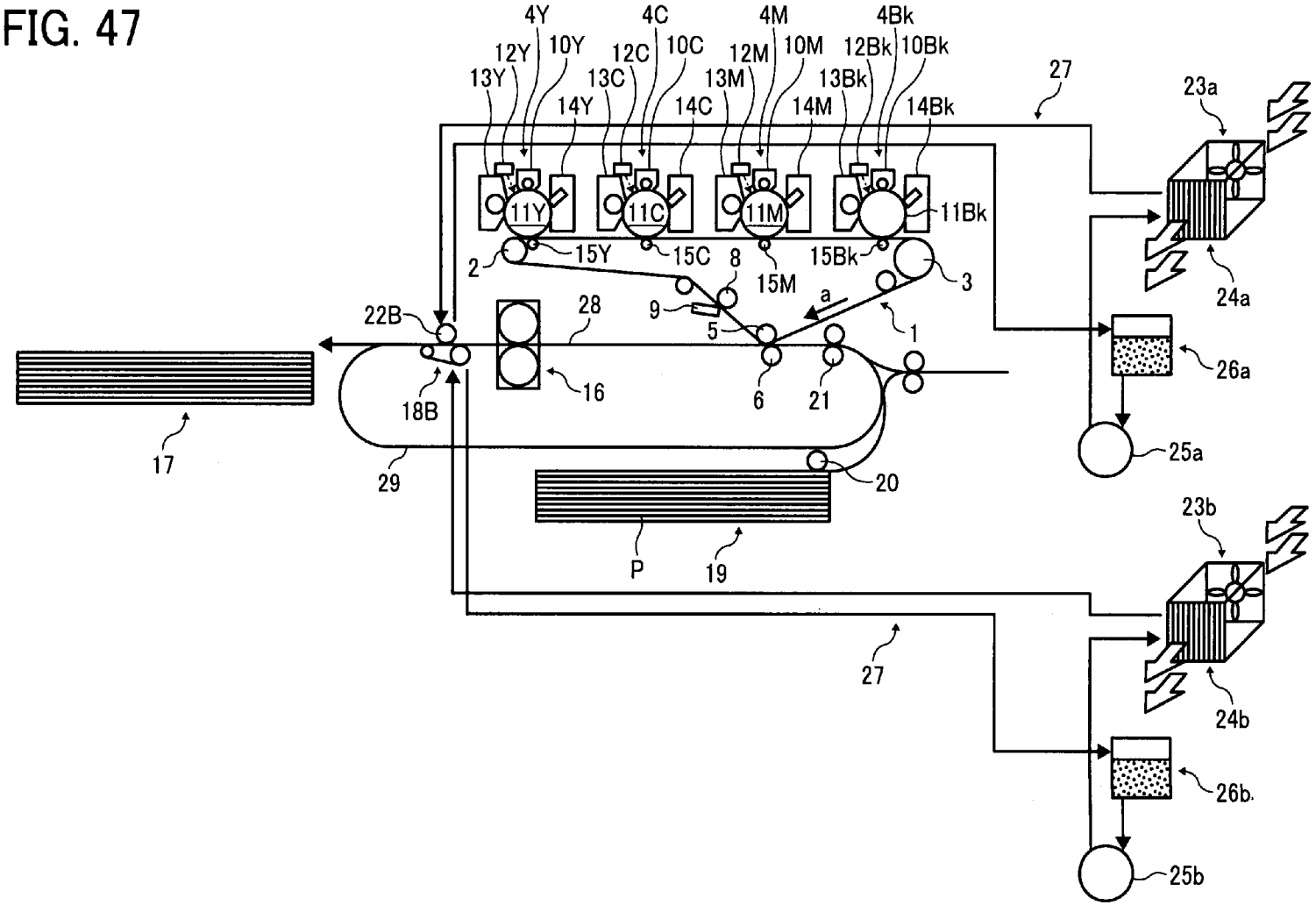
FIG. 47 is a schematic configuration diagram illustrating a color image forming device of a tandem type intermediate transfer belt method in which a cooling device including a cooling roller of a dual tube structure and a cooling liquid circulating system is installed according to the embodiment 2-2.

Further, a configuration operation of the color image forming device in which the cooling roller according to the present embodiment is installed and the cooling liquid circulating system is employed is the same as in FIG. 14 and FIG. 47, and thus duplicated description thereof is omitted.

The heat exhaustion cycle of the high cooling performance by the cooling liquid medium efficiently cools down the paper P heated by the heat fixing unit 16. Therefore, at a point in time when the paper P is discharged to and stacked on the discharge paper receiving unit 17, it is possible to harden the toner on the paper P with the high degree of certainty. Particularly, it is possible to avoid a blocking phenomenon that was a big problem at the time of two-sided image formation output. In addition, cooling using the cooling liquid does not require a large space that was required when using the conventional fan and can perform local cooling with high efficiency, thereby contributing to reducing the size of the image forming device. Therefore, when a high-speed image forming process of 100 or more pieces of A4-size papers per minute is continuously performed for a long time (for example, during several days), the image forming device of the present embodiment can reduce the surface temperature gradient in the axial direction of the cooling roller and reduce a problem such as a jam that may be caused when the paper is curled, thereby continuously performing the image forming process without interruption.

Further, the roller outer tube 22Ba and the roller inner tube 22Bb of the cooling roller 22B of the present invention and the rotary joints 35 at both sides are preferably in a fixed or rotatable state with respect to each other by the fitting relationship. Since they are in a fixed or rotatable state with respect to each other by the fitting relationship, axis alignment among them can be performed with the high degree of certainty, realizing the coaxiality of the high accuracy. Accordingly, eccentricity or vibration caused by axis misalignment at the time of rotation is eliminated, and so the rotation accuracy or durability of the cooling roller 22B is improved. It is possible to avoid a risk of a leak caused by eccentricity, vibration, or breakage and reduce the frequency of maintenance or component replacement. Further, if the rotation accuracy of the cooling roller 22B is improved, since the paper P can be properly transported, a high quality image can be obtained, and a jam or a skew caused by faulty rotation of the cooling roller 22B can be reduced.

As described above, according to the present embodiment, the cooling device 18B has a dual tube structure in which the roller inner tube 22Bb is disposed inside the outer tube composed of the roller outer tube 22Ba and the flanges 22*d* and 22*f* mounted to both ends of the roller outer tube 22Ba, and the outside flow passage that allows the cooling liquid to flow through between the outer tube and the roller inner tube 22Bb and the inside flow passage that allows the cooling liquids to flow inside the roller inner tube 22Bb are formed, includes the cooling roller 22B that is rotatably supported to the housing of the device main body through the bearing, the pump 25 as the cooling medium transport unit that transports the cooling medium, and the rotary joints 35 as the rotating tube joint unit that is mounted to both ends of the cooling roller 22B in a state in which the cooling roller 22B is rotatable and the cooling roller 22B is connected with the pump 25 through the tube, and enables the cooling roller 22B to contact the sheet-like member to cool down the sheet-like member. The flow direction of the cooling liquid, in the outside flow passage, fed to the outside flow passage by the pump 25 is reverse to the flow direction of the cooling liquid, in the inside flow passage, fed to the inside flow passage by the pump 25. The flow direction of the cooling liquid flowing through the outside flow passage is reverse to the flow direction of the cooling liquid flowing through the inside flow passage in the axial direction of the cooling roller 22B. Accordingly, the surface temperature gradient of the cooling roller 22B of the dual tube structure is reduced, and thus the cooling roller 22B with the high cooling performance can be provided.

Further, according to the present embodiment, both ends of the roller outer tube are rotatably supported to the rotary joints 35, and both ends of the roller inner tube 22Bb are fixedly supported to the rotary joints 35. Thus, the cooling roller of the present embodiment is appropriate to the case of desiring to actively generate the turbulence in the flow (the flow in the axial direction and the rotation direction) of the cooling liquid flowing through the space formed between the roller outer tube and the roller inner tube 22Bb, and particularly, is effective in the case where the supply flow quantity of the cooling liquid is small or the flow velocity in the space formed between the roller outer tube and the roller inner tube 22Bb is slow. Therefore, the cooling performance can be improved by generating the turbulence in the flow of the cooling liquid.

Further, according to the present embodiment, both ends of the roller outer tube and both ends of the roller inner tube 22Bb are fixedly supported to the rotary joints 35. Thus, the cooling roller of the present embodiment is appropriate to the case of desiring to make smooth the flow (the flow in the axial direction and the rotation direction) of the cooling liquid flowing through the space formed between the roller outer tube and the roller inner tube 22Bb, and particularly, is effective in the case where the supply flow quantity of the cooling liquid is abundant or the flow velocity in the space formed between the roller outer tube and the roller inner tube 22Bb is fast. Therefore, the cooling performance can be improved by making smooth the flow of the cooling liquid.

Further, according to the present embodiment, the cooling medium is fed to the outside flow passage and the inside flow passage by the common pump 25, and thus it is possible to reduce the cost and save the space.

Further, according to the present embodiment, the cooling medium is fed to the outside flow passage and the inside flow passage by the individual pumps 25, and thus it is possible to further improve the cooling performance of the cooling roller 22B by individual cooling control.

Further, according to the present embodiment, since the same cooling medium is circulated in the outside flow passage and the inside flow passage, the cost can be reduced. Further, it is possible to save the space of the cooling liquid circulating system and reduce a work mistake in storing or replenishing the cooling medium.

Further, according to the present embodiment, the different cooling media are circulated in the outside flow passage and the inside flow passage, and thus the cooling liquid is optimally selected, thereby providing the cooling roller 22B with the significantly excellent cooling performance.

Further, according to the present embodiment, the coil spring 22*w* as the agitating unit that agitates the cooing liquid is disposed between the outer tube and the roller inner tube 22Bb. Therefore, the cooling efficiency can be improved by actively greatly agitating the flow of the cooling liquid flowing inside the space formed between the outer tube and the roller inner tube 22Bb.

Further, according to the present embodiment, the agitating unit that agitates the cooing liquid is disposed in the roller inner tube 22Bb. Therefore, the cooling efficiency can be improved by actively greatly agitating the flow of the cooling liquid flowing through the inside of the roller inner tube 22Bb.

Further, according to the present embodiment, both ends of the outer tube are coaxially rotatably fitted into and mounted to the fitting sections 35Bc as first fitting sections of the rotary joints 35B. Both ends of the roller inner tube 22Bb are coaxially fitted into and fixedly or rotatably supported to the bearing 35*k* as second fitting sections of the rotary joints 35. Accordingly, since the three components of the roller outer tube, the roller inner tube 22Bb, and the rotary joint 35 are mounted in a fitting relationship of being capable of further preventing rattling compared to screw coupling, axis misalignment among the three components of the roller outer tube, the roller inner tube 22Bb, and the rotary joint 35 can be reduced compared to the screw coupling. As axis misalignment among the three components is reduced, vibration of the rotary joint 35 generated due to eccentricity when the roller outer tube rotates can be reduced compared to the case of the screw coupling.

Further, according to the present embodiment, in the image forming device including the toner image forming unit for forming the toner image on the paper P as the sheet-like member, the heat fixing unit 16 for fixing the toner image formed on the paper P on the paper P by at least heat, and the cooling unit for cooling down the paper P on which the toner image is fixed by the heat fixing unit 16, the cooling device 18B of the present invention is used as the cooling unit. Since the cooling device 18 having the cooling roller 22 having the cooling performance and the rotation accuracy significantly higher than the conventional device is mounted in the image forming device, the image forming device in which the paper cooling effect and the paper transport accuracy are improved and the space is saved can be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cooling device, comprising:

a cooling roller having a dual tube structure in which an inner tube is disposed inside an outer tube, and an outside flow passage in which a cooling medium flows between the outer tube and the inner tube and an inside flow passage in which a cooling medium flows inside the inner tube are formed, including an opening, formed in the inner tube, that allows the outside flow passage to communicate with the inside flow passage, and being rotatably supported to a housing of a device main body through bearings;

a cooling medium transport unit that transports the cooling medium; and a rotating tube joint unit that is mounted to one end side of the cooling roller so that the cooling roller is rotatable and connects the cooling roller with the cooling medium transport unit through a pipe, wherein the cooling roller contacts a sheet-like member to cool down the sheet-like member, one end side of the outer tube is coaxially rotatably fitted into and mounted to a first fitting section of the rotating tube joint unit, one end side of the inner tube is coaxially fitted into and rotatably or fixedly supported to a second fitting section of the rotating tube joint unit, and the other end side is coaxially fitted into and rotatably or fixedly supported to a fitting section formed at the other end side of the outer tube.

2. The cooling device according to claim 1, wherein one end side of the inner tube is fixedly supported to the rotating tube joint unit, and the other end side is rotatably supported to the outer tube.

3. The cooling device according to claim 1, wherein one end side of the inner tube is rotatably supported to the rotating tube joint unit, and the other end side is fixedly supported to the outer tube.

4. The cooling device according to claim 1, wherein the inner tube has a large diameter section and a small diameter section.

5. The cooling device according to claim 1, further comprising:

a cylinder disposed between the outer tube and the inner tube so that a space is formed between an inner wall of the outer tube and an outer wall thereof, wherein the cylinder is coaxially fitted into a fitting section of the inner tube and is supported to the inner tube rotatably or fixedly with respect to the inner tube.

6. The cooling device according to claim 5, wherein the cylinder is fixedly supported to the inner tube in a fitting relationship, and one end side of the inner tube is fixedly supported to the rotating tube joint unit, and the other end side is rotatably supported to the outer tube.

7. The cooling device according to claim 5, wherein the cylinder is engaged with or fixedly supported to the inner tube in a fitting relationship, and one end side of the inner tube is rotatably supported to the rotating tube joint unit, and the other end side is fixedly supported to the outer tube.

8. The cooling device according to claim 5, wherein the cylinder is engaged with or fixedly supported to the outer tube in a fitting relationship, and one end side of the inner tube is fixedly supported to the rotating tube joint unit, and the other end side is rotatably supported to the outer tube or the cylinder.

9. An image forming device comprising the cooling device recited in claim 1.

10. A cooling device, comprising:

a cooling roller having a dual tube structure in which an inner tube is disposed inside an outer tube, and an outside flow passage in which a cooling medium flows between the outer tube and the inner tube and an inside flow passage in which a cooling medium flows inside the inner tube are formed and being rotatably supported to a housing of a device main body through a bearings;

a cooling medium transport unit that transports the cooling medium; and a rotating tube joint unit that is mounted to both ends of the cooling roller so that the cooling roller is rotatable and connects the cooling roller with the cooling medium transport unit, wherein the cooling roller contacts a sheet-like member to cool down the sheet-like member, fitting sections formed at both ends of the outer tube are coaxially rotatably fitted into first fitting sections of the rotating tube joint unit, respectively, fitting sections formed at both ends of the inner tube are coaxially fitted into second fitting sections of the rotating tube joint unit, respectively, in a rotatable or fixed state.

11. The cooling device according to claim 10, wherein the cooling medium is transported by the cooling medium transport unit which is common for the outside flow passage and the inside flow passage.

12. The cooling device according to claim 10, wherein the cooling medium is transported by the cooling medium transport unit which is individually disposed for the outside flow passage and the inside flow passage.

13. The cooling device according to claim 10, further comprising, a cooling medium agitating unit, which agitates the cooling medium, disposed between the outer tube and the inner tube.

14. An image forming device comprising the cooling device recited in claim 10.

15. A cooling device, comprising:

a cooling roller having a dual tube structure in which an inner tube is disposed inside an outer tube, and an outside flow passage in which a cooling medium flows between the outer tube and the inner tube and an inside flow passage in which a cooling medium flows inside the inner tube are formed and being rotatably supported to a housing of a device main body through bearings;

a cooling medium transport unit that transports the cooling medium; and a rotating tube joint unit that is mounted to both ends of the cooling roller so that the cooling roller is rotatable and connects the cooling roller with the cooling medium transport unit, wherein the cooling roller contacts a sheet-like member to cool down the sheet-like member, a flow direction of a cooling medium, in the outside flow passage, transported to the outside flow passage by the cooling medium transport unit is reverse to a flow direction of a cooling medium, in the inside flow passage, transported to the inside flow passage by the cooling medium transport unit in an axial direction of the cooling roller.

16. The cooling device according to claim 15, wherein the cooling medium is transported by the cooling medium transport unit which is common for the outside flow passage and the inside flow passage.

17. The cooling device according to claim 15, wherein the cooling medium is transported by the cooling medium transport unit which is individually disposed for the outside flow passage and the inside flow passage.

18. The cooling device according to claim 15, further comprising, a cooling medium agitating unit, which agitates the cooling medium, disposed between the outer tube and the inner tube.

19. The cooling device according to claim 15, wherein both ends of the outer tube are coaxially rotatably fitted into and mounted to first fitting sections of the rotating tube joint unit, and both ends of the inner tube are coaxially fitted into and rotatably or fixedly supported to second fitting sections of the rotating tube joint unit.

20. An image forming device comprising the cooling device recited in claim 15.

* * * * *